US009914070B2

(12) United States Patent
Brooks et al.

(10) Patent No.: US 9,914,070 B2
(45) Date of Patent: Mar. 13, 2018

(54) INTERACTIVE FOLDING BOOK

(71) Applicant: The Foliage Library, Export, PA (US)

(72) Inventors: Emily Brooks, Kinderhook, NY (US); Matthew Holbein, Export, PA (US)

(73) Assignee: The Foliage Library, Export, PA (US)

( * ) Notice: Subject to any disclaimer, the term of this patent is extended or adjusted under 35 U.S.C. 154(b) by 73 days.

(21) Appl. No.: 15/155,259

(22) Filed: May 16, 2016

(65) Prior Publication Data

US 2016/0332089 A1 Nov. 17, 2016

Related U.S. Application Data

(60) Provisional application No. 62/162,670, filed on May 16, 2015.

(51) Int. Cl.

| | |
|---|---|
| ***B42D 1/00*** | (2006.01) |
| ***A63H 33/38*** | (2006.01) |
| ***B42D 5/00*** | (2006.01) |

(52) U.S. Cl.

CPC ..... *A63H 33/38* (2013.01); *B42D 1/001* (2013.01); *B42D 1/003* (2013.01); *B42D 1/006* (2013.01); *B42D 5/003* (2013.01)

(58) Field of Classification Search

CPC ..... B42D 1/003; B42D 1/006; B42D 5/003
USPC ..... 281/15.1, 16; 40/124.09, 124.13
See application file for complete search history.

(56) References Cited

U.S. PATENT DOCUMENTS

| | | | | | |
|---|---|---|---|---|---|
| 3,614,835 | A * | 10/1971 | Rice | F16B 5/0607 | 434/211 |
| 3,629,967 | A * | 12/1971 | Bass | A63H 33/16 | 446/488 |
| 4,120,100 | A * | 10/1978 | Dugan | B42D 1/003 | 40/539 |
| 4,627,640 | A * | 12/1986 | Markovics | B42D 1/08 | 283/34 |
| 6,006,457 | A * | 12/1999 | Transport | G09F 1/06 | 40/124.14 |
| 6,158,777 | A * | 12/2000 | Twardosz | B42D 15/008 | 281/2 |
| 6,431,606 | B1 * | 8/2002 | Lowe | B42D 1/00 | 281/22 |
| 2008/0008852 | A1 * | 1/2008 | Perry | B42D 1/006 | 283/106 |
| 2015/0047524 | A1 * | 2/2015 | Todie | B42D 15/008 | 101/483 |

* cited by examiner

*Primary Examiner* — Kyle Grabowski
(74) *Attorney, Agent, or Firm* — Spruce Law Group, LLC

(57) ABSTRACT

A folding book moves between a collapsed configuration and an expanded configuration. The book includes a book body and a plurality of layers forming the book body. Each layer moves between a folded configuration and an unfolded configuration. The folding book moves from the collapsed configuration to the expanded configuration by moving each layer of the plurality of layers from the folded configuration to the unfolded configuration in a predetermined order.

20 Claims, 52 Drawing Sheets

74
54
56A
66B
24
181
68
41
183B
46B
64B
184B
58
62
66A
183A
60B
10
41
184A
182
185B
44
24
64A
46A
186B
43A
41
185A
46B
24
45A
186A
45B
60A
44A
43A
104
100
90
104
54
50
104
44B
43B
186B
45A
24
60B
42
46A
45B
185B
41
186A
46B
185A
43A
182
41
184B
46B
44A
60A
45B
24
183B
184A
45A
24
46A
183A
181
41
68
54
56
74

INTERACTIVE FOLDING BOOK

CROSS REFERENCE TO RELATED APPLICATION

This application claims the benefit of U.S. Provisional Patent Application No. 62/162,670 filed May 16, 2015, which is incorporated herein by reference as if fully set forth herein.

BACKGROUND

Books are effective devices for teaching and entertaining children. Conventional children's books are constructed of a series of bound pages displaying text and images. Such books may be ineffective at thoroughly engaging children, as repeatedly flipping through pages may not hold a child's attention. Interactive books are one means of increasing engagement between children and books. Like conventional books, interactive books typically require repeated flipping of pages in order to reach the interactive material. A need exists for a book that requires complex interaction between the reader and the book in order to proceed through the written or illustrated material contained therein.

SUMMARY OF THE EMBODIMENTS

The application discloses a folding book that moves between a collapsed configuration and an expanded configuration. The book includes a book body and a plurality of layers forming the book body. Each layer moves between a folded configuration and an unfolded configuration. The folding book moves from the collapsed configuration to the expanded configuration by moving each layer of the plurality of layers from the folded configuration to the unfolded configuration in a predetermined order.

The application further discloses a folding book that moves between a collapsed configuration and an expanded configuration. The book includes a book body having a hexagonal shape and a plurality of layers forming the book body. Each layer includes a plurality of identical layer sections, and each layer section includes a plurality of scores defining a predetermined fold pattern. Each layer moves between a folded configuration and an unfolded configuration by folding the layer sections about the scores. The folding book moves from the collapsed configuration to the expanded configuration by moving each layer of the plurality of layers from the folded configuration to the unfolded configuration in a predetermined order.

The application further discloses a method of moving a folded book from a collapsed configuration to an expanded configuration. The method includes providing the book. The book includes a book body and a plurality of layers that each move between a folded configuration and an unfolded configuration. The method further includes unfolding each layer in a predetermined order, to move each of the layers from the folded configuration to the unfolded configuration and move the book from the collapsed configuration to an expanded configuration.

DETAILED DESCRIPTION OF THE EMBODIMENTS

Figure 1:
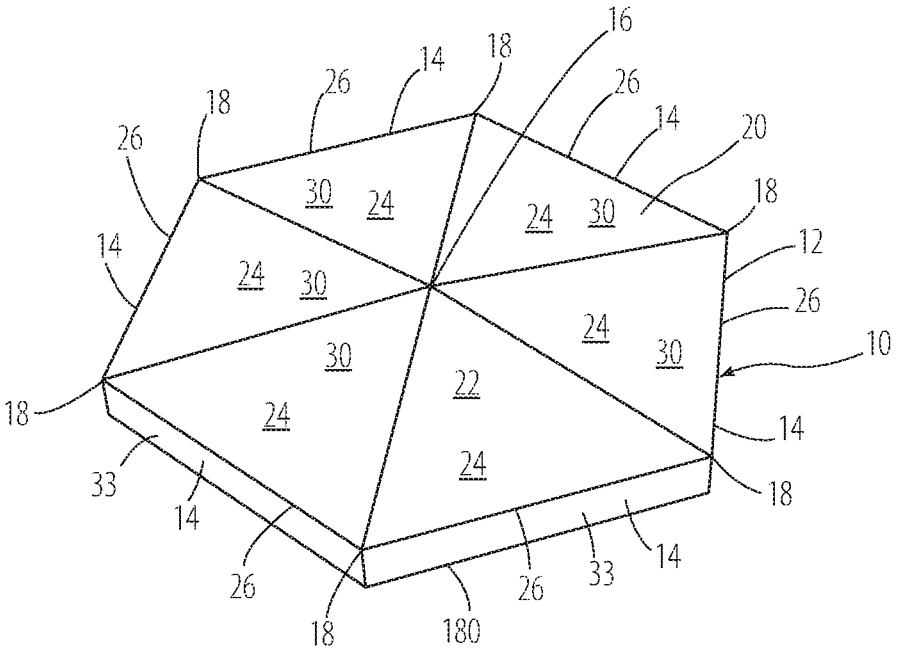
FIG. 1 is a perspective view of a first embodiment of a folding book, in a collapsed configuration.

The term "pleat" or "pleating" as used in this application, shall be defined as a plurality of folds creating hinges extending in alternating opposite directions.

A first embodiment of an interactive folding book 10 according to the invention is shown in FIGS. 1-12. The folding book 10 moves between a collapsed configuration, shown in FIG. 1, and an expanded configuration, shown in FIG. 12. As shown, the folding book 10 comprises a body 12 having a simple polygonal shape, which is a hexagonal shape in the embodiment shown. The body 12 has a stacked four layer construction including a first or top layer 20, a second layer 50 located just beneath the first layer 20, a third layer 100 located just beneath the second layer 50, and a fourth or bottom layer 150 located just beneath the third layer 100. A book base 180 is located beneath the fourth or bottom layer 150.

Each layer moves between a folded and an unfolded configuration in a selected order, to move the folding book 10 from the collapsed configuration to the expanded configuration, as described in detail below. Each layer includes a plurality of layer sections. At least one of the layer sections may comprises a polygonal shape similar to that of the body 12, for example a hexagonal shape in the embodiment of FIGS. 1-12, as described below. Each of the layer sections individually moves between a folded configuration and an unfolded configuration, to move the layer between the folded configuration and the unfolded configuration, as described in further detail below.

As shown in FIG. 1, the hexagonal body 12 includes a center 16 and six sides 14 extending between six vertices 18. In one embodiment, the hexagonal body 12 has a diameter of 8 inches, with each side 14 having a length of 4 inches, and a thickness of ½ inch, but the dimensions may vary depending on desired use and appearance of the folding book 10.

Referring to FIGS. 1-4, the first layer 20 and a first stage of expansion of the folding book 10 is shown in detail. As shown, the first layer 20, in the folded configuration of FIG. 1, has a hexagonal shape and a top surface 22 forming a top surface of the folding book 10.

The first layer 20 is formed of six identical first layer sections 24. Each first layer section 24 moves between a folded configuration, shown in FIG. 1, and an unfolded configuration, shown in FIG. 4. As shown, in the folded configuration, each first layer section 24 has a triangular shape, and in the unfolded configuration has a hexagonal shape. Referring to FIG. 1, the triangular shape is that of an equilateral triangle, and each side has a length that may be equal to the length of each side 14 of the body 12, for example 4 inches. When in the folded configuration, the first layer sections 24 fit together to form a hexagonal shape that may have same dimensions as the hexagonal shape of the folding book body 12, as shown in FIG. 1.

Figure 2:
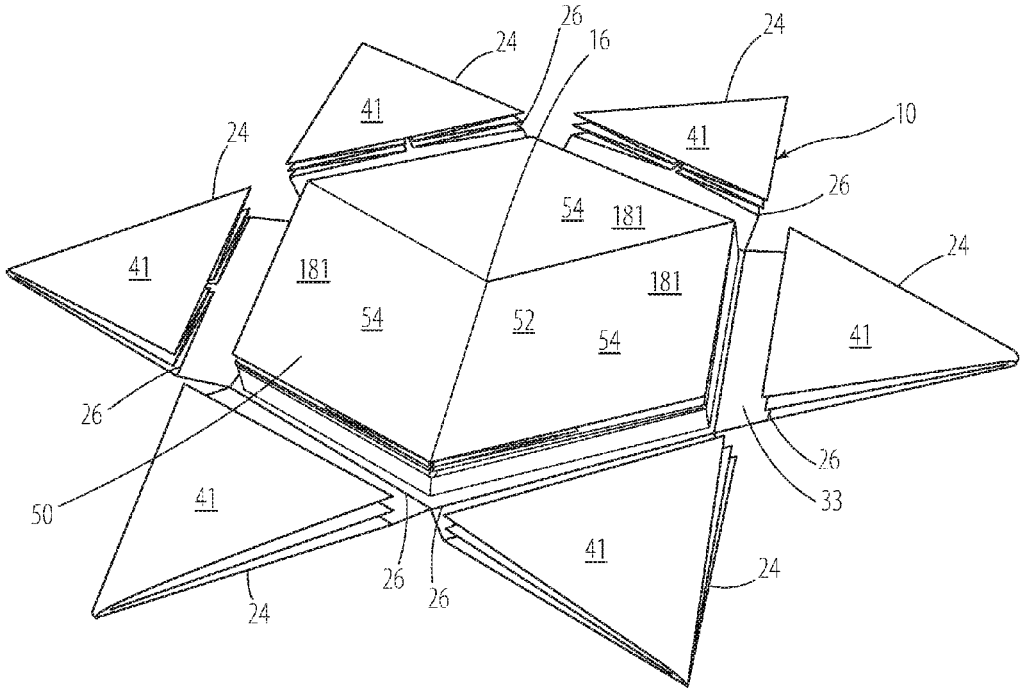
FIG. 2 is a perspective view of the folding book of FIG. 1, showing the first layer in a partially unfolded configuration.
Figure 3:
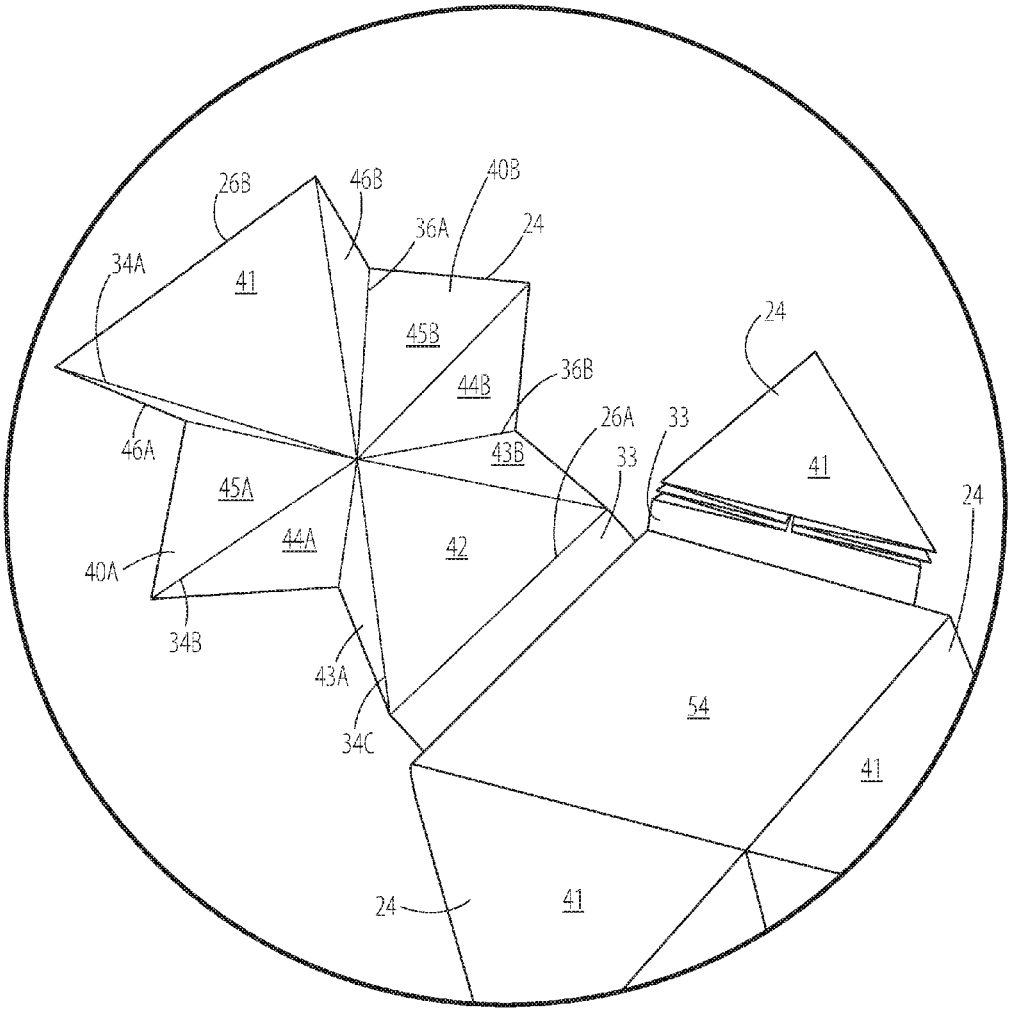
FIG. 3 is an enlarged detail of a first layer section of the folding book of FIG. 1, during unfolding.
Figure 4:
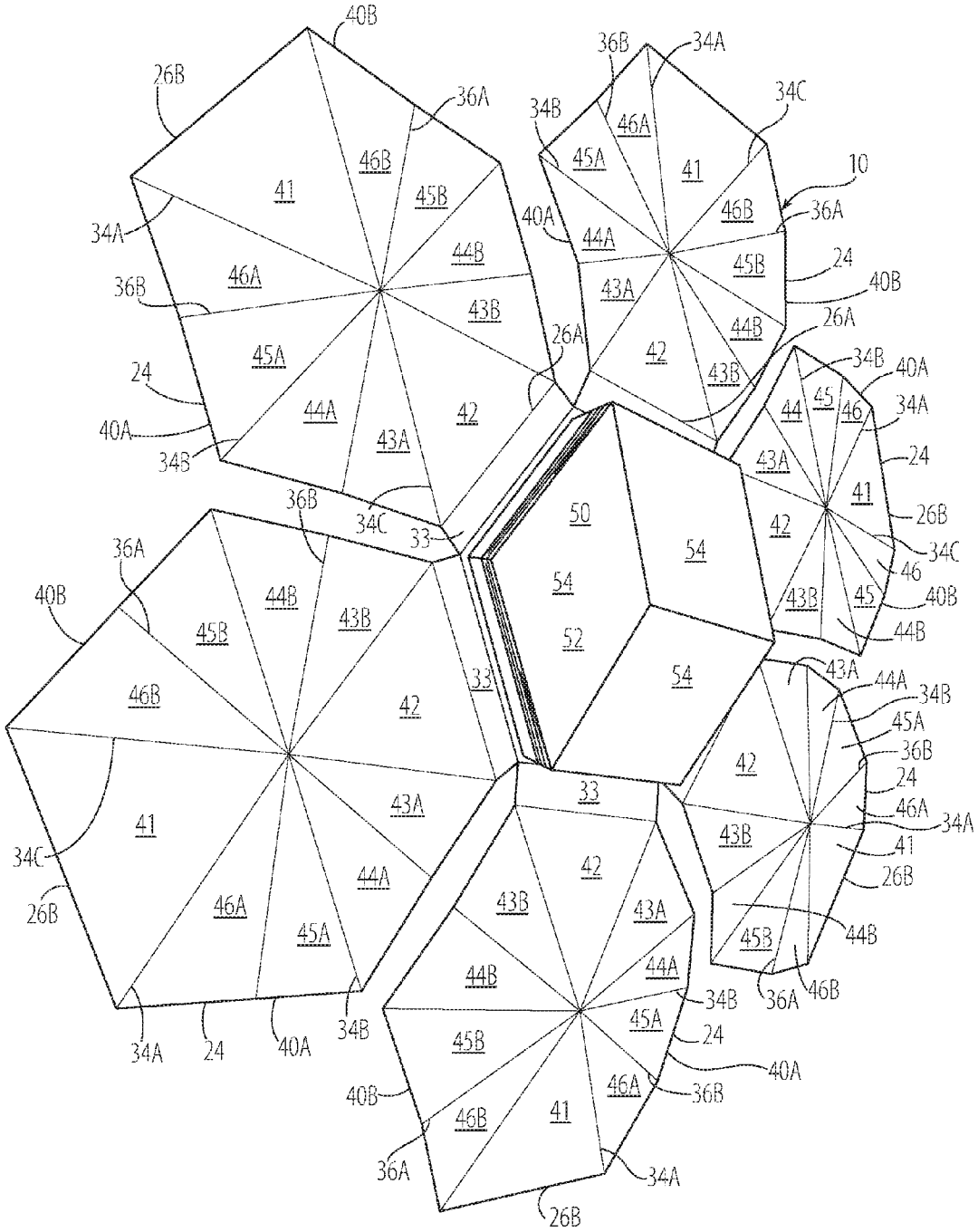
FIG. 4 is a perspective view of the folding book of FIG. 1, showing the first layer in an unfolded configuration.

Referring to FIGS. 1 and 2, each first layer section 24 has a hinge side 26 that lies on an outer edge and forms a portion of a side 14 of the folding book body 12 when the first layer 20 is in the folded configuration. The hinge side 26 includes an inner hinge side 26A and outer hinge side 26B, which are adjacent and form a single side with the inner hinge side 26A stacked atop the outer hinge side 26B when the first layer section 24 is in the folded configuration of FIG. 1, but are located opposite each other with the inner hinge side 26A located adjacent the side 14 of book body 12, and the outer hinge 26A side 26B located radially outward of the inner hinge side 26A when the first layer section 24 is in the unfolded configuration, as shown in FIG. 4. To begin moving the first layer 20 from the folded configuration to the unfolded configuration, each first layer section 24 is first pivoted outward from the center 16 of the book body 12 about the hinge side 26, as shown in FIG. 2. An attachment strip 33 extends along the inner hinge side 26B of each first layer section 24, joining the respective first layer section 24 to an outer edge of the base 180. The attachment strips 33 form sides of the book 10 when in the folded configuration, as shown in FIG. 1, and each of the first layer sections 24 pivots about the associated attachment strip 33 when the first layer 20 is unfolded as shown in FIGS. 2 and 3.

Each first layer section 24 then moves from its folded configuration, shown in FIG. 2, to its unfolded configuration, shown in FIG. 4, to fully move the first layer 20 from the folded configuration to the unfolded configuration and move the folding book 10 into a first stage of expansion. Each first layer section 24 has, in its unfolded configuration, an upper surface 30 and a lower surface opposite the upper surface, and comprises a plurality of scores, each score being a linear crimp, fold line, or half cut, creating a predetermined fold pattern and enabling the first layer section 24 to be accurately folded, unfolded and refolded repeatedly along the same line.

As shown in FIG. 4, three diagonal scores 34A-C are formed in each unfolded first layer section 24, each extending between opposite corners to bisect the hexagonal shape of the first layer section 24. Two transverse scores 36A, 36B are formed in each unfolded first layer section 24, each extending between opposite side edges 28 to bisect the hexagonal shape of the first layer section 24. The scores 34A-C, 36A, B intersect at the center 38 of each first layer section 24. The scores divide each first layer section 24 into an outer equilateral triangular portion 41, an inner equilateral triangular portion 42, and four right triangular portions 43A, B, 44A,B, 45A, B, 46A, B along each side of the unfolded first layer section 24, between the outer and inner equilateral triangular portions 41, 43.

A valley, or downwardly extending fold line, is formed along the length of each diagonal score 34A-C, allowing the upper surface 30 of the first layer section 24 to pivot inwardly about the diagonal score 34A-C, bringing adjacent regions of the top upper surface 30 towards and away from each other about the score. A ridge, or upwardly extending fold line, is formed along the length of each transverse score 36A, B, allowing the lower surface of the first layer section 24 to pivot inwardly about the transverse score 36A, B, bringing adjacent regions of the lower surface towards and away from each other about the score. The alternating valleys and ridges formed via diagonal scores 34A-C and transverse scores 36A, B result in a first radial pleat 40A extending along a first side of each first layer section 24 and a second radial pleat 40B extending along a second side of each first layer section 24.

Accordingly, when in the folded configuration of FIGS. 1 and 2, outer 41 and inner 42 equilateral triangular portions form upper and lower surfaces of the folded first layer section 24, with their upper surfaces 30 facing each other, and the right triangular portions are folded about the radial pleats 40A, B are sandwiched between. Specifically, first right triangular portion 43A is folded inward about diagonal score 34C, overlapping inner equilateral triangular portion 42, second right triangular portion 44A, is folded outward about transverse score 36A, overlapping the first right triangular portion 43A, third right triangular portion 45A is folded inward about diagonal score 34B, overlapping second right triangular portion 44A, fourth right triangular portion 46A, is folded outward about transverse score 36B, overlapping third right triangular portion 45A, and outer equilateral triangular portion 41 is folded inward about diagonal score 34A, overlapping the fourth right triangular portion 46A.

Similarly, on the opposite side of the first layer section 24, first right triangular portion 43B is folded inward about diagonal score 34A, overlapping inner equilateral triangular portion 42, second right triangular portion 44B, is folded outward about transverse score 36B, overlapping the first right triangular portion 43B, third right triangular portion 45B, is folded inward about diagonal score 34B, overlapping second right triangular portion 44B, fourth right triangular portion 46B, is folded outward about transverse score 36A, overlapping third right triangular portion 45B, and outer equilateral triangular portion 41 is folded inward about diagonal score 34C, overlapping the fourth right triangular portion 46B.

Figure 5:
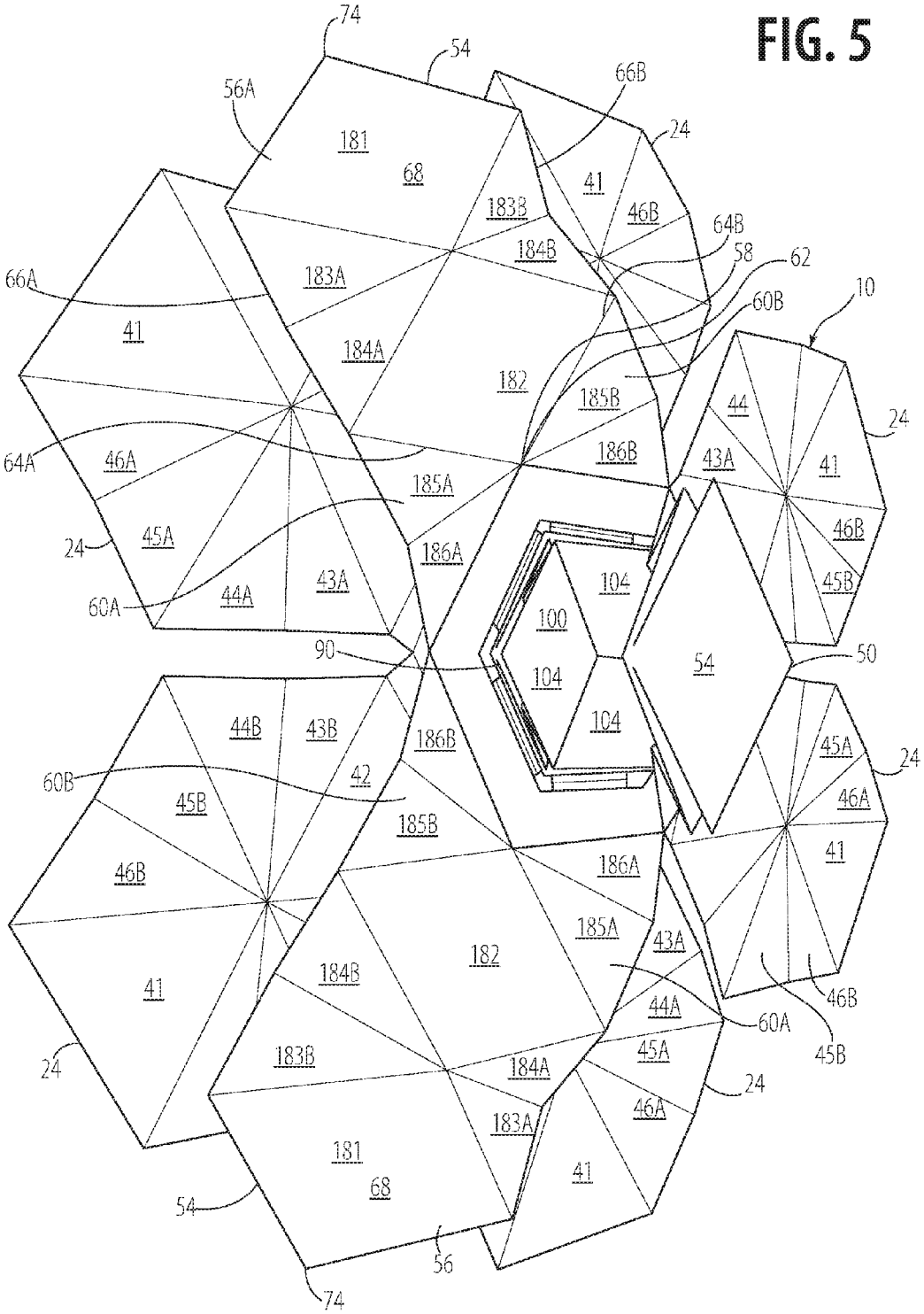
FIG. 5 is a perspective view of the folding book of FIG. 1, showing the second layer in a partially unfolded configuration.

In order to move a first layer section 24 from the folded configuration of FIG. 5, to the unfolded configuration, and move the folding book 12 into a first stage of expansion, as shown in FIG. 4, outer hinge side 26B is gripped and pivoted outward away from the center 16 of the folding book body 12 and inner hinge side 26A. This action results in unfolding of radial pleats 40A, B, as shown in FIG. 3 and expansion of the first layer section 24 from the folded configuration of FIG. 2 to the unfolded configuration of FIG. 4. The first layer section 24 has a hexagonal shape after expansion. Repeating this action for each of the first layer sections 24 moves the first layer 20 into the unfolded configuration, and the folding book 10 into the first stage of expansion, as shown in FIG. 5. As shown, each hexagonally shaped first layer section 24 is located adjacent to an associated side 14 of the body 12 and attached to the base 18 by the attachment strip 33. In the embodiment shown, each first layer 24 section is of a hexagonal shape having the same dimensions as the folding book body 12.

Referring to FIGS. 4-7 the second layer 50 and a second stage of expansion of the folding book 10 is shown in detail. As shown in FIG. 4, the second layer 50, in the folded configuration has a hexagonal shape and a top surface 52, which forms a top surface of the book body 12 following the first stage of expansion and before the second stage of expansion.

Figure 5A:
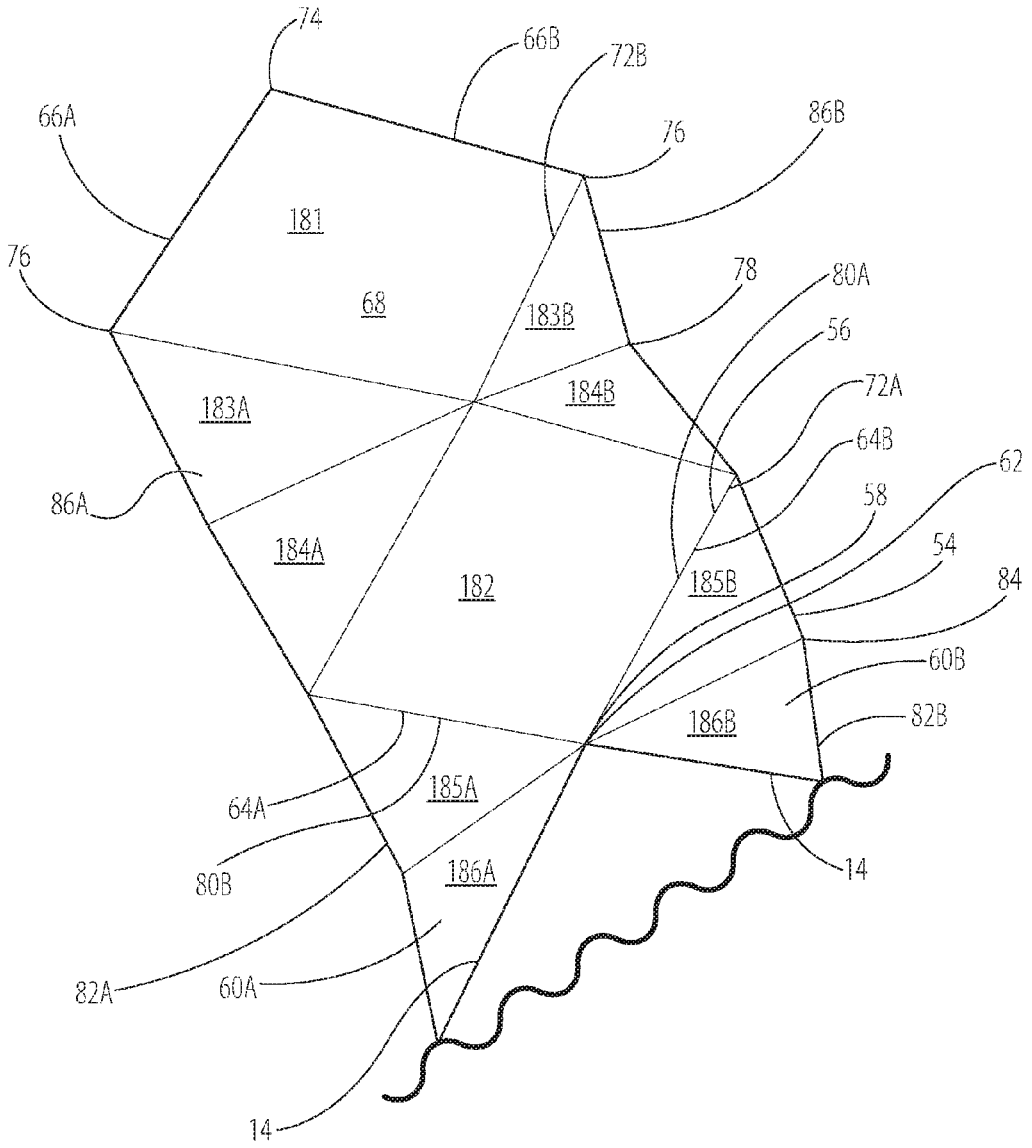
FIG. 5A is a detail of FIG. 5, showing just a second layer section.
Figure 6:
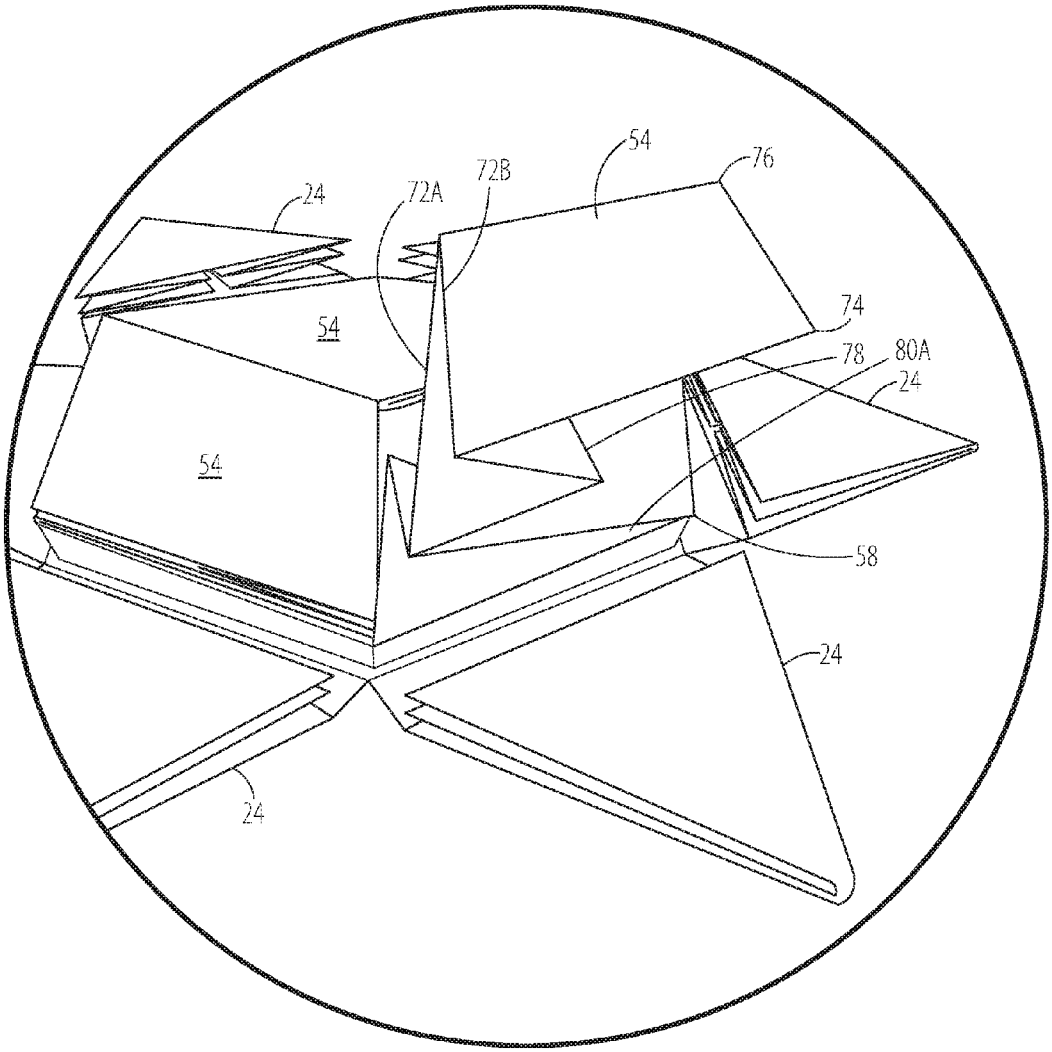
FIG. 6 is a detailed perspective view the folding book of FIG. 1, showing a section of the second layer during unfolding.
Figure 7:
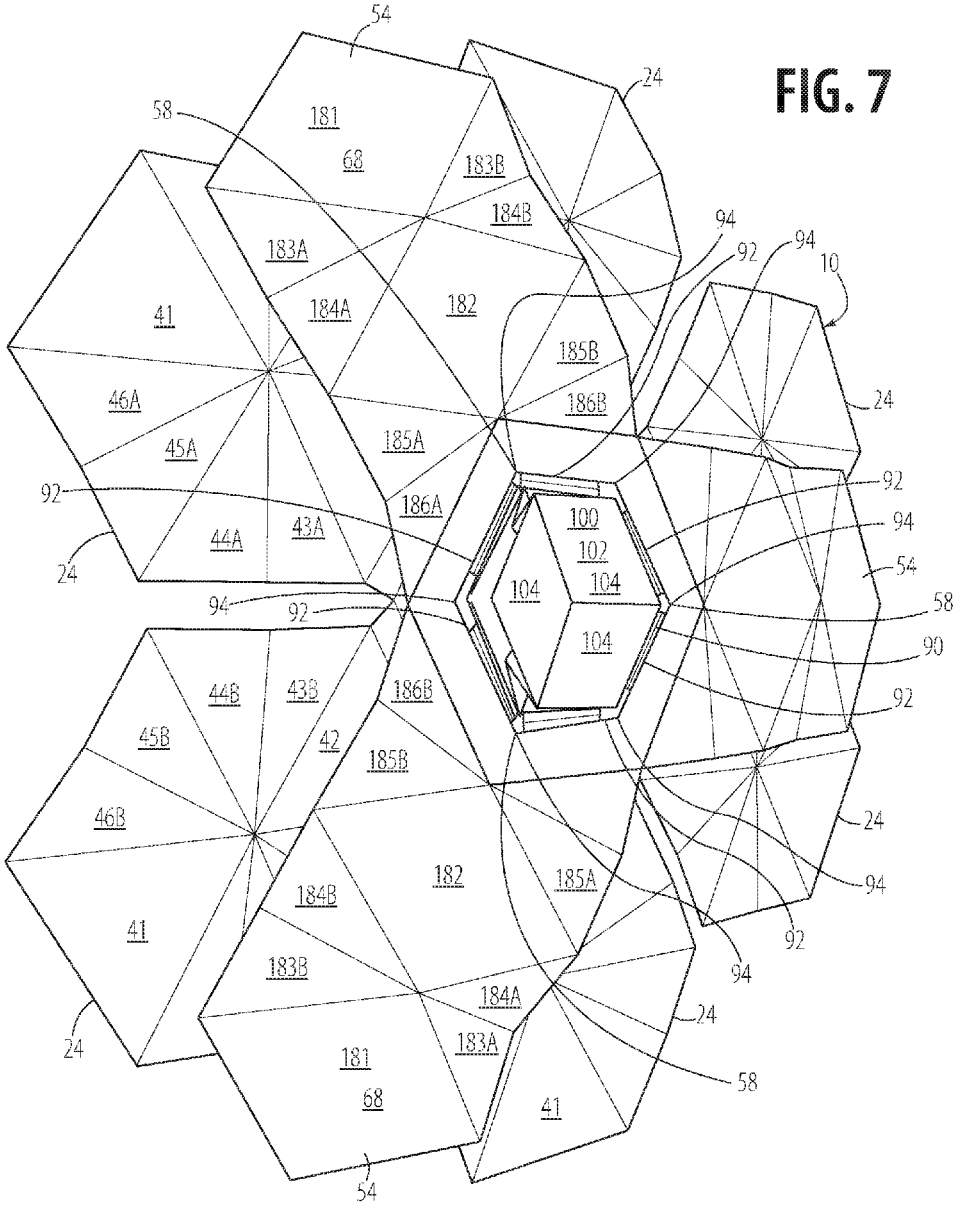
FIG. 7 is a perspective view of the folding book of FIG. 1, showing the second layer in an unfolded configuration.

The second layer 50 is formed of three identical second layer sections 54. Each second layer section 54 moves between a folded configuration, shown in FIG. 4, and an unfolded configuration, shown in FIG. 7. As shown, the hexagonal shape of the second layer 50, when in the folded configuration, is divided into thirds by the three identical second layer sections 54, each of which has an identical diamond shape in the folded configuration. In the unfolded configuration, as shown in FIG. 5A, each second layer section 54 includes a hexagonal portion 56, which may be dimensioned the same as the hexagonal body 12, for example having a diameter of 8 inches. Each hexagonal portion 56 includes an attachment vertex 58 pivotally joined with a vertex 18 of the body 12 at an attachment point 62. An outer vertex 74 is located opposite attachment vertex 62, and side vertices 76 are located along the sides of each second layer section 54, between the attachment vertex 58 and outer vertex 74. As shown in FIG. 7, attachment vertices 58 are attached to alternating vertices 18 of the body 12.

As shown in FIG. 5A, each second layer section 54 further includes first and second triangular shaped hinge portions 60A, B, which extend between each attachment point 62, the adjacent two sides 14 of the body 12 and adjacent two sides 64A, B of hexagonal portion 60. The triangular hinge portions 60A, B are shaped as equilateral triangles and the sides may be of lengths equal to the length of the sides 14 of the book base 12, for example, 4 inches. Each second layer section 54, in the unfolded configuration, is formed as a strip extending radially away from the center 16 of the folding book body 12 and having outer edges 66A, B located on the radially outer end thereof and extending at angles with respect to each other, forming a pointed end of each second layer section 54.

Each second layer section 54 moves from its folded configuration, shown in FIG. 4, to its unfolded configuration, shown in FIG. 7, to move the folding book 10 to a second stage of expansion. Each second layer section has, in its unfolded configuration, an upper surface 68 and a lower surface, and comprises a plurality of scores, each score being a linear crimp, fold line, or half cut, creating a predetermined fold pattern.

First and second diagonal scores 72A, B are formed in each hexagonal portion 56, each extending between opposite side vertices 76A, B to bisect the hexagonal shape of the hexagonal portion 56. A single transverse score 78 is formed in each hexagonal portion 56, extending between opposite sides to bisect the hexagonal shape of the hexagonal portion 56. Third and fourth diagonal scores 80A, B are formed in each second layer section 54, each extending between a side 14 of body 12 and an adjacent side 82 of triangular hinge portion 60, through attachment point 62, and further along a side 64 of hexagonal portion 64 and an adjacent side of the opposite triangular hinge portion 60. A transverse score 84 extends between and bisects opposing triangular hinge portions 60A, B and through attachment point 62. The scores divide each second layer section 54 into an outer diamond shaped portion, 181, inner diamond shaped portion 182, located between the outer diamond shaped portion 181 and body 12, inner right triangular portions 183A, B, 184 A, B located on each side of second layer portion 54 between the inner and outer diamond shaped portion 181, 182, and outer right triangular portions 185A, B 186A, B, located within triangular hinges 60, between inner diamond shaped portion 182 and body 12.

A valley is formed along the length of transverse score 78 and third and fourth diagonal scores 80A, B. A ridge is formed along the length of first and second diagonal scores 72A, B, and transverse score 84. The alternating valleys and ridges formed via scores in the second layer sections result in a first triangular pleat 86A extending along a first side of each second layer section 54 and a second triangular pleat 86B extending along a second side of each second layer section 54.

Accordingly, when in the folded configuration of FIG. 4, the diamond shaped end portions 181 overlap the body 12, with a lower surface of each diamond shaped end portion 181 facing the book body and the inner diamond shaped portion 182 and right triangular portions 183-186A, B, sandwiched in between. Specifically, fourth right triangular portion 186A, is folded inward about diagonal score 80A, overlapping book body 12, third right triangular portion 185A, is folded outward about transverse score 84, overlapping fourth right triangular portion 186A, outer diamond shaped portion 182 is folded inward about diagonal score 80B, overlapping third right triangular portion 185A, second right triangular portion 184A is folded outward about diagonal score 72B, overlapping outer diamond shaped portion 182, first right triangular portion 183A is folded inward about transverse score 78, overlapping second right triangular portion 182A, and outer diamond shaped portion 181 is folded outward about diagonal hinge 72A, overlapping first right triangular portion 183A.

Similarly, on the opposite side of the second layer section fourth right triangular portion 186B, is folded inward about diagonal score 80B, overlapping book body 12, third right triangular portion 185B, is folded outward about transverse score 84, overlapping fourth right triangular portion 186B, outer diamond shaped portion 182 is folded inward about diagonal score 80A, overlapping third right triangular portion 185B, second right triangular portion 184B is folded outward about diagonal score 72A, overlapping outer diamond shaped portion 182, first right triangular portion 183B is folded inward about transverse score 78, overlapping second right triangular portion 182B, and outer diamond shaped portion 181 is folded outward about diagonal hinge 72B, overlapping first right triangular portion 183B.

In order to move a second layer section 54 from the folded configuration of FIG. 4, to the unfolded configuration of FIG. 7, and move the folding book 12 into the second stage of expansion, outer diamond shaped portion 181 is griped and drawn radially outward, away from the center 16 of book body 12, resulting in unhinging of the second layer section 54 about the triangular pleats 86A, B, and extension into the elongate shape shown in FIG. 7. Repeating this action for each of the second layer sections 54 moves the second layer 50 into the unfolded configuration and the folding book 10 into the second stage of expansion, as shown in FIG. 7. In this configuration, each second layer section 54 is partially overlapping and partially located between two adjacent first layer sections 24.

Referring to FIGS. 7-10 the third layer 100 and a third stage of expansion of the folding book 10 is shown in detail. As shown in FIG. 7, the folding book body 12 defines a cavity 90 beneath the second layer 50, which extends downward and terminates at the book base 180. The cavity 90 houses the third layer 100 and fourth layer 150 when in their respective folded configurations. The cavity 90 is of a hexagonal shape, similar to and smaller than that of the folding book body. In one embodiment, the cavity 90 has a diameter of 5½ inches. The cavity 90 has six sides 92, positioned in radial alignment with the six sides 14 of the book body 12, and six vertices 94, positioned in radial alignment with the six vertices 18 of the book body 12.

The third layer 100 is of a hexagonal shape, similar to that of the book body 12 and the cavity 90, and is sized to fit snugly within the cavity 90 when in the folded configuration. In one embodiment, the third layer 100, when in the folded configuration, has a diameter of 5 inches. The third layer 100 has a top surface 102 when in the folded configuration, which forms a portion of the top surface of the book body 12 following the second stage of expansion and before the third stage of expansion.

Figure 9A:
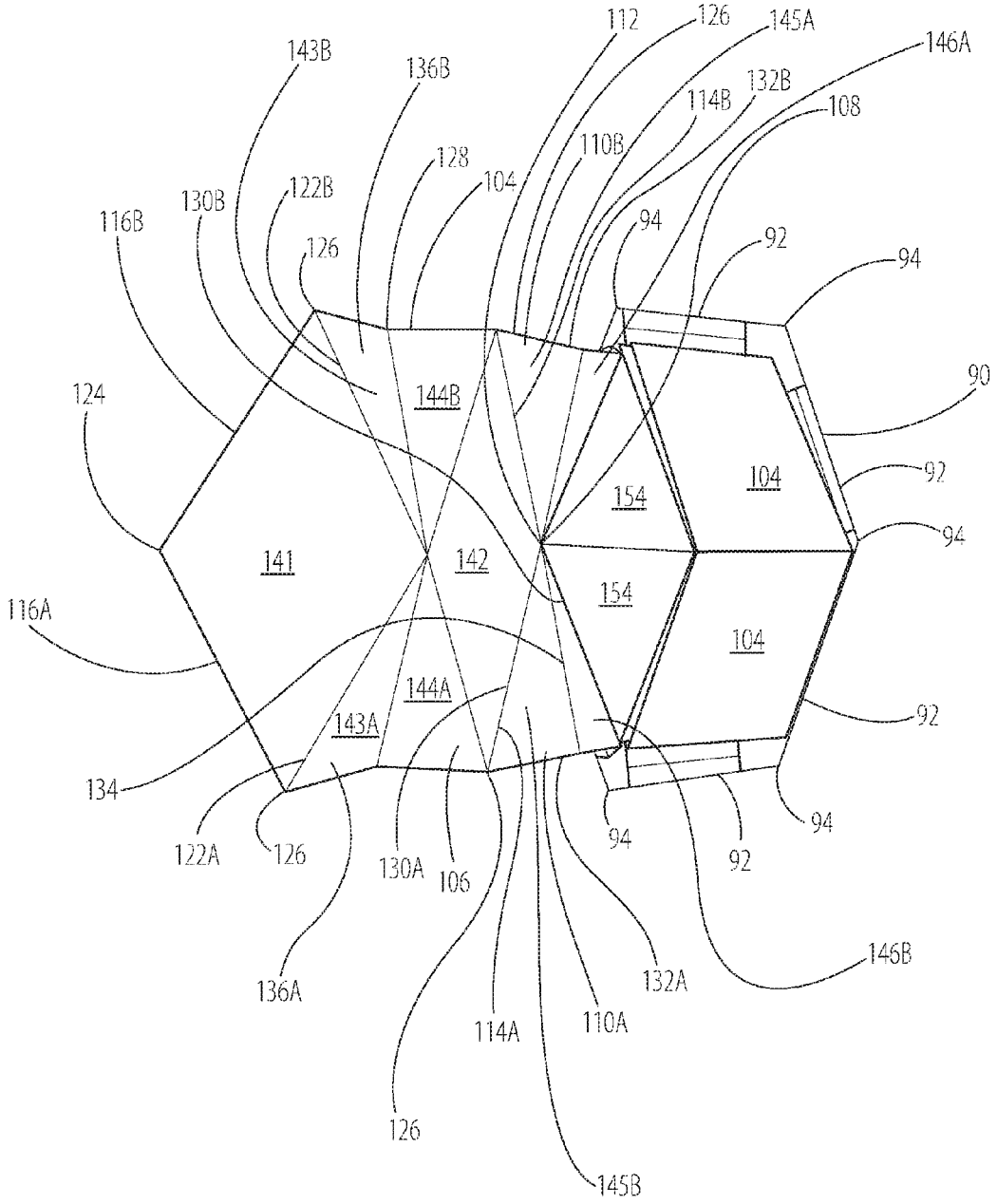
FIG. 9A is a detail of FIG. 9, showing just the third layer.
Figure 10:
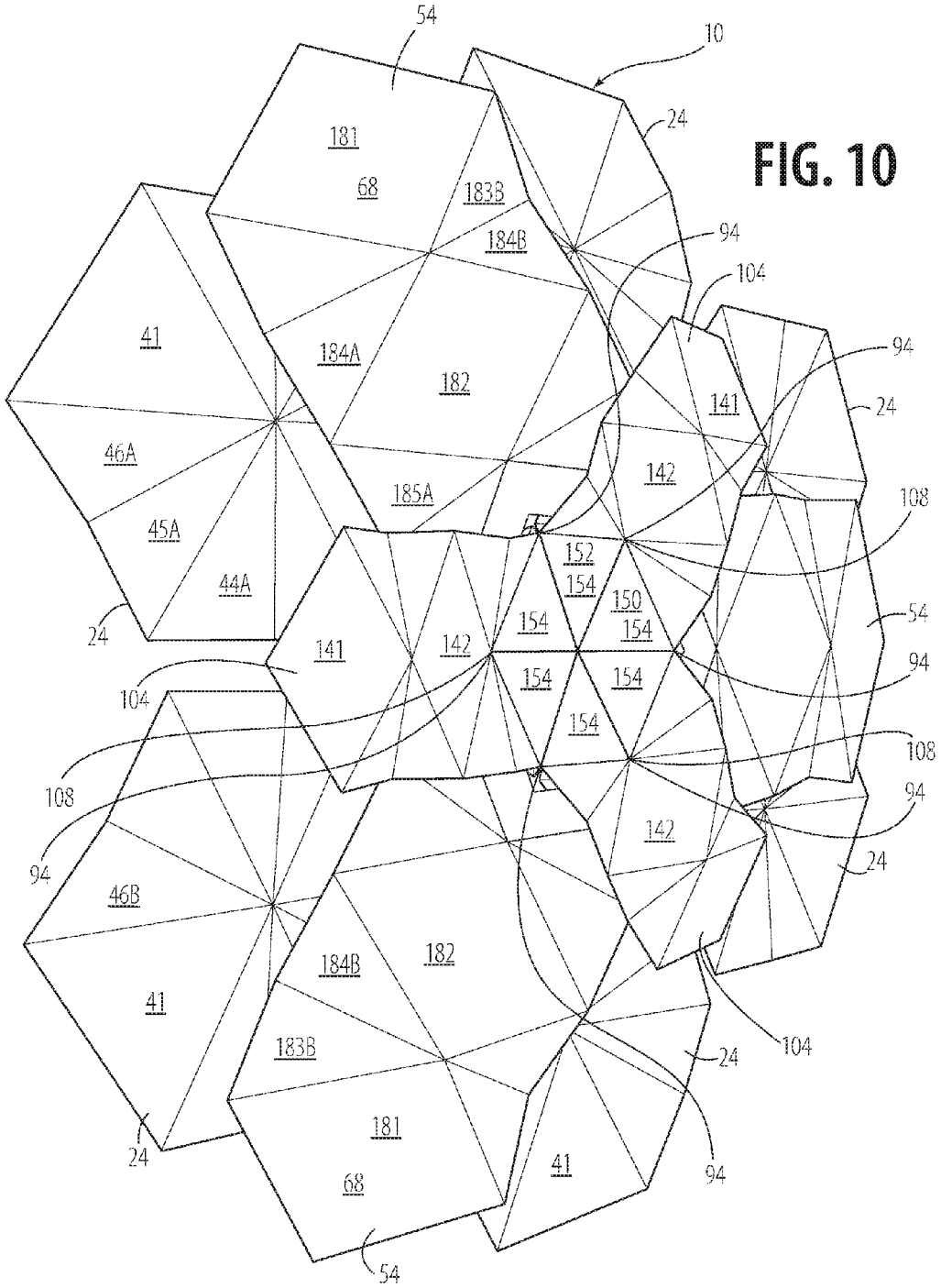
FIG. 10 is a perspective view of the folding book of FIG. 1, showing the third layer in an unfolded configuration.

The third layer 100 is formed of three identical third layer sections 104. Each third layer section 104 moves between a folded configuration, shown in FIG. 7, and an unfolded configuration, shown in FIG. 10. As shown, the hexagonal shape of the third layer 100, when in the folded configuration, is divided into thirds by the three identical third layer sections 104, each having an identical diamond shape in the folded configuration. In the unfolded configuration, as shown in FIG. 9A, each third layer section 104 includes a hexagonal portion 106. Each hexagonal portion 106 includes an attachment vertex 108 pivotally joined with a vertex 94 of the cavity 90 at an attachment point 112. An outer vertex 124 is located opposite attachment vertex 108, and side vertices 126 are located along the sides of each third layer section 104, between the attachment vertex 108 and outer vertex 124. As shown in FIG. 10, attachment vertices 108 are attached to alternating vertices 94 of the cavity 90. Referring to FIG. 9A, each third layer section 104 further includes first and second triangular shaped hinge portions 110A, B, which extend between each attachment point 112, the adjacent two sides 92 of the body cavity 90 and adjacent two sides 114 of hexagonal portion 106. The triangular hinge portions 110A, B are shaped as equilateral triangles and the sides may be of lengths equal to the sides of hexagonal portions 106, for example, 2½ inches. Each third layer section 104, in the unfolded configuration, is formed as a strip extending radially away from the center 16 of the folding book body 12 and having outer edges 116A, B located on the radially outer end thereof and extending at angles with respect to each other, forming a pointed end on each third layer section 104.

Each third layer section 104 moves from its folded configuration, shown in FIG. 7, to its unfolded configuration, shown in FIG. 10, to move the folding book 10 to a third stage of expansion. Each third layer section 104 has, in its unfolded configuration, an upper surface 118 and a lower surface located opposite the upper surface, and comprises a plurality of scores, each score being a linear crimp, fold line, or half cut, creating a predetermined fold pattern.

First and second diagonal scores 122A, B are formed in each hexagonal portion 106, each extending between opposite side vertices 126A, B to bisect the hexagonal shape of the hexagonal portion 106. A single transverse score 128 is formed in each hexagonal portion 106, extending between opposite sides 116 to bisect the hexagonal shape of the hexagonal portion 106. Third and fourth diagonal scores 130A, B are formed in each third layer section 104, each extending between a side 92 of cavity 90 and an adjacent side 132 of triangular hinge portion 110, through attachment point 112, and further along a side 114 of hexagonal portion 114 and an adjacent side of the opposite triangular hinge portion 110. A transverse score 134 extends between and bisects opposing triangular hinge portions 110A, B and extends through attachment point 112.

The scores divide each third layer section 104 into an outer diamond shaped portion, 141, inner diamond shaped portion 142, located between the outer diamond shaped portion 141 and body 12, inner right triangular portions 143A, B, 144A, B located on each side of third layer portion 104 between the inner and outer diamond shaped portion 141, 142, and outer right triangular portions 145A, B 146A, B, located within triangular hinges 110, between inner triangular portion 142 and body 12.

A valley is formed along the length of transverse score 128 and third and fourth diagonal scores 130A, B. A ridge is formed along the length of first and second diagonal scores 122A, B, and transverse score 134. The alternating valleys and ridges formed via scores in the third layer sections result in a first triangular pleat 136A extending along a first side of each third layer section 104 and a second triangular pleat 136B extending along a second side of each third layer section 104.

Accordingly, when in the folded configuration of FIG. 7, the diamond shaped end portions 141 overlap the body 12, with a lower surface of each diamond shaped end portion 141 facing the book body 12 and the inner diamond shaped portion 142 and right triangular portions 143-146A, B, sandwiched in between. Specifically, fourth right triangular portion 146A, is folded inward about diagonal score 130B, overlapping book body 12, third right triangular portion 144A, is folded outward about transverse score 134, overlapping fourth right triangular portion 146A, inner diamond shaped portion 142 is folded inward about diagonal score 130A, overlapping third right triangular portion 145A, second right triangular portion 144A is folded outward about diagonal score 122B, overlapping inner diamond shaped portion 142, first right triangular portion 143A is folded inward about transverse score 128, overlapping second right triangular portion 144A, and outer diamond shaped portion 141 is folded outward about diagonal score 122A, overlapping first right triangular portion 143A.

Similarly, on the opposite side of the second layer section, fourth right triangular portion 146B, is folded inward about diagonal score 130A, overlapping book body 12, third right triangular portion 144B, is folded outward about transverse score 134, overlapping fourth right triangular portion 146B, inner diamond shaped portion 142 is folded inward about diagonal score 130B, overlapping third right triangular portion 145B, second right triangular portion 144B is folded outward about diagonal score 122A, overlapping inner diamond shaped portion 142, first right triangular portion 143B is folded inward about transverse score 128, overlapping second right triangular portion 144B, and outer diamond shaped portion 141 is folded outward about diagonal score 122B, overlapping first right triangular portion 143B.

Figure 8:
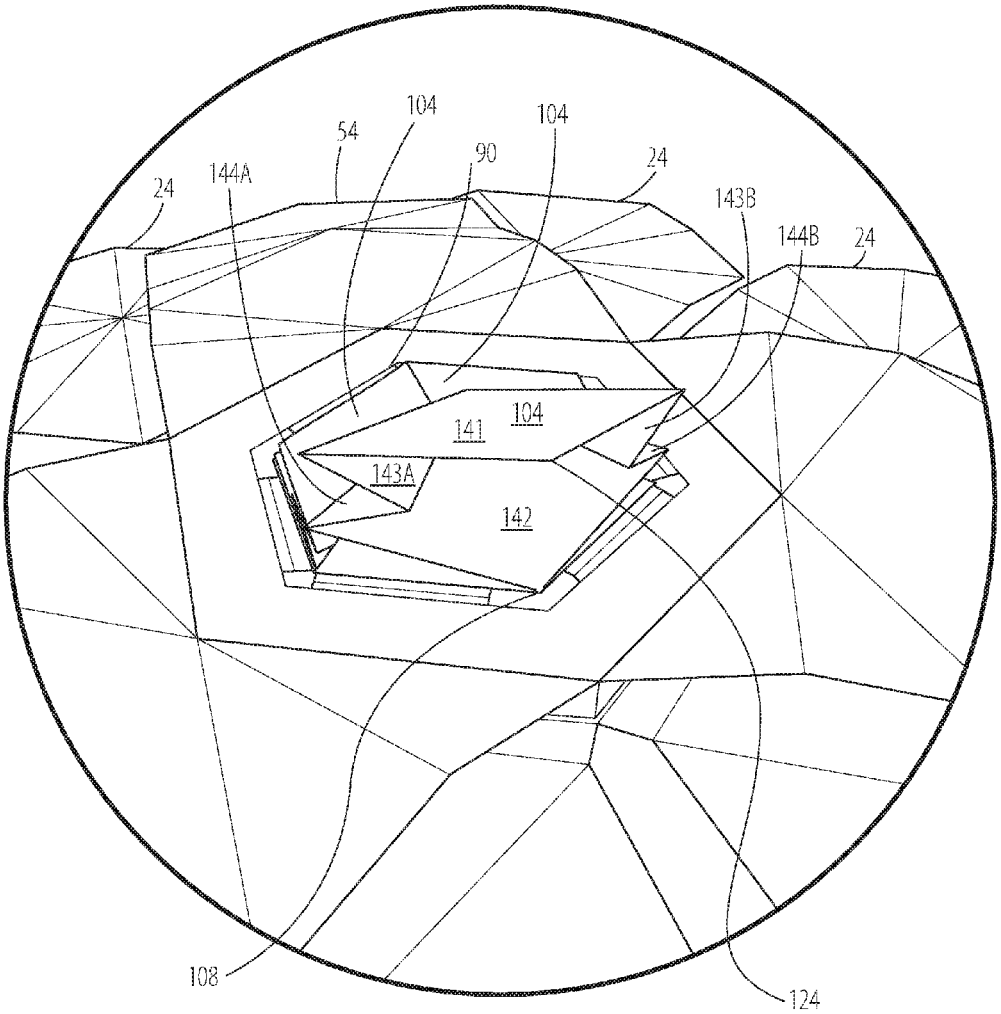
FIG. 8 is a detailed perspective view of the folding book of FIG. 1, showing a section of the third layer during unfolding.
Figure 9:
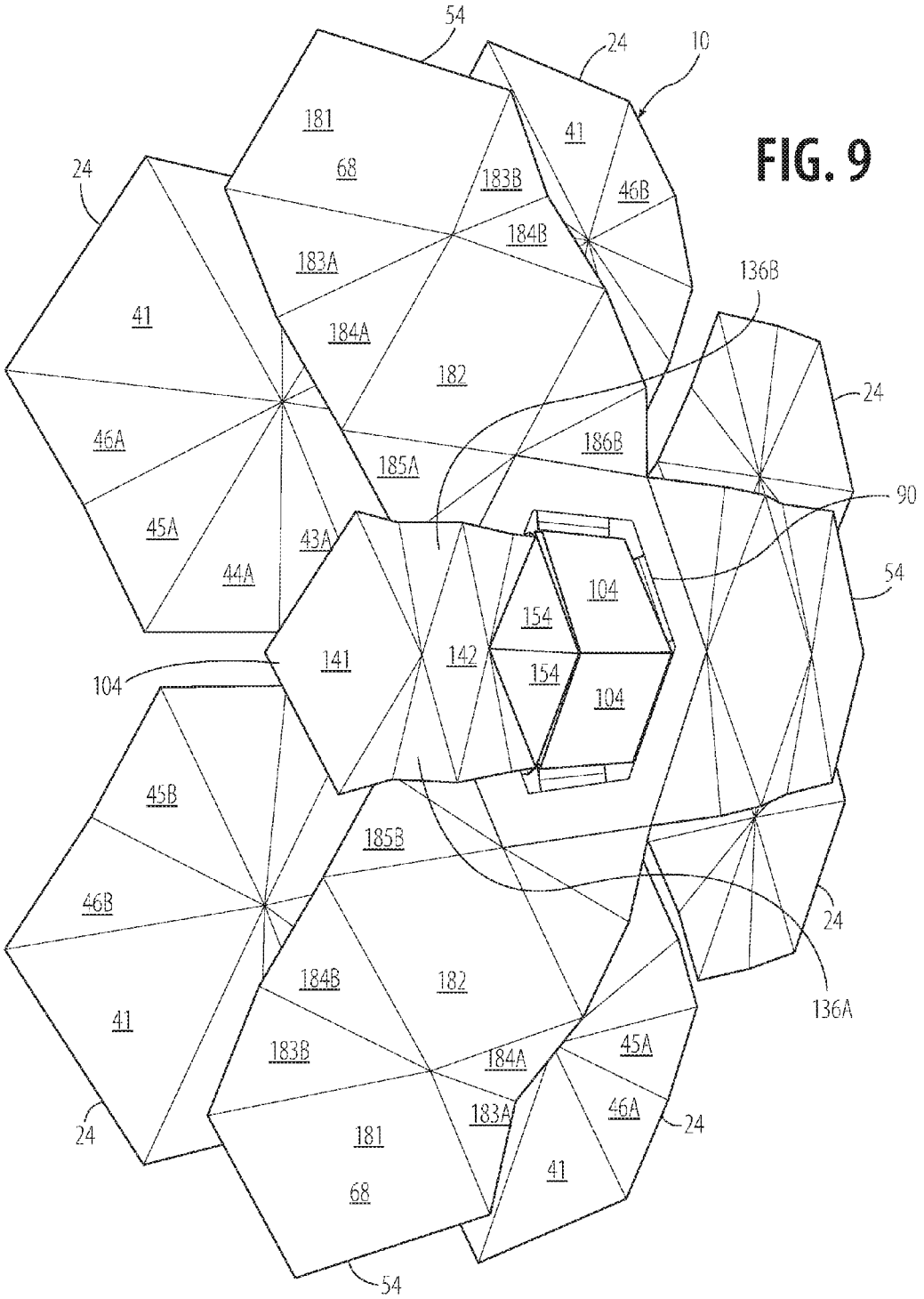
FIG. 9 is a perspective view of the folding book of FIG. 1, showing the third layer in a partially unfolded configuration.

In order to move a third layer section 104 from the folded configuration of FIG. 7, to the unfolded configuration of FIG. 10, and move the folding book 12 into the third stage of expansion, the outer diamond shaped portion 141 is griped and drawn radially outward, away from the center 168 of book body 12, resulting in unhinging of the third layer section 104, as shown in FIGS. 8 and 9, about the triangular pleats 136A, B, and extension into the elongate shape shown in FIG. 10. Repeating this action for each of the third layer sections 104 moves the third layer 100 into the unfolded configuration and the folding book 10 into the third stage of expansion, as shown in FIG. 10. In this configuration, each third layer section 104 is partially overlapping and partially located between two adjacent first layer sections 24 and two adjacent second layer sections 54.

Referring to FIGS. 10-12A, the fourth layer 150 and a fourth stage of expansion of the folding book 10 is shown in detail. As shown, the fourth layer 150, in the folded configuration of FIG. 10, has a hexagonal shape and a top surface 152 forming a top surface of the folding book 10 following the third stage of expansion and before the fourth stage of expansion.

The fourth layer 150 is formed of six identical fourth layer sections 154. Each fourth layer section 154 moves between a folded configuration, shown in FIG. 10, and an unfolded configuration, shown in FIG. 12. As shown, in the folded configuration, each fourth layer section 154 has a triangular shape, and in the unfolded configuration has a hexagonal shape. Referring to FIG. 10, the triangular shape is that of an equilateral triangle. When in the folded configuration, the fourth layer sections 154 fit together to form the hexagonal shape shown in FIG. 10, which is dimensioned to fit snugly within the cavity 90, for example having a diameter of 5½ inches.

Figure 12:
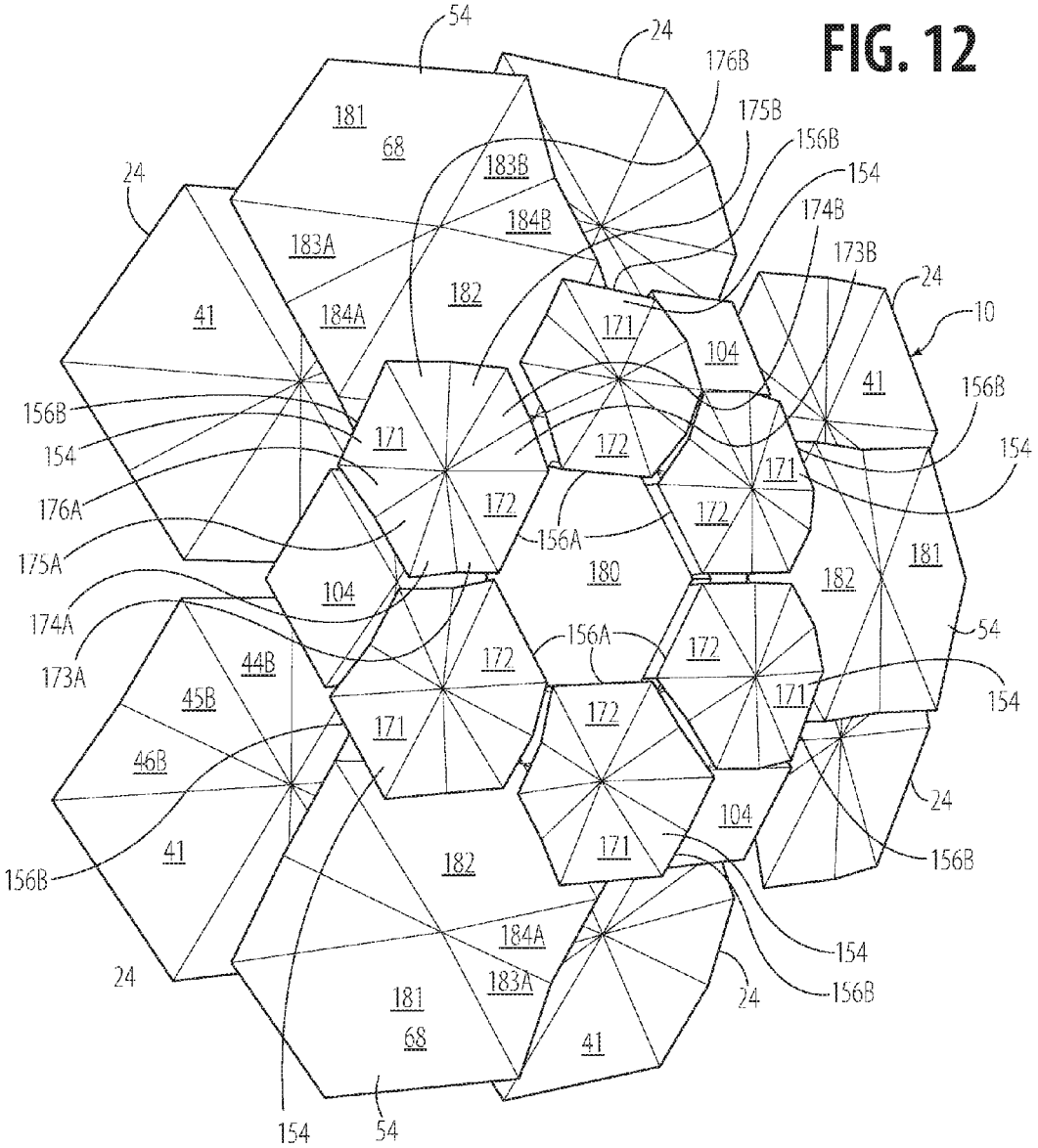
FIG. 12 is a perspective view of the folding book of FIG. 1, in a fully expanded configuration.

Each fourth layer section 154 has a hinge side 156 that lies adjacent to a side 92 of the cavity 90 when the fourth layer 150 is in the folded configuration. The hinge side 156 includes an inner hinge side 156A and outer hinge side 156B, which are adjacent and form a single side with the inner hinge side 156A stacked atop the outer hinge side 156B when the fourth layer section 154 is in the folded configuration, but are located opposite each other with the inner hinge side 156A located adjacent the side 92 of the cavity 90 when the fourth layer section 154 is in the unfolded configuration, as shown in FIG. 12. To begin moving the fourth layer 150 from the folded configuration to the unfolded configuration, each fourth layer section 154 is pivoted outward from the center 16 of the book body 12 about the hinge side 156 and then arranged outside of the cavity 90 with the hinge side 156 of each fourth layer section 150 adjacent to a side 92.

Figure 11:
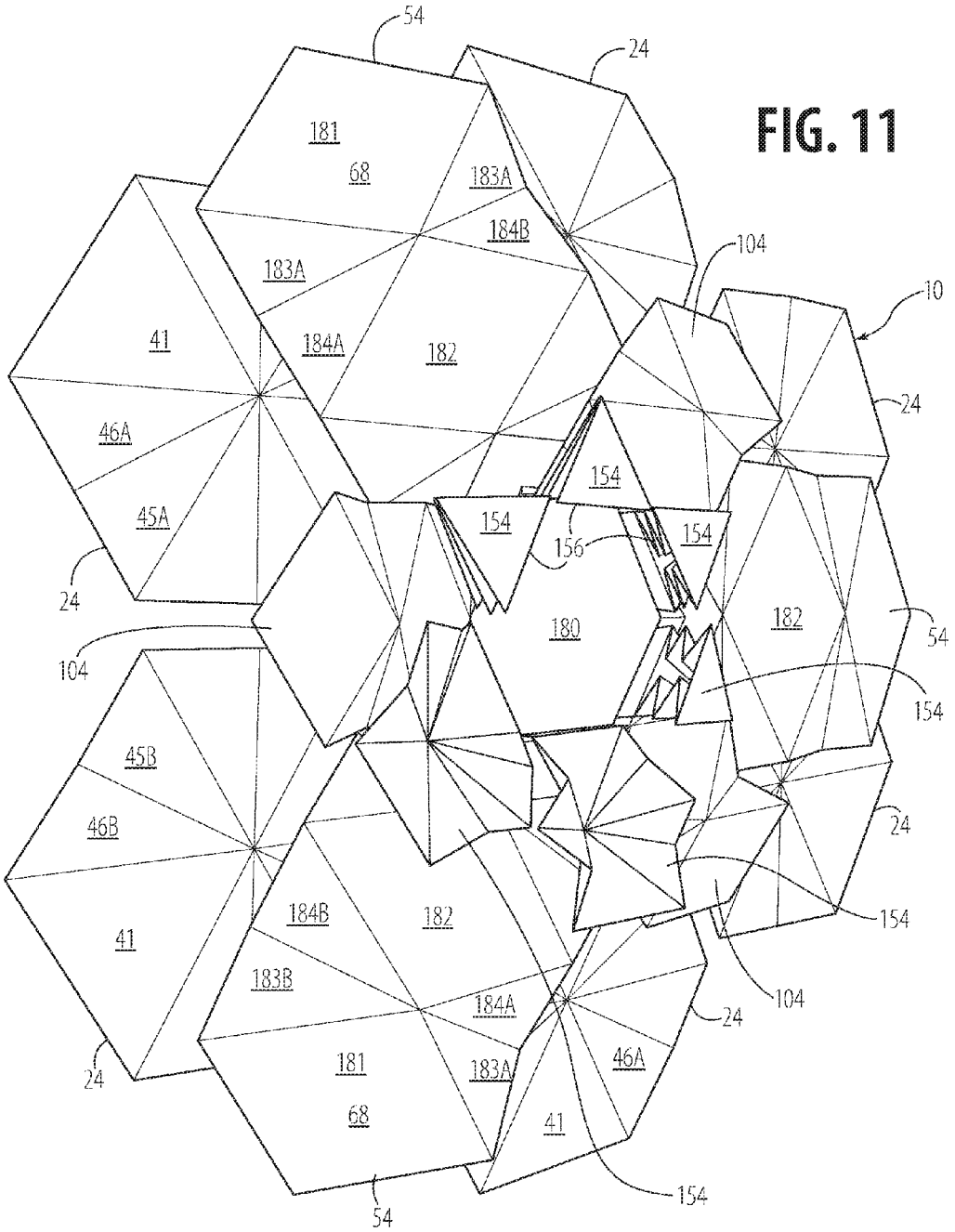
FIG. 11 is a perspective view of the folding book of FIG. 1, showing the fourth layer in a partially unfolded configuration.

Each fourth layer section 154 then moves from its folded configuration to its unfolded configuration, as shown in FIG. 11, to fully move the fourth layer 150 from the folded configuration to the unfolded configuration and move the folding book 10 into a fourth stage of expansion, and into the expanded configuration. Each fourth layer section 154 has, in its unfolded configuration, an upper surface 160 and a lower surface positioned opposite the upper surface, and comprises a plurality of scores, each score being a linear crimp, fold line, or half cut, creating a predetermined fold pattern and enabling the fourth layer section 154 to be accurately folded, unfolded and refolded repeatedly along the same line.

Figure 12A:
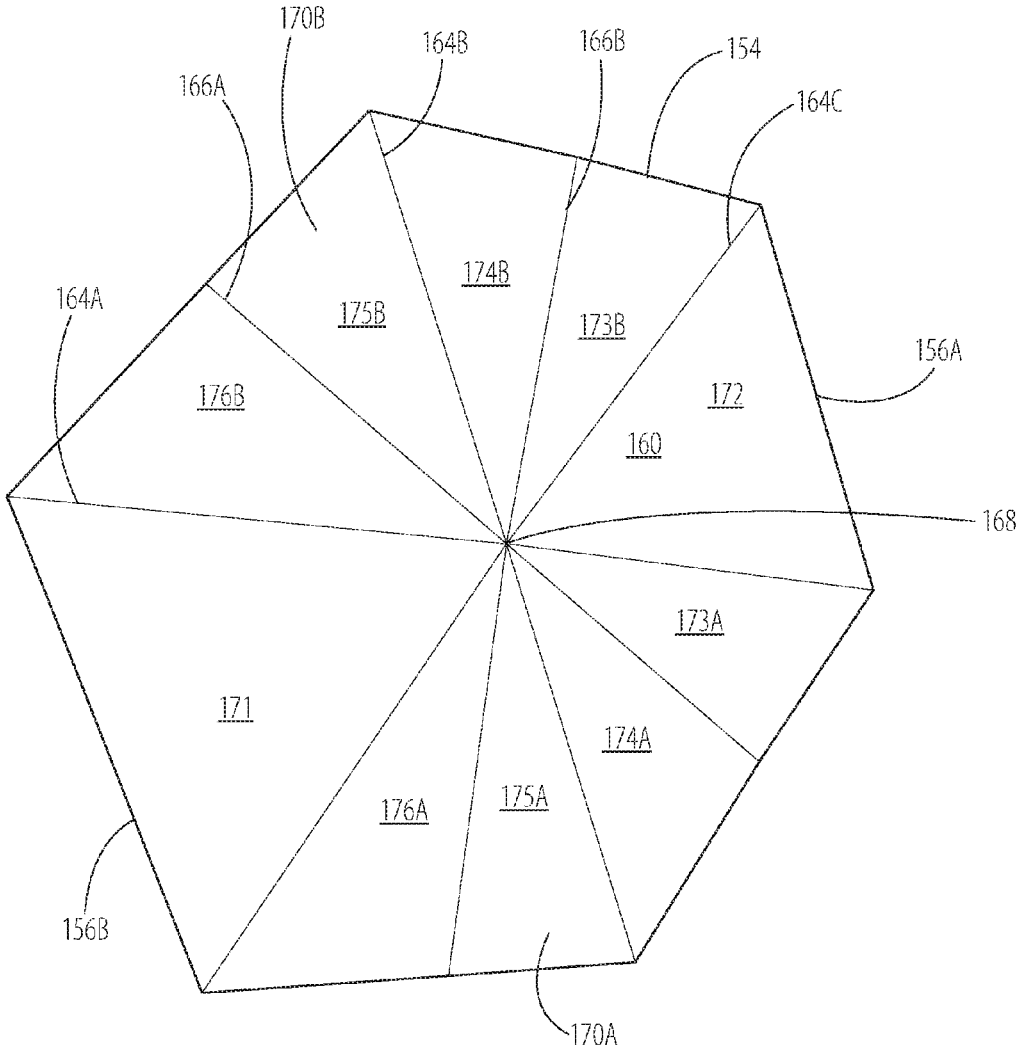
FIG. 12A is an enlarged detail of FIG. 12, showing just a fourth layer section.

As shown in FIG. 12A, three diagonal scores 164A-C extend between opposite corners to bisect the hexagonal shape of the fourth layer section 154. Two transverse scores 166A, 166B extend between opposite side edges 158A, B to bisect the hexagonal shape of the fourth layer section 154. The scores 164A-C, 158A, B intersect at the center 168 of each fourth layer section 154. The scores divide each fourth layer section 154 into an outer equilateral triangular portion 171, an inner equilateral triangular portion 172, and four right triangular portions 173A, B, 174A, B, 175A, B, 176A, B along each side of the unfolded fourth layer section 154, between the outer and inner equilateral triangular portions 171, 173.

A valley, or downwardly extending fold line, is formed along the length of each diagonal score 164A-C, allowing the upper surface 160 of the fourth layer section 154 to pivot inwardly about the diagonal score 164A-C, bringing adjacent regions of the top upper surface 160 towards and away from each other about the score. A ridge, or upwardly extending fold line, is formed along the length of each transverse score 166A, B, allowing the lower surface 162 of the fourth layer section 154 to pivot inwardly about the transverse score 166A, B, bringing adjacent regions of the lower surface towards and away from each other about the score. The alternating valleys and ridges formed via diagonal scores 164A-C and transverse scores 166A, B result in a first radial pleat 170A extending along a first side of each fourth layer section 154 and a second radial pleat 170B extending along a second side of each fourth layer section 154.

Accordingly, when in the folded configuration, outer 171 and inner 172 equilateral triangular portions form upper and lower surfaces of the folded fourth layer section 154, with their upper surfaces 160 facing each other, and the right triangular portions folded about the radial pleats 170A, B and sandwiched between. Specifically, first right triangular portion 173A is folded inward about diagonal score 164A, overlapping inner equilateral triangular portion 172, second right triangular portion 174A, is folded outward about transverse score 166A, overlapping the first right triangular portion 173A, third right triangular portion 175A, is folded inward about diagonal score 164B, overlapping second right triangular portion 174A, fourth right triangular portion 176A, is folded outward about transverse score 166B, overlapping third right triangular portion 175A, and outer equilateral triangular portion 171 is folded inward about diagonal score 164A, overlapping the fourth right triangular portion 176A.

Similarly, on the opposite side of the fourth layer section 154, first right triangular portion 173B is folded inward about diagonal score 164C, overlapping inner equilateral triangular portion 172, second right triangular portion 174B, is folded outward about transverse score 166B, overlapping the first right triangular portion 173B, third right triangular portion 175B, is folded inward about diagonal score 164B, overlapping second right triangular portion 174B, fourth right triangular portion 176B, is folded outward about transverse score 166A, overlapping third right triangular portion 175B, and outer equilateral triangular portion 171 is folded inward about diagonal score 164C, overlapping the fourth right triangular portion 176B.

In order to move a fourth layer section 154 from the folded configuration to the unfolded configuration of FIG. 12, and move the folding book 12 into a fourth stage of expansion, and a fully expanded configuration, outer hinge side 156B is gripped and pivoted outward away from the center 16 of the folding book body 12 and inner hinge side 156A. This action results in unfolding of radial pleats 170A, B, as shown in FIG. 11, and expansion of the fourth layer section 154 from the folded configuration of FIG. 10 to the unfolded configuration of FIG. 12. The fourth layer section 154 has a hexagonal shape after expansion. Repeating this action for each of the fourth layer sections 154 moves the fourth layer 150 into the unfolded configuration, and the folding book 10 into the fourth stage of expansion, as shown in FIG. 12. As shown, each hexagonally shaped fourth layer section 154 is located adjacent to an associated side 92 of the body cavity 90. In the embodiment shown, each fourth layer section 150 is of a hexagonal shape similar to that of the cavity 90.

A second embodiment of a folding book 1010 is shown in FIGS. 13-23.

Figure 13:
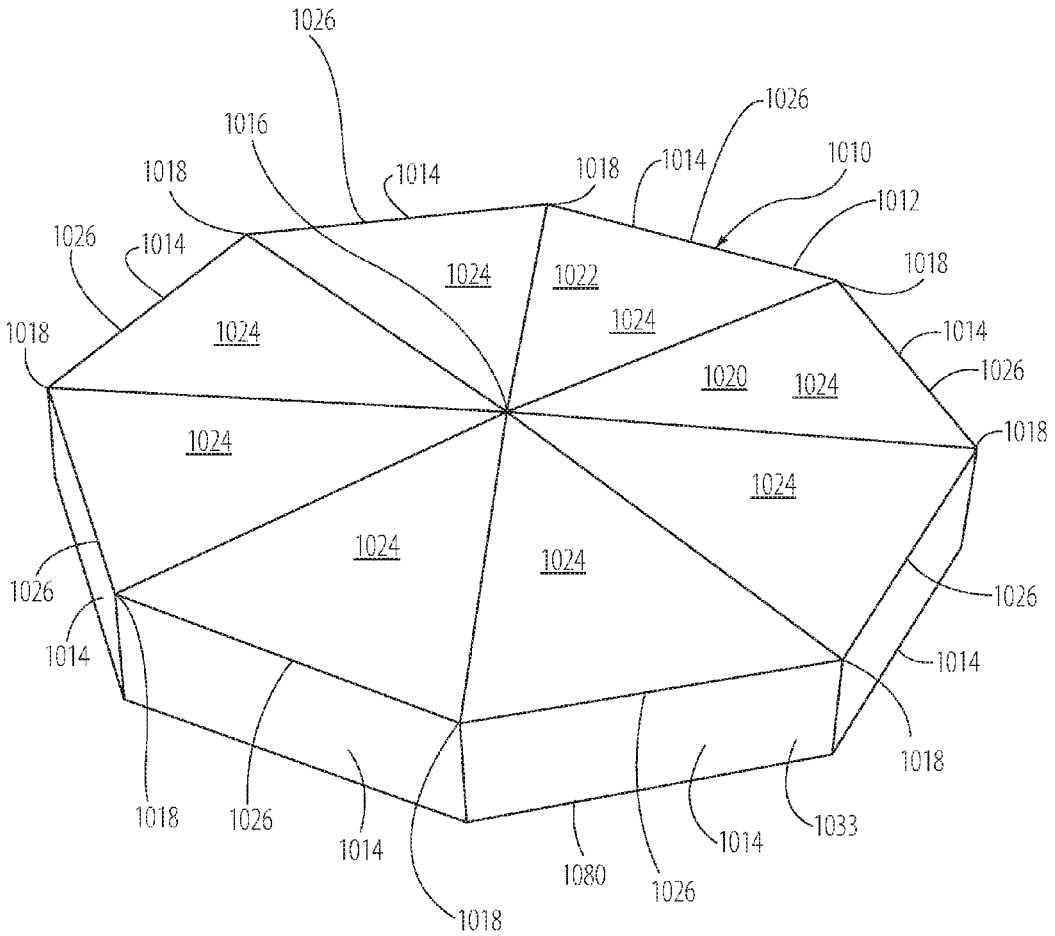
FIG. 13 is a perspective view of a second embodiment of a folding book, in a collapsed configuration.
Figure 23:
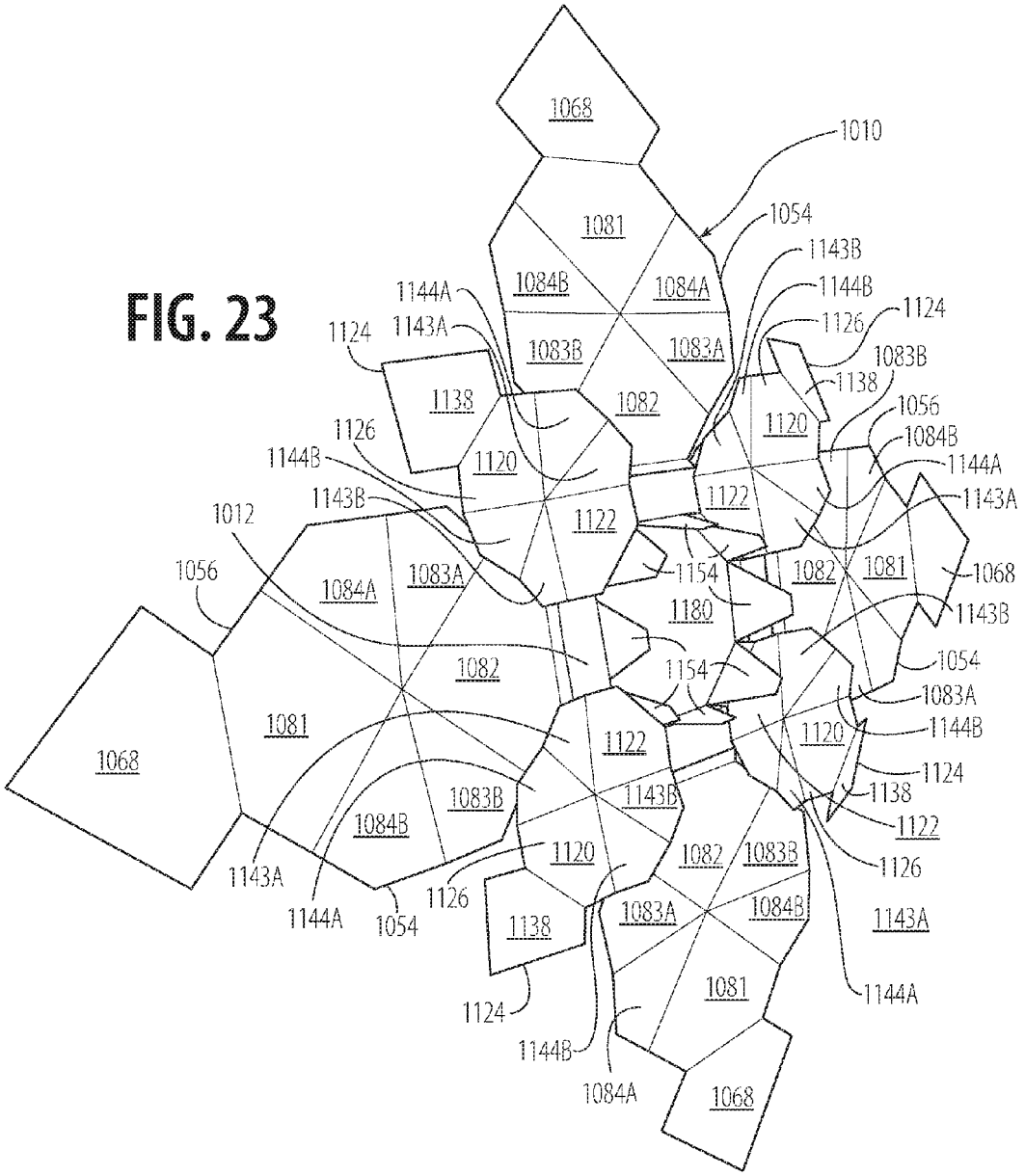
FIG. 23 is a perspective view of the folding book of FIG. 13 in a fully expanded configuration.

The folding book 1010 moves between a collapsed configuration, shown in FIG. 13, and an expanded configuration, shown in FIG. 23. As shown, the folding book 1010 comprises an octagonal body 1012 having a stacked four layer construction including a first or top layer 1020, a second layer 1050 located just beneath the first layer 1020, a third layer 1100 located just beneath the second layer 1050, and a fourth or bottom layer 1150 located just beneath the third layer 1100. A book base 1180 is located beneath the fourth or bottom layer 1150.

Each layer moves between a folded and an unfolded configuration in a selected order, to move the folding book 1010 from the collapsed configuration to the expanded configuration, as described in detail below. Each layer includes a plurality of layer sections, and each of the layer sections individually moves between a folded configuration and an unfolded configuration, to move the layer between the folded configuration and the unfolded configuration, as described in further detail below.

As shown in FIG. 13, the octagonal body 1012 includes a center 1016 and eight sides 1014 extending between eight vertices 1018. In one embodiment, the octagonal body 1012 has a diameter of 8 inches, with each side 1014 having a length of approximately 3 inches, and a thickness of 3/16 inch, but the dimensions may vary depending on desired use and appearance of the folding book 1010.

Figure 14:
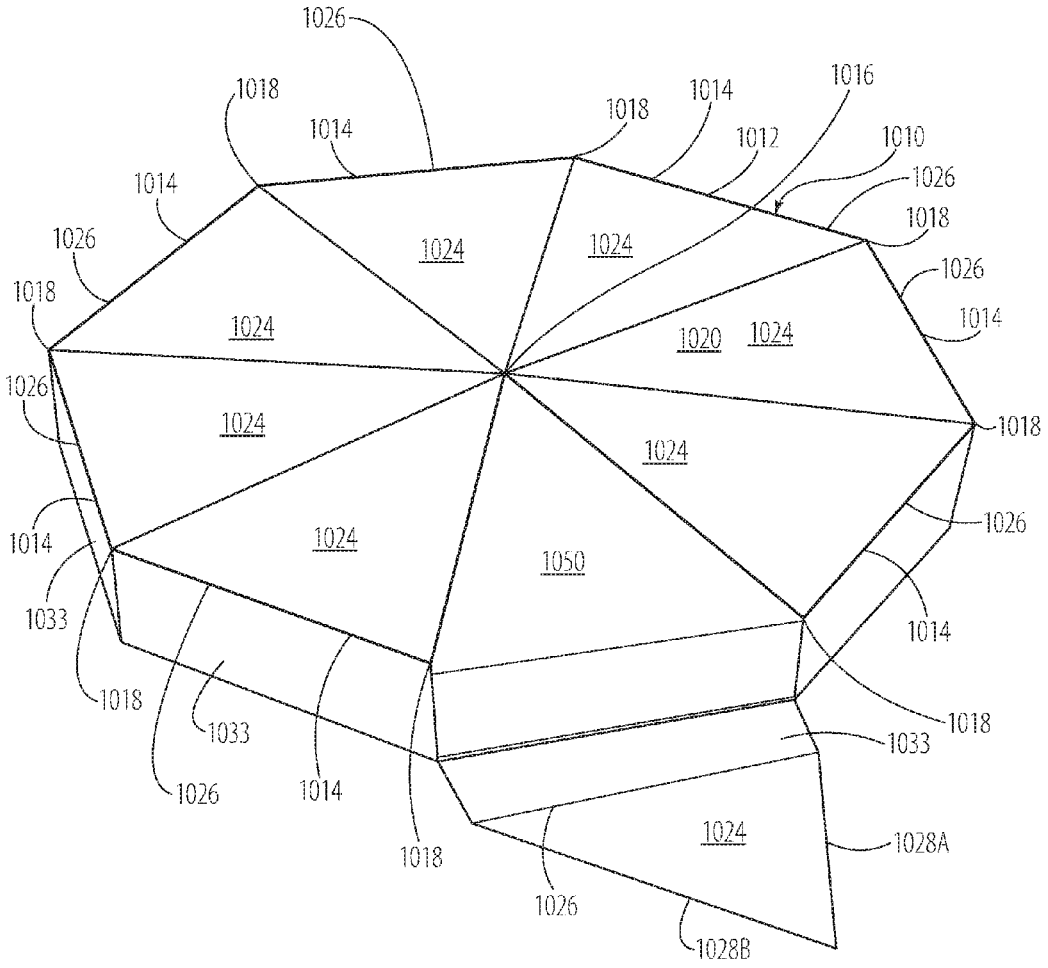
FIG. 14 is a perspective view of the folding book of FIG. 13, showing the first layer in a partially unfolded configuration.
Figure 15:
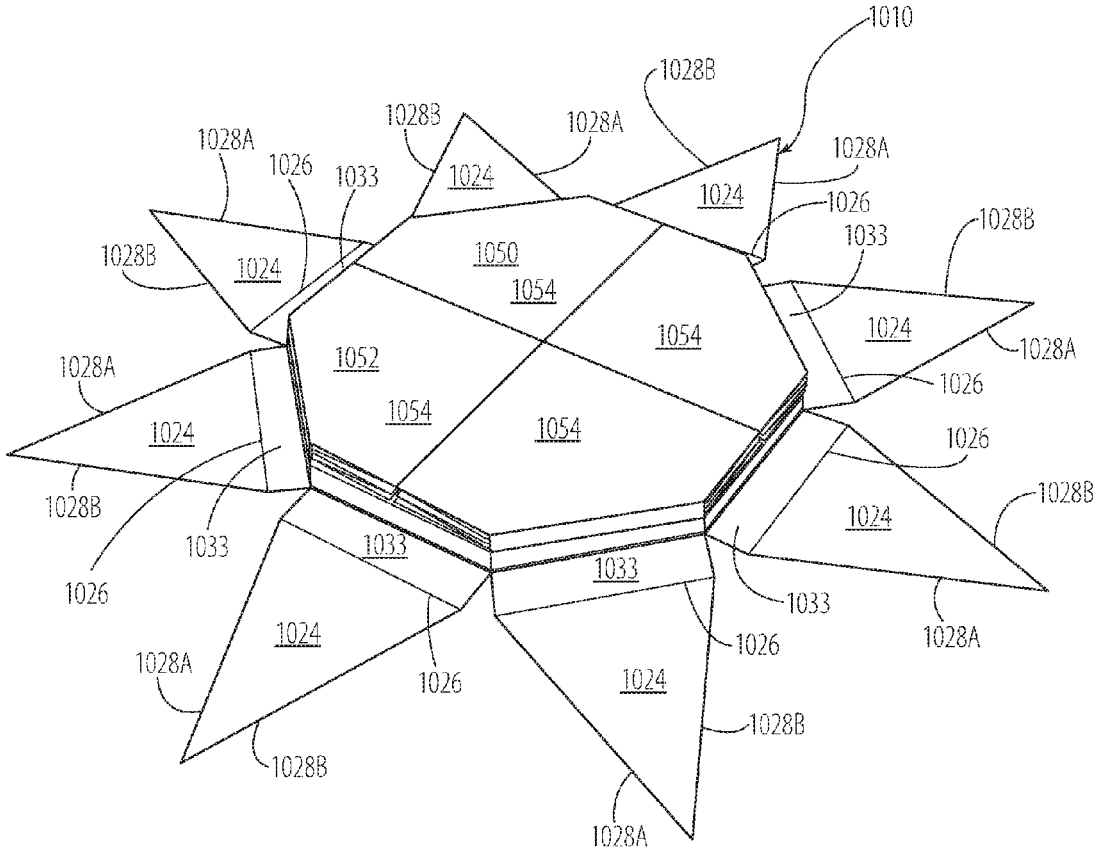
FIG. 15 is a perspective view of the folding book of FIG. 13, showing the first layer in an unfolded configuration.
Figure 16:
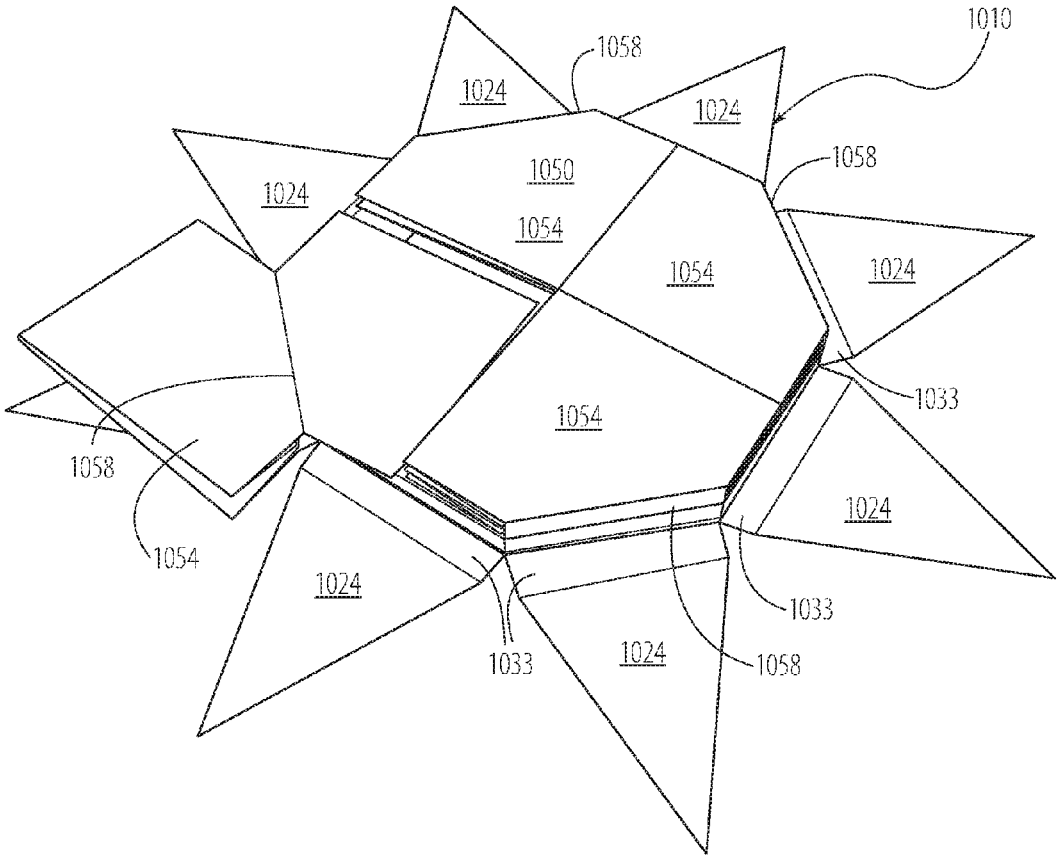
FIG. 16 is a perspective view of the folding book of FIG. 13, showing the second layer in a partially unfolded configuration.
Figure 17:
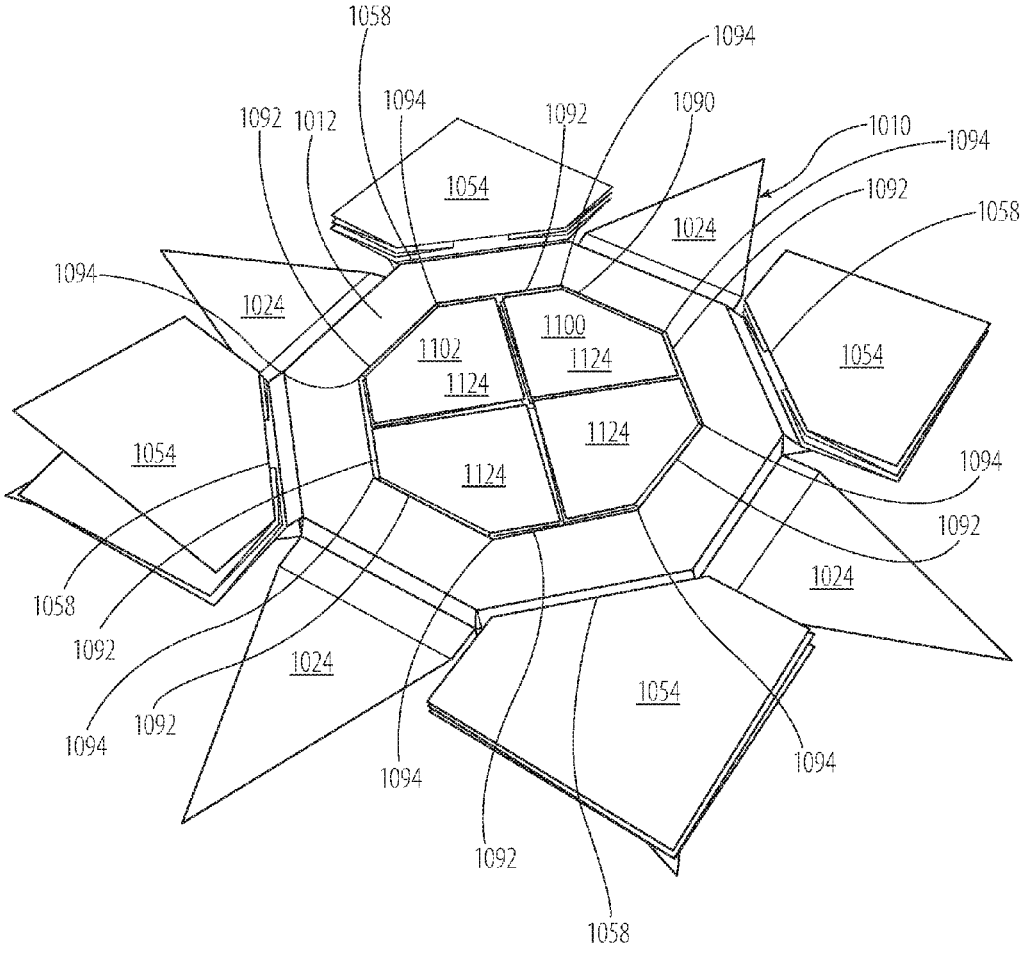
FIG. 17 is a perspective view of the folding book of FIG. 13, showing the second layer in a partially unfolded configuration, subsequent to that of FIG. 16.

Referring to FIGS. 13-15, the first layer 1020 and a first stage of expansion of the folding book 1010 is shown in detail. As shown, the first layer 1020, in the folded configuration of FIG. 13, has an octagonal shape and a top surface 1022 forming a top surface of the folding book 1010.

The first layer 1020 is formed of eight identical first layer sections 1024. Each first layer section 1024 moves between a folded configuration, shown in FIG. 13, and an unfolded configuration, shown in FIG. 15. As shown, in the folded configuration, each first layer section 1024 has an isosceles triangular shape. Referring to FIG. 13, each first layer section 1024 has a base side 1026 having a length that may be equal to the length of each side 1014 of the body 1012, for example approximately 3 inches, and a height of approximately 3.7 inches, about or slightly less than half the diameter of the octagonal body 1012. Each first layer section 1024 further has opposite leg sides 1028A, B, extending between a vertex 1018 and the center 1016 of the body 1012.

When in the folded configuration, the first layer sections 1024 fit together to form an octagonal shape that may be similarly sized to the octagonal shape of the folding book body 1012, as shown in FIG. 13. As shown, each first layer section 1024 is located adjacent to an associated side 1014 of the body 1012 and attached to the base 1018 by an attachment strip 1033, which may have a height of slightly greater than the thickness of the book, for example 5/16 inch.

Referring to FIG. 14, the base side 1026 of each first layer section 1024 lies on an outer edge and forms a portion of a side 1014 of the folding book body 1012 when the first layer 1020 is in the folded configuration. The attachment strip 1033 may extend between an outer edge of the base 1180 and the base side 1026 of each first layer section, joining the first layer sections to the base 1180 such that in the folded configuration of FIG. 13, the attachment strips 1033 form side walls of the book body 1012, with each of the second 1050, third 1110 and fourth 1150 layers in their folded configurations housed within.

To move the first layer 1024 from the folded configuration to the unfolded configuration, each section 1024 is first pivoted outward from the center 1016 of the book body 1012 about the base side 1026, as shown in FIG. 14. This is repeated for each first layer section 1024, until all have been pivoted to the positions shown in FIG. 15. As shown, each first layer section 1024 is located adjacent to an associated side 1014 of the body 1012 and attached to the base 1018 by the attachment strip 1033.

Referring to FIGS. 15-18, 20 and 20A the second layer 1050 and a second stage of expansion of the folding book 1010 is shown in detail. As shown in FIG. 15, the second layer 1050, in the folded configuration has an octagonal shape and a top surface 1052, which forms a top surface of the book body 1012 following the first stage of expansion and before the second stage of expansion.

Figure 20:
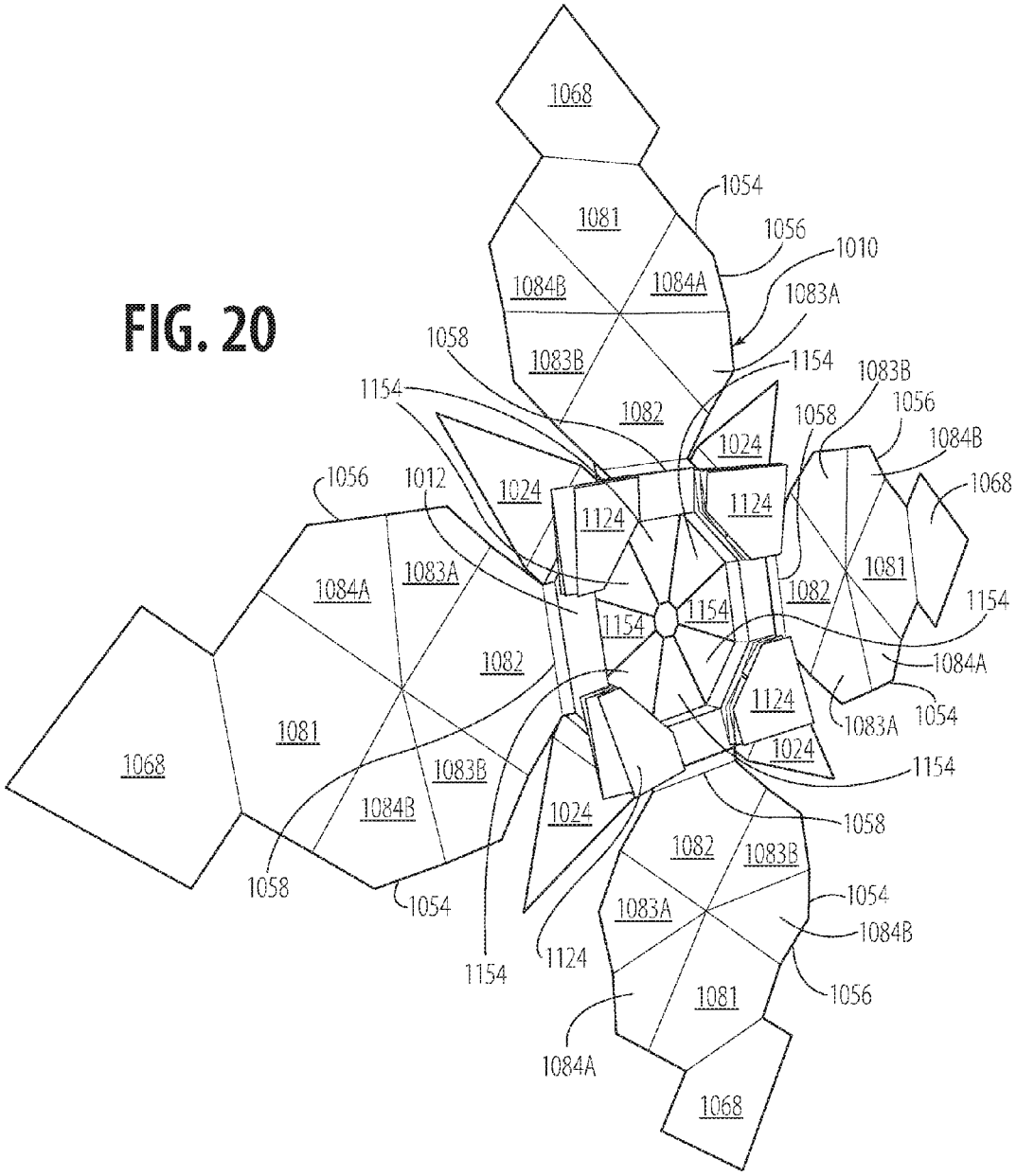
FIG. 20 is a perspective view of the folding book of FIG. 13, showing the third layer in a partially unfolded configuration.
Figure 20A:
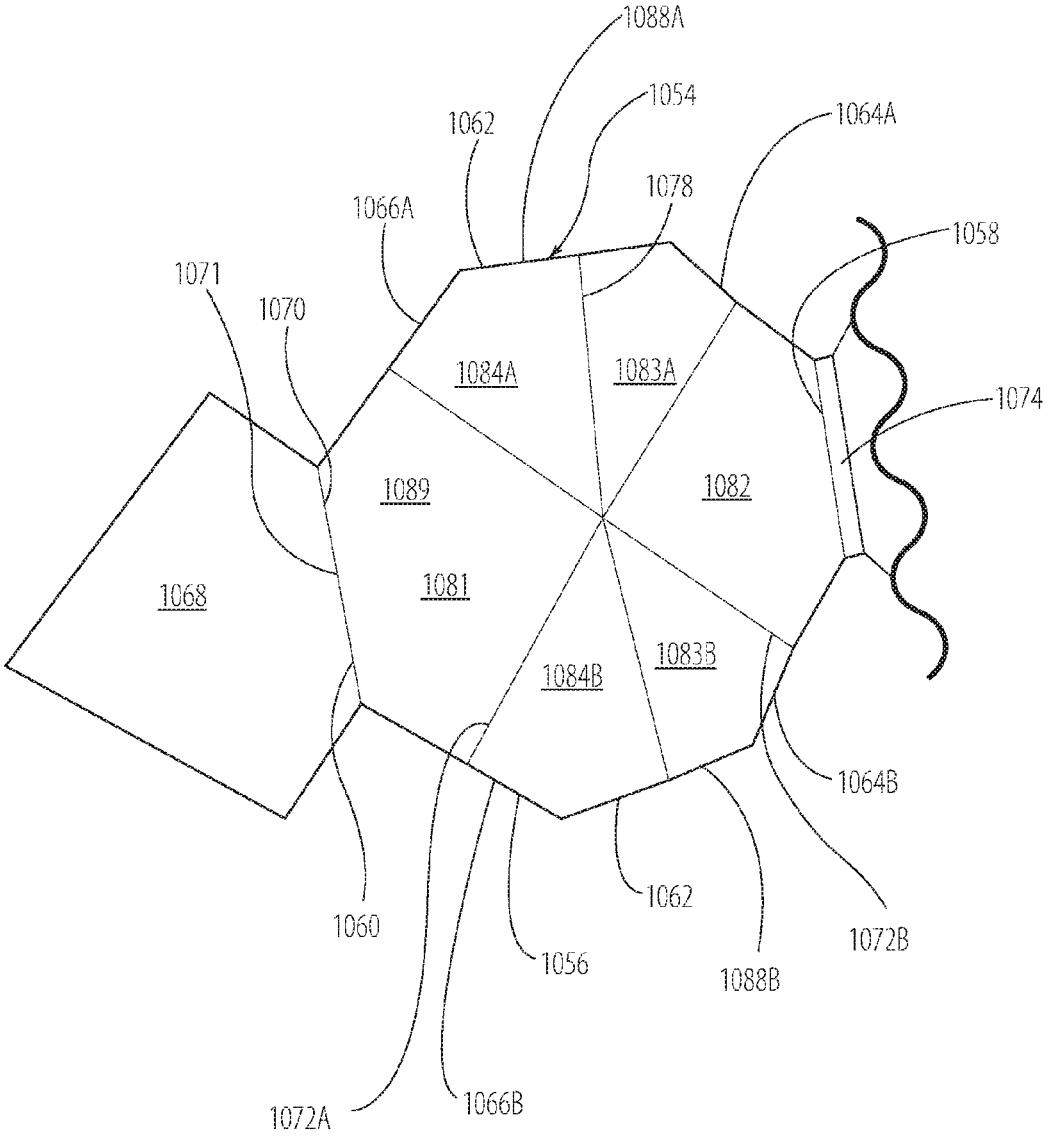
FIG. 20A is a detail of FIG. 20, showing just a second layer section.

The second layer 1050 is formed of four identical second layer sections 1054. Each second layer section 1054 moves between a folded configuration, shown in FIG. 15, and an unfolded configuration, shown in FIG. 20. As shown, the octagonal shape of the second layer 1050, when in the folded configuration, is divided into fourths by the four identical second layer sections 1054, each of which has an identical five sided quarter octagon shape in the folded configuration. In particular, the shapes four second layer sections 1054, are formed by bisecting the octagonal shape of the second layer 1050 in two perpendicular directions that traverse alternating sides of the second layer's hexagonal shape. In the unfolded configuration, as shown in FIGS. 20 and 20A, each second layer section 1054 includes an octagonal portion 1056, which may be dimensioned the same as the octagonal body 1012, for example having a diameter of 8 inches. Each octagonal portion 1056 includes an attachment side 1058 which may be pivotally joined with a side 1014 of the body 1012. In the embodiment shown, an attachment strip 1074 may extend between the attachment side 1058 and the body 1012, the attachment strip 1074 being formed as a thin strip of material having a length equal to the attachment side 1058 and the side 1014 of the body. The attachment strip 1074 doesn't permit the second layer sections 1054 to fold around the third and fourth layers 1110, 1150 when in their folded configurations. The third and fourth layers 1110, 1150 are contained within the cavity 1090 of the base octagon, and attachment strips 1074 permit the second layer sections to fold on top of the third and fourth layer sections 1110, 1150, which are contained in cavity 1090 of the base octagon.

An outer side 1060 is located opposite attachment side 1058. Opposite perpendicular sides 1062 extend between outer side 1060 and attachment side 1058, joined thereto by inner diagonal sides 1064A, B and outer diagonal sides 1066A, B. Attachment sides 1058 are attached to alternating sides 1014 of the body 1012. Each second layer section 1054 further includes a quarter octagonal extension 1068 that extends radially outward from the outer side 1060. As shown in FIG. 20A, each extension 1068 may be shaped and dimensioned the same as an individual second layer section 1050 when in the folded configuration, and includes an inner radial side 1070 pivotally joined with outer side 1060 of octagonal portion 1056. An extension score 1071 is formed along the inner radial side 1070, between the extension 1068 and the adjacent octagonal portion 1056.

Each second layer section 1054 moves from its folded configuration, shown in FIG. 15, to its unfolded configuration, shown in FIG. 20, to move the folding book 1010 to a second stage of expansion. Each second layer section has, in its unfolded configuration, an upper surface 1089 and a lower surface, and comprises a plurality of scores, each score being a linear crimp, fold line, or half cut, creating a predetermined fold pattern.

First and second diagonal scores 1072A, B are formed in each octagonal portion 1056, each extending between opposite inner and outer diagonal sides 1064, 1066 to bisect the octagonal shape of the octagonal portion. A single transverse score 1078 is formed in each octagonal portion 1056, extending between opposite perpendicular sides 1062 to bisect the octagonal shape of the octagonal portion 1056. The scores divide each octagonal portion 1056 into an outer quarter octagon, 1081, inner quarter octagon 1082, located between the outer quarter octagon 1081 and body 1012. The scores further define inner eighth octagonal portions 1083A, B, 1084A, B located on each side of each octagonal portion 1056 between the inner and outer quarter octagonal portions 1081, 1082.

A ridge is formed along the length of transverse score 1078 and along extension score 1071. A valley is formed along the length of each diagonal score 1072. The alternating valleys and ridges formed via scores in the second layer sections result in a first radial pleat 1088A extending along a first side of each octagonal portion 1056 and a second radial pleat 1088B extending along a second side of each octagonal portion 1056.

Accordingly, when in the folded configuration of FIG. 15, the quarter octagonal extensions 1068 overlap the body 1012, with a lower surface of each extension 1068 facing the book body 1012 and the folded octagonal portions 1056 sandwiched in between. Specifically, inner eighth octagonal portion 1083A is folded inward about diagonal score 1072A, overlapping quarter octagonal portion 1082, outer eighth octagonal portion 1084A is folded outward about transverse score 1078, overlapping inner eighth octagonal portion 1083A, outer quarter octagonal portion 1081 is folded inward about diagonal score 1072B, overlapping outer eighth octagonal portion 1083.

Similarly, on the opposite side of the second layer section 1054 the quarter octagonal extensions 1068 overlap the body 1012, with a lower surface of each extension 1068 facing the book body 1012 and the folded octagonal portions 1056 sandwiched in between. Inner eighth octagonal portion 1083B is folded inward about diagonal score 1072B, overlapping quarter octagonal portion 1082, outer eighth octagonal portion 1084B is folded outward about transverse score 1078, overlapping inner eighth octagonal portion 1083B, outer quarter octagonal portion 1081 is folded inward about diagonal score 1072A, overlapping outer eighth octagonal portion 1083.

Quarter octagonal extension 1068 is folded outward about extension score 1071, overlapping the back surface of quarter octagon 1081. Three of the second layer sections 1054 are shown in this partially folded configuration in FIG. 16. As shown, one of the second layer sections 1054 has been partially unfolded by pivoting then entire section in a folded configuration about the extension score 1071, to begin moving the second layer section 1054 into an unfolded configuration. This begins the process of moving the second layer section 1054 into the unfolded configuration.

Figure 18:
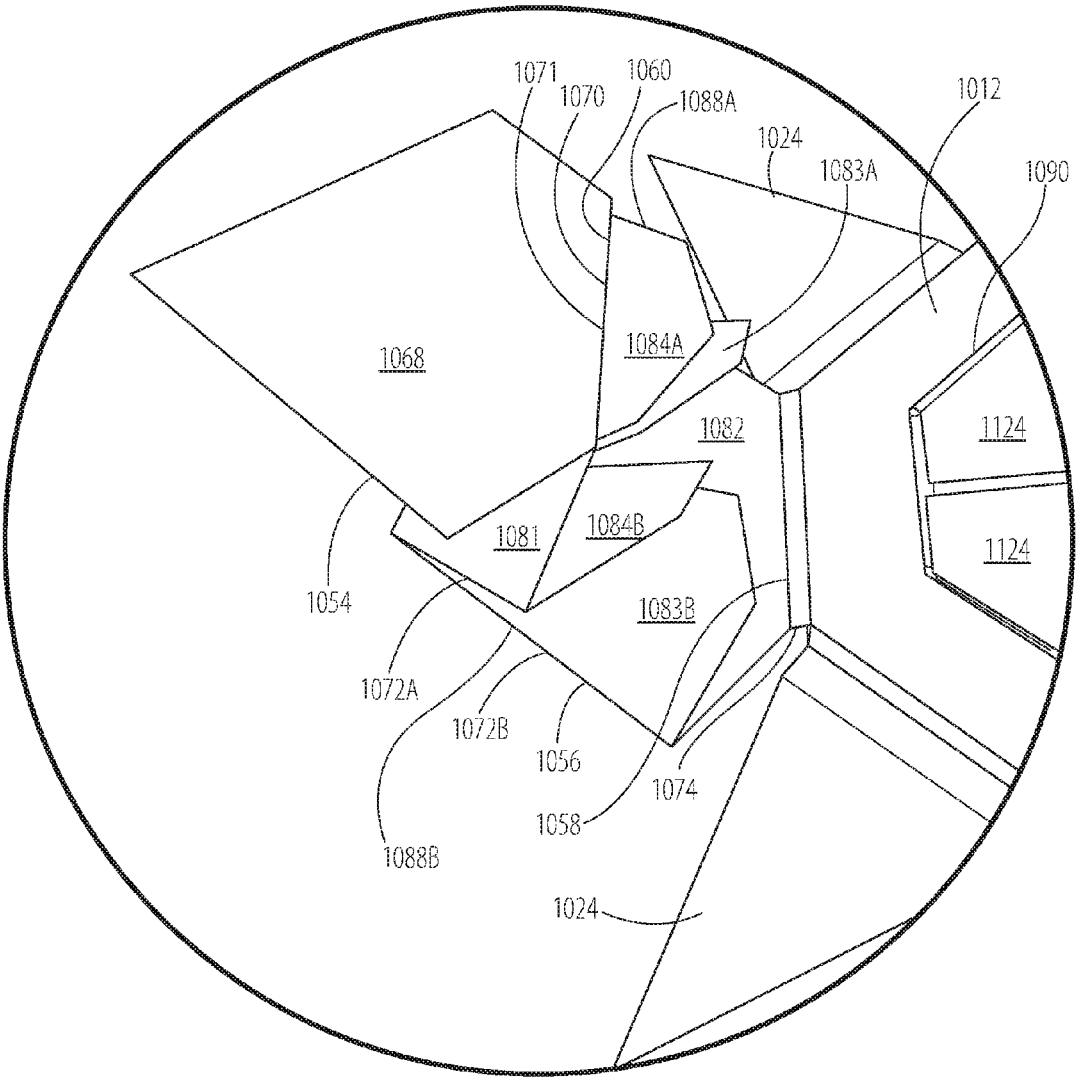
FIG. 18 is a detailed perspective view of the folding book of FIG. 13, showing a second layer section during unfolding.

In order to continue moving the second layer section 1054 into an unfolded configuration, extension 1068 is grasped and drawn radially outward, away from the center 1016 of book body 1012, as shown in FIG. 18, resulting in unhinging of the second layer section 1054 about the triangular pleats 1088A, B, and extension into the elongate shape shown in FIG. 20. Repeating this action for each of the second layer sections 1054 moves the second layer 1050 into the unfolded configuration and the folding book 10 into the second stage of expansion, as shown in FIG. 20. In this configuration, each second layer section 1054 is partially overlapping and partially located between two adjacent first layer sections 1024.

Figure 19:
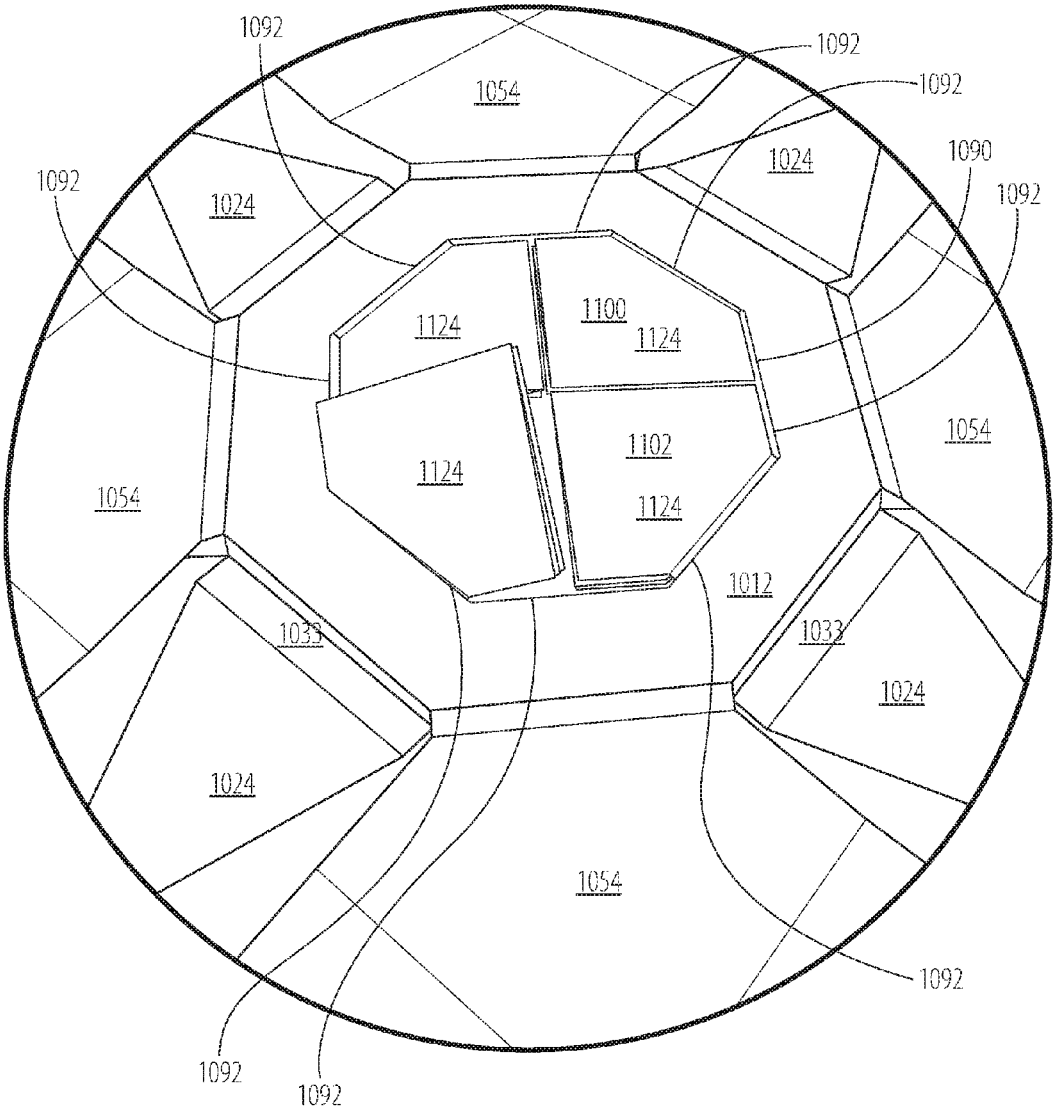
FIG. 19 is a detailed perspective view of the folding book of FIG. 13, showing the third layer during unfolding.

Referring to FIGS. 20-22A the third layer 1100 and a third stage of expansion of the folding book 1010 is shown in detail. As shown in FIG. 19, the folding book body 1012 defines a cavity 1090 beneath the second layer 1050, which extends downward and terminates at the book base 1180. The cavity 1090 houses the third layer 1100 and fourth layer 1150 when in their respective folded configurations. The cavity 1090 is of an octagonal shape, similar to and smaller than that of the folding book body. In one embodiment, the cavity has a diameter of 5.5 inches. The cavity 1090 has eight sides 1092, positioned in radial alignment with the eight sides 1014 of the book body 1012, and eight vertices 1094, positioned in radial alignment with the eight vertices 1018 of the book body 1012.

The third layer 1100 is of an octagonal shape, similar to that of the book body 1012 and the cavity 1090, and is sized to fit snugly within the cavity 1090 when in the folded configuration. In one embodiment, the third layer 1100, when in the folded configuration, has a diameter of 5.5 inches. The third layer 1100 has a top surface 1102 when in the folded configuration, which forms a top surface of the book body 1012 following the second stage of expansion and before the third stage of expansion.

The third layer 1100 is formed of four identical third layer sections 1124. Each third layer section 1124 moves between a folded configuration, shown in FIG. 19, and an unfolded configuration, shown in FIGS. 22 and 22B. As shown, the octagonal shape of the third layer 1100, when in the folded configuration, is divided into fourths by the four identical third layer sections 1124, each of which has an identical five sided quarter octagon shape in the folded configuration. In particular, the shapes four third layer sections 1124, are formed by bisecting the octagonal shape of the second layer 1050 in two perpendicular directions that traverse alternating sides of the second layer's hexagonal shape. The bisecting lines dividing the third layer 1100 into the third layer sections 1124 are misaligned with those of the second layer sections 1054, so that the third layer sections 1124 are staggered with respect to the second layer sections 1054, and are aligned with alternating first layer sections 1024. As a result, when in the unfolded configuration, the expanded third layer sections 1124 extend radially outward between the second layer sections 1054, as shown in FIGS. 19 and 22B.

Figure 22:
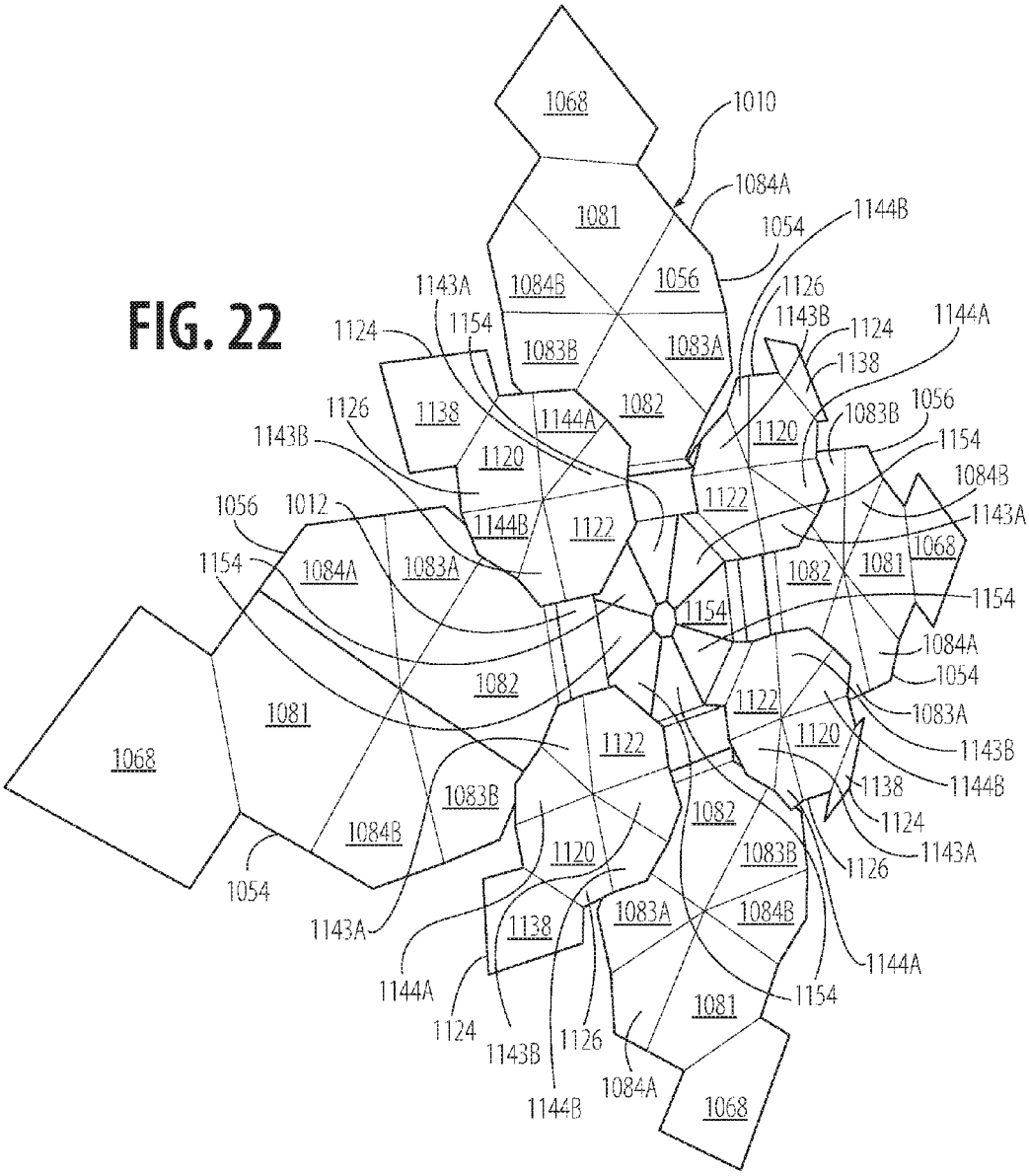
FIG. 22 is a perspective view of the folding book of FIG. 13, showing the third layer section in an unfolded configuration.

In the unfolded configuration of FIG. 22, each third layer section 1124 includes an octagonal portion 1126, which may be dimensioned the same as the octagonal body 1112, for example having a diameter of 4 inches. Each octagonal portion 1126 includes an attachment side 1128 which may be pivotally joined with a side 1092 of the cavity 1090.

An outer side 1130 is located opposite attachment side 1128. Opposite perpendicular sides 1132A, B extend between outer side 1130 and attachment side 1128, joined thereto by inner diagonal sides 1134A, B and outer diagonal sides 1136A, B. As shown in FIG. 22, attachment sides 1128 are attached to alternating sides 1092 of the cavity 1090. Each third layer section 1124 further includes a quarter octagonal extension 1138 that extends radially outward from the outer side 1130. As shown in FIG. 22, each extension 1138 may be shaped and dimensioned the same as an individual third layer section 1124 when in the folded configuration, and includes an inner radial side 1140 pivotally joined with outer side 1130 of octagonal portion 1135. An extension score 1146 is formed along the inner radial side 1140, between the extension 1138 and the adjacent octagonal portion 1126.

Figure 22A:
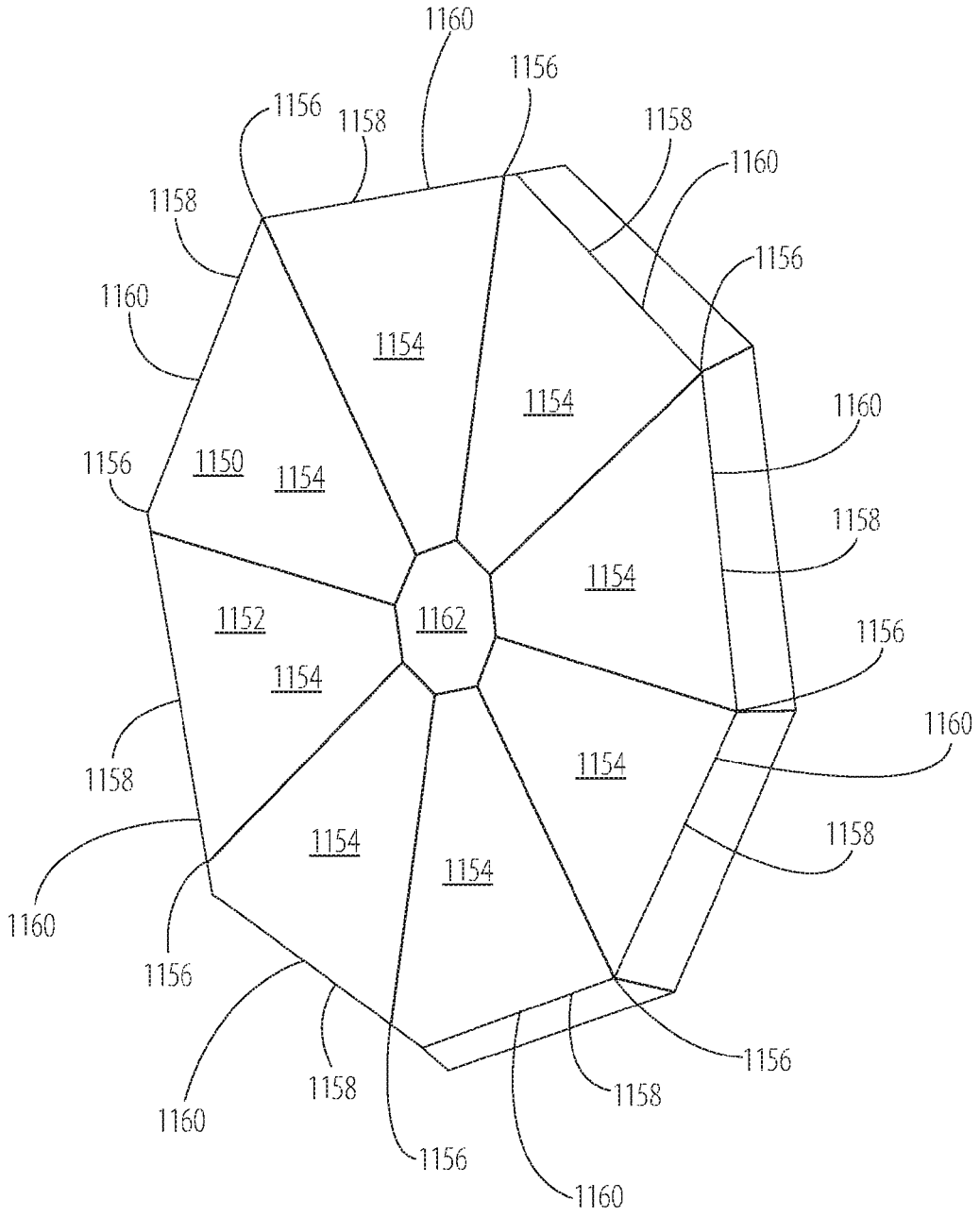
FIG. 22A is an enlarged detail of FIG. 22, showing just the fourth layer.
Figure 22B:
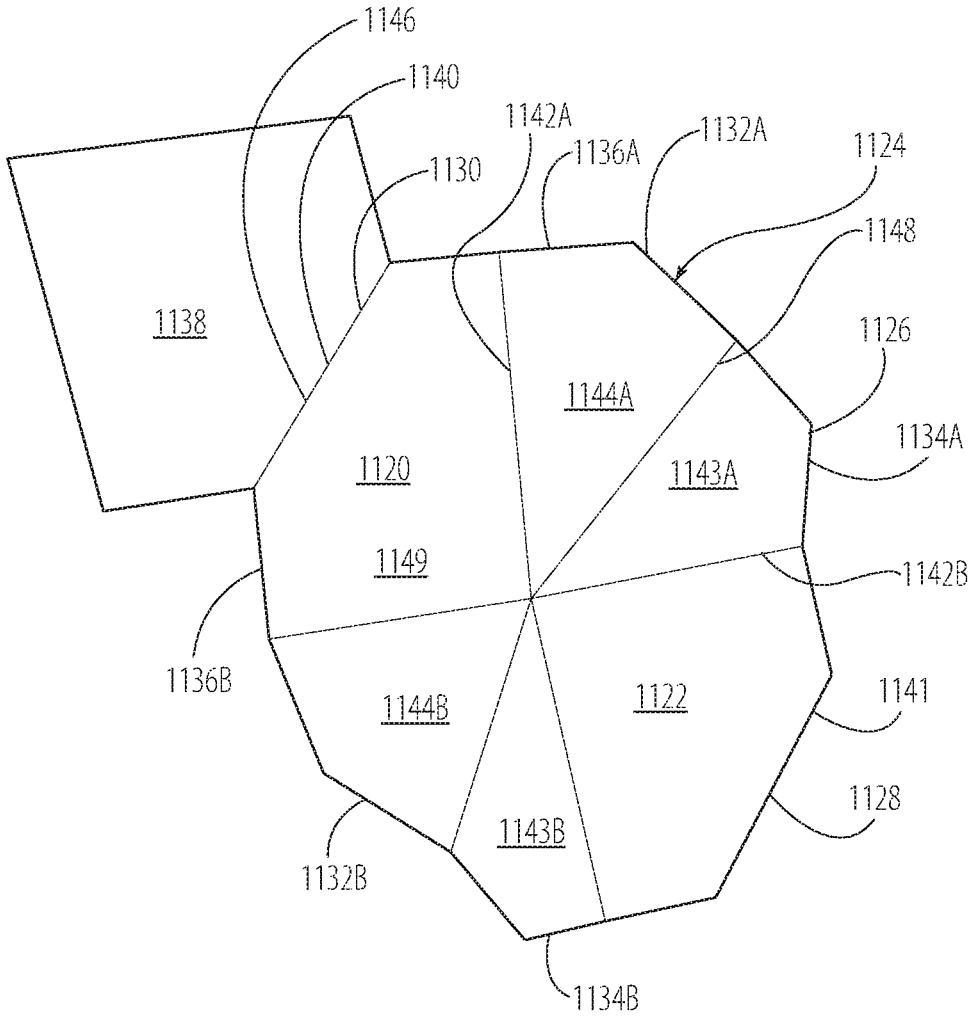
FIG. 22B is an enlarged detail of FIG. 22, showing just a third layer section.

Each third layer section 1124 moves from its folded configuration, shown in FIG. 19, to its unfolded configuration, shown in FIGS. 22 and 22B, to move the folding book 1010 to a third stage of expansion. Each third layer section 1124 has, in its unfolded configuration, an upper surface 1149 and a lower surface, and comprises a plurality of scores, each score being a linear crimp, fold line, or half cut, creating a predetermined fold pattern.

First and second diagonal scores 1142A, B are formed in each octagonal portion 1126, each extending between opposite inner and outer diagonal sides 1134, 1136 to bisect the octagonal shape of the octagonal portion. A single transverse score 1148 is formed in each octagonal portion 1126, extending between opposite perpendicular sides 1132 to bisect the octagonal shape of the octagonal portion 1126. The scores divide each octagonal portion 1126 into an outer quarter octagon, 1120, inner quarter octagon 1121, located between the outer quarter octagon 1120 and body 1012. The scores further define inner eighth octagonal portions 1143A, B, 1144 A, B located on each side of each octagonal portion 1126 between the inner and outer quarter octagonal portions 1120, 1122.

A ridge is formed along the length of transverse score 1148 and along an extension score 1146. A valley is formed along the length of each diagonal score 1142. The alternating valleys and ridges formed via scores in the second layer sections result in a first triangular pleat 1108A extending along a first side of each octagonal portion 1126 and a second triangular pleat 1108B extending along a second side of each octagonal portion 1126.

Accordingly, when in the folded configuration of FIG. 19, the quarter octagonal extensions 1138 overlap the body 1012, with a lower surface of each extension 1138 facing the book body 1012 and the folded octagonal portions 1126 sandwiched in between. Specifically, inner quarter octagonal portion 1122, is folded inward about adjoining score 1141, inner eighth octagonal portion 1143B is folded inward about diagonal score 1142A, overlapping quarter octagonal portion 1122, outer eighth octagonal portion 1144B is folded outward about transverse score 1148, overlapping inner eighth octagonal portion 1143B, outer quarter octagonal portion 1120 is folded inward about diagonal score 1142B, overlapping outer eighth octagonal portion 1144.

Similarly, on the opposite side of the third layer section 1124 the quarter octagonal extensions 1138 overlap the body 1012, with a lower surface of each extension 1138 facing the book body 1012 and the folded octagonal portions 1126 sandwiched in between. Inner quarter octagonal portion 1122, is folded inward about adjoining score 1141, inner eighth octagonal portion 1143A is folded inward about diagonal score 1142B, overlapping quarter octagonal portion 1122, outer eighth octagonal portion 1144A is folded outward about transverse score 1148, overlapping inner eighth octagonal portion 1143A, outer quarter octagonal portion 1120 is folded inward about diagonal score 1142A, overlapping outer eighth octagonal portion 1144A, B.

Quarter octagonal extension 1138 is folded outward about extension score 1146, and overlaps the back surface of quarter octagon 1120 to begin moving the third layer sections 1126 into the unfolded configuration. The third layer sections 1126 are shown in this partially folded configuration in FIG. 20.

Figure 21:
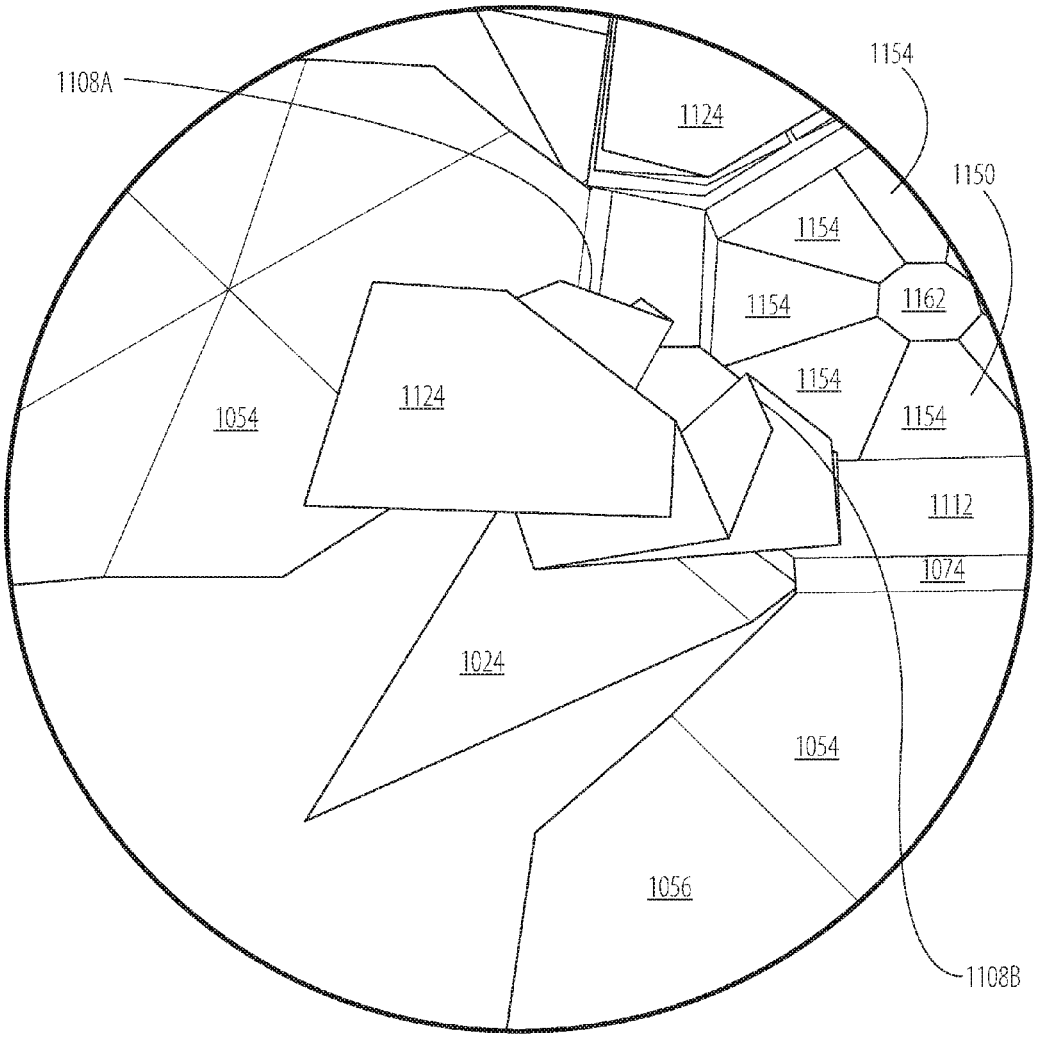
FIG. 21 is a detailed perspective view of the folding book of FIG. 13, showing a third layer section during unfolding.

In order to move each third layer section 1124 into an unfolded configuration, extension 1138 is grasped and drawn radially outward, away from the center 1016 of book body 1012, as shown in FIG. 21, resulting in unhinging of the third layer section 1124 about the triangular pleats 1108A, B, and extension into the elongate shape shown in FIG. 22. Repeating this action for each of the third layer sections 1124 moves the third layer 1100 into the unfolded configuration and the folding book 1010 into the third stage of expansion, as shown in FIG. 22. In this configuration, each third layer section 1124 is partially overlapping and partially located between two adjacent second layer sections 1054.

Referring to FIGS. 22, 22A and 23, the fourth layer 1150 and a fourth stage of expansion of the folding book 1010 is shown in detail. As shown, the fourth layer 1150, in the folded configuration of FIG. 22A, has a hexagonal shape and a top surface 1152 forming a portion of the top surface of the folding book 1010 following the third stage of expansion and before the fourth stage of expansion. The fourth layer 1150 includes eight vertices 1156 located between each of eight sides 1158. Each of the eight sides 1158 is radially aligned with a second layer section 1054 or a third layer section 1124.

The fourth layer 1150 is formed of eight identical fourth layer sections 1154. Each fourth layer section 1154 moves between a folded configuration, shown in FIG. 22, and an unfolded configuration, shown in FIG. 23. As shown, each fourth layer section 1154 has an isosceles triangular shape, and in particular forms an eighth of the octagonal shape of the fourth layer section 1150, which is divided in linear cuts extending between opposite vertices 1156. Each fourth layer section 1154 may have a length of one half the diameter of the cavity 1090, for example 2.75 inches in the embodiment shown. The forth layer 1150 may be housed within the cavity 1090 when in the folded configuration, with the sides 1158 each affixed to the base 1180 about an attachment hinge 1160. An opening 1162 may be formed at the center of the fourth layer 1150, cutting into the vertex angle of each fourth layer section 1154. The opening 1162 may have a diameter of 1.25 inches, being formed by cutting the tip of each fourth layer section 1154 by a height of 0.625 inches.

To move the book fourth layer 1150 into the unfolded configuration, and in turn move the book 1010 to the fully expanded configuration, each fourth layer section 1154 is pivoted about attachment hinge 1160 until perpendicular to the base 1180, as shown in FIG. 23. A user may insert a finger into the opening 1162 to facilitate gripping of a fourth layer section 1154 in order to initiate this pivoting action.

A third embodiment of a folding book 2010 is shown in FIGS. 24-29.

Figure 24:
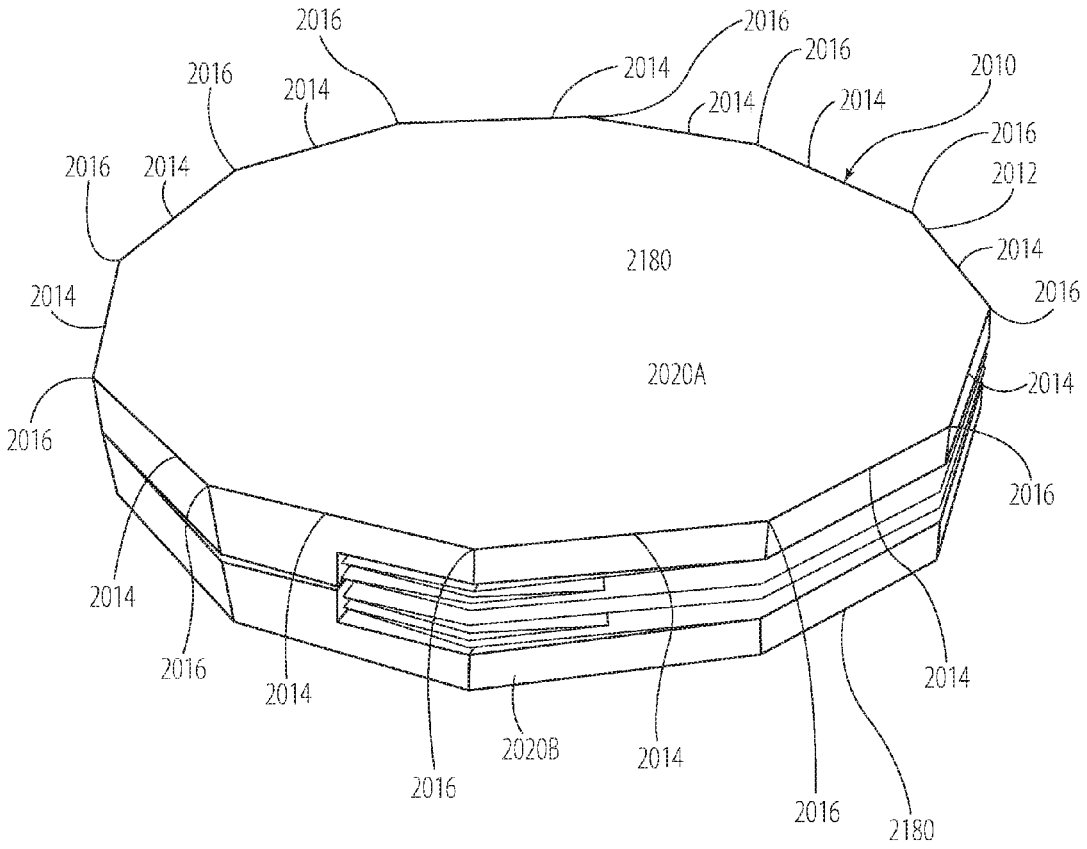
FIG. 24 is a perspective view of a third embodiment of a folding book, in a collapsed configuration.
Figure 29:
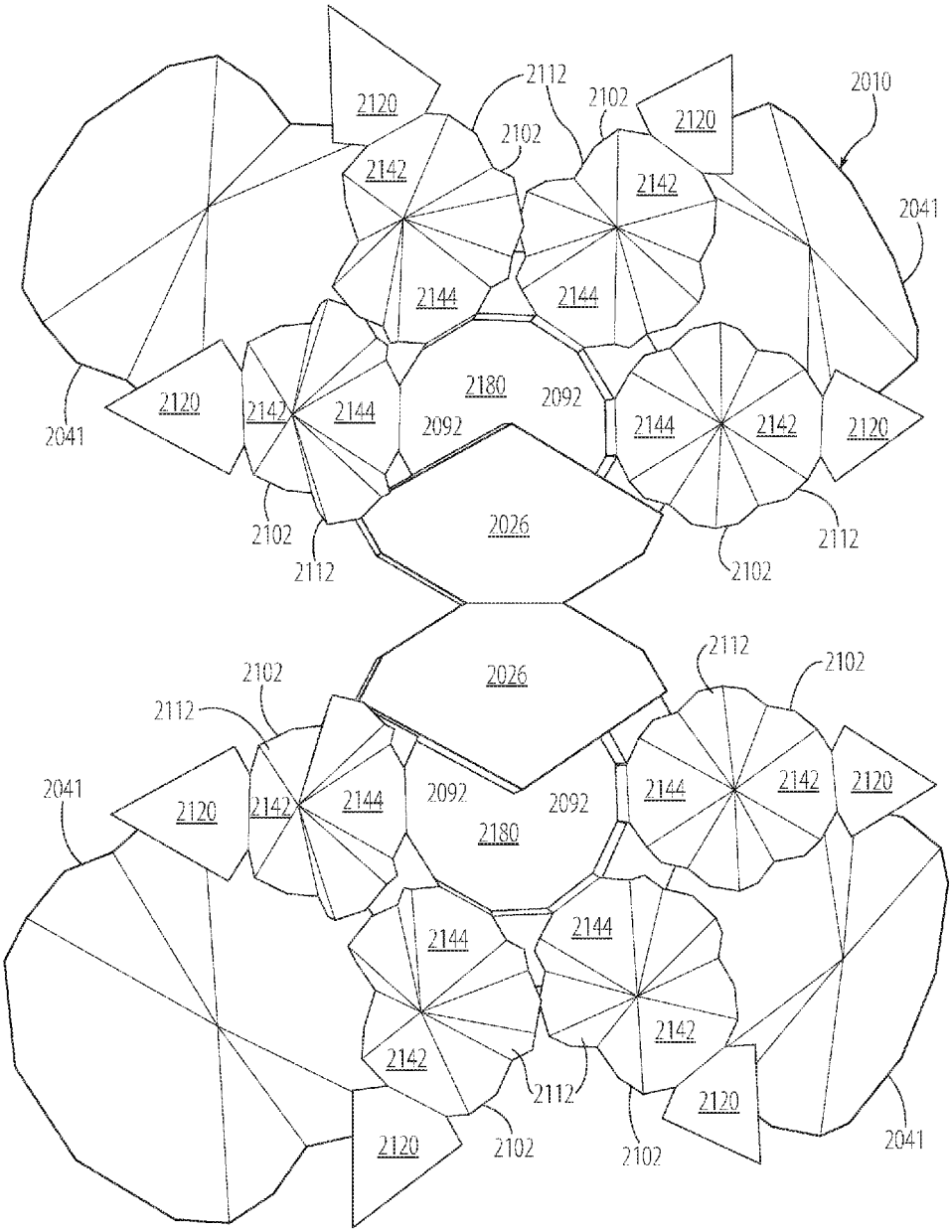
FIG. 29 is a perspective view of the folding book of FIG. 23, in a fully expanded configuration.

The folding book 2010 moves between a collapsed configuration, shown in FIG. 24, and an expanded configuration, shown in FIG. 29. As shown, the folding book 2010 comprises a dodecagonal body 2012 having twelve sides 2014 and twelve vertices 2016 joining adjacent pairs of the sides 2014. The body 2010 may be, for example, 8 inches in diameter and 1 inch thick, with each side 2014 having a length of 2 inches. The body 2012 is formed of two stacked and pivotally connected book frames 2020A, B, each frame having a two layer construction having a first layer 2040 and a second layer 2090 located beneath the first layer 2040. A book base 2180 is located beneath each of the second layers 2090 and forms top and bottom outer surfaces of the book 2010 when in the folded configuration of FIG. 29.

Figure 25:
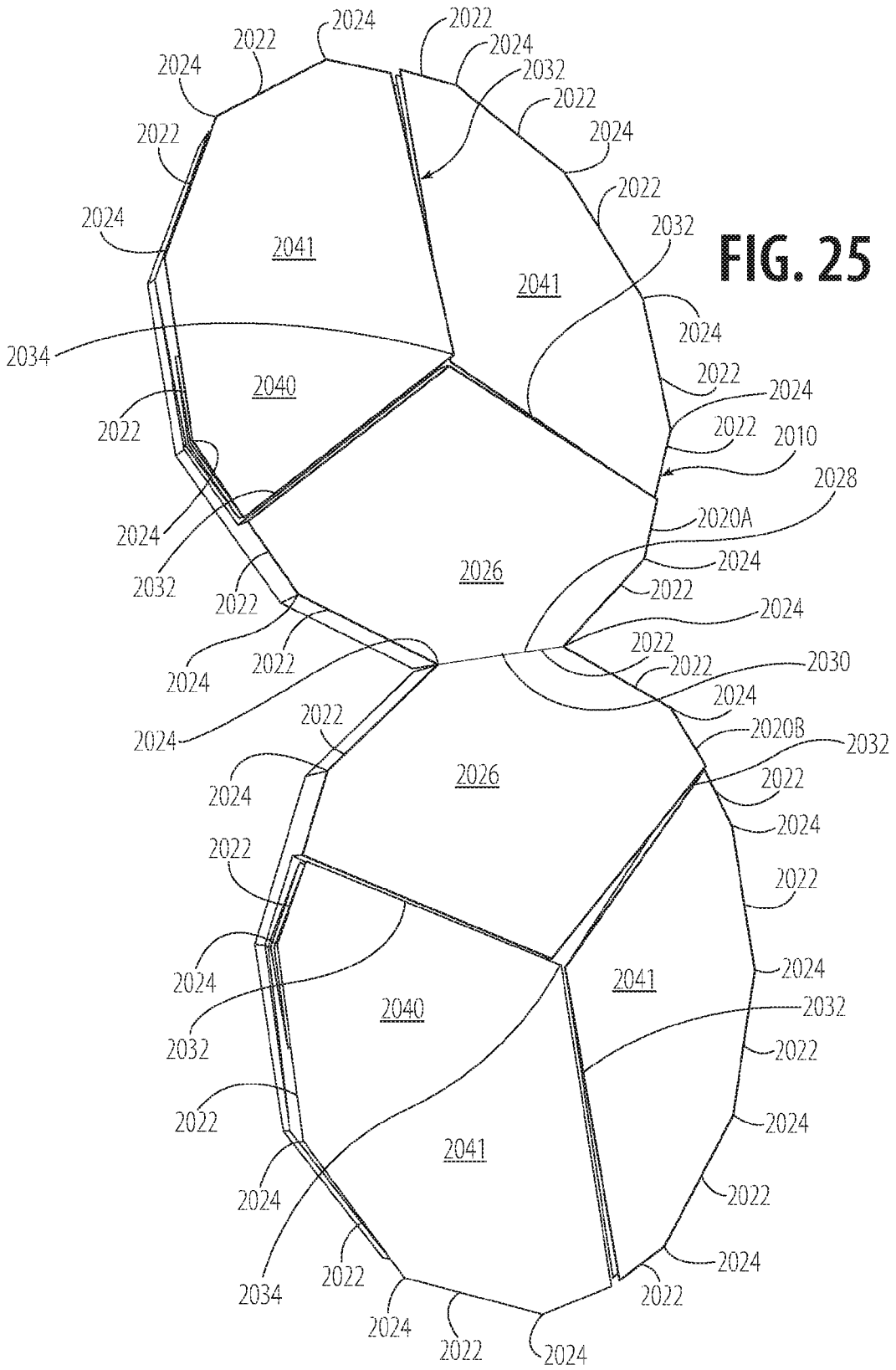
FIG. 25 is a perspective view of the folding book of FIG. 24, showing the book frames in an unfolded configuration.

Referring to FIGS. 24 and 25, the book frames 2020A, B are shown in detail. As shown, each book frame 2020 has a dodecagonal shape which may be congruent to that of the body 2012, for example having an 8 inch diameter, and including a center 2034, twelve sides 2022 and twelve vertices 2024 joining adjacent pairs of the sides 2022. Each of the frames is divided into thirds, with two of the thirds making up the first layers 2040, as explained below, and one of the thirds having continuous surface 2026 extending between the two frames 2020. As shown in FIG. 25, when the frames 2020 are in an unfolded configuration, the continuous surface 2026 joins and extends between the frames 2020, forming a portion of the upper surface of the book 2010 in this configuration. One of the sides 2022 of each frame, and in particular a connecting side 2028 is attached to the connecting side of the other frame 2020. A connecting hinge 2030 is formed in the surface 2026 at the connecting side 2028, pivotally joining the frames 2020. When in the closed configuration of FIG. 24, the surface 2026 of each frame, as well as the folded first layers 2040 face each other and are sandwiched between halves of the base 2180.

In order to move the frames 2020 into an opened configuration and move the book 2010 into a first stage of expansion, the frames 2020 are pivoted about connecting hinge 2030, away from each other until substantially in planar alignment, as shown in FIG. 25. When in this opened configuration, the surface 2026 and first layers 2040 face upward, with the base 2180 located beneath. The frames 2020 appear as mirror images of each other at this stage.

Each of the first layer sections 2041 forms a third of upper surface of the associated frame 2020 when in the opened configuration of FIG. 25, and is dimensioned the same as the portion of continuous surface 2026. Each of the dividing lines 2032 that splits a first layer section 2041 into thirds bisects one of the sides 2014 of the book body 2012, giving each third layer section 2041 a seven sided third dodecagonal shape when in the folded configuration of FIG. 25.

Figure 26:
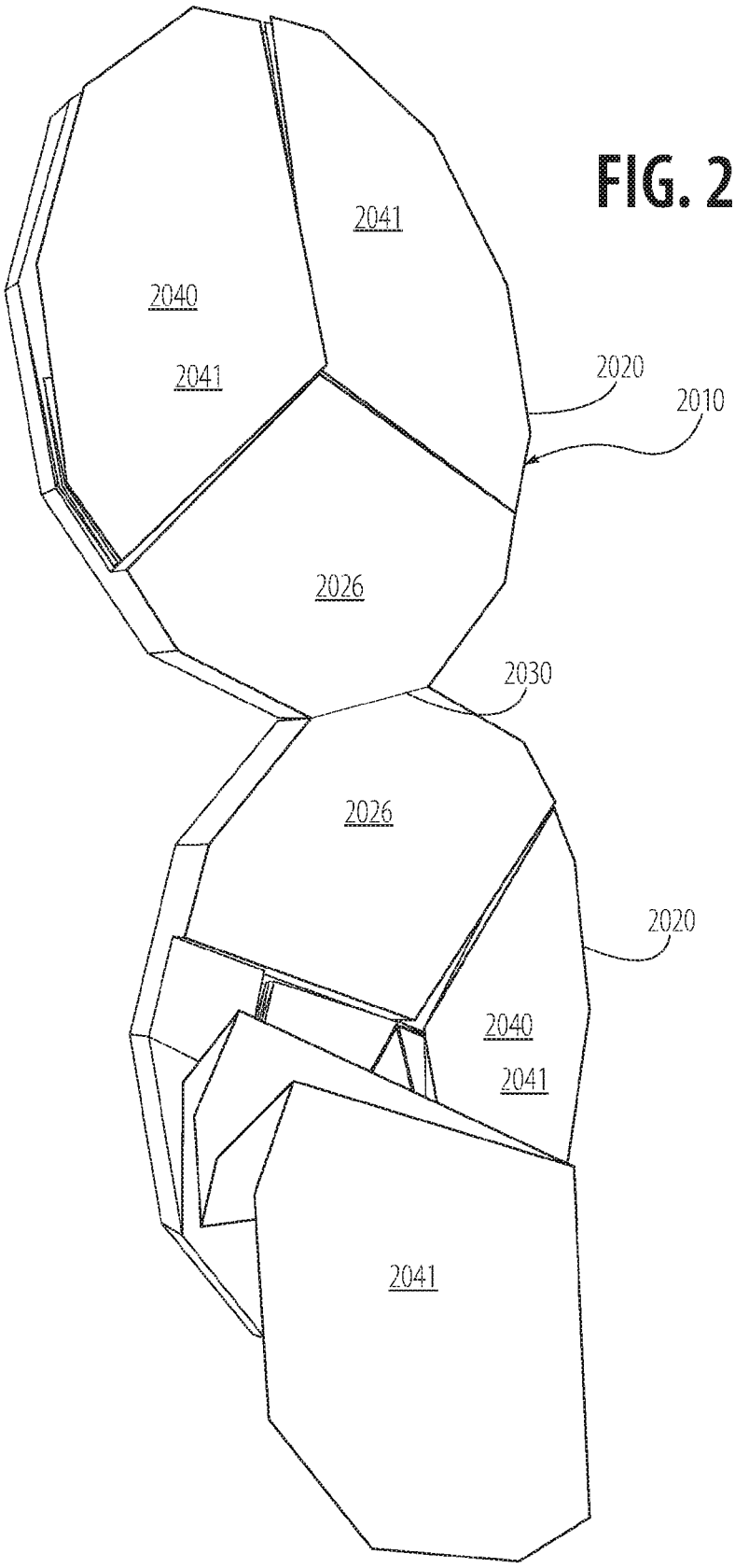
FIG. 26 is a perspective view of the folding book of FIG. 23, during unfolding of a first layer section.
Figure 27:
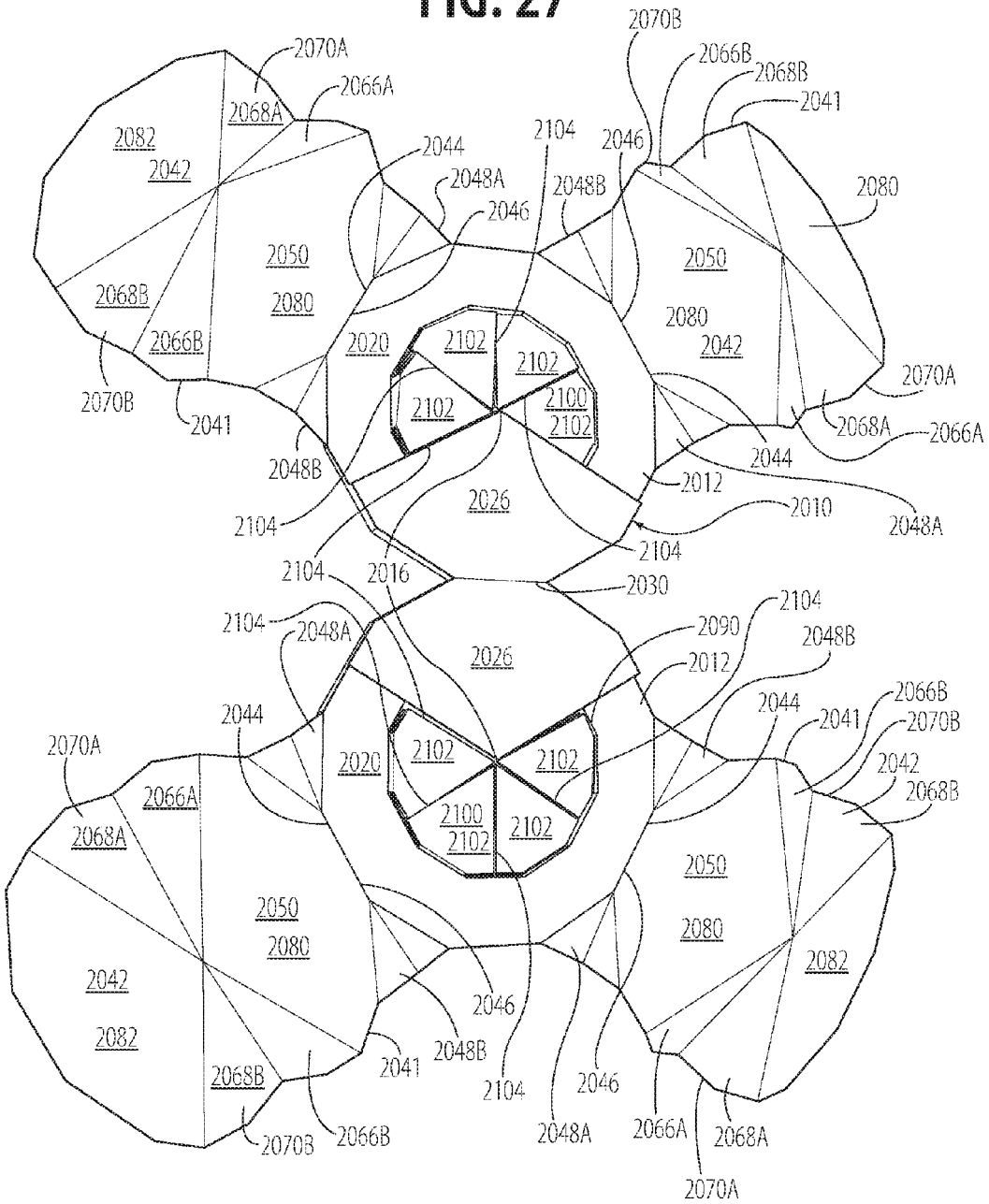
FIG. 27 is a perspective view of the folding book of FIG. 23, showing the first layer in an unfolded configuration.
Figure 27A:
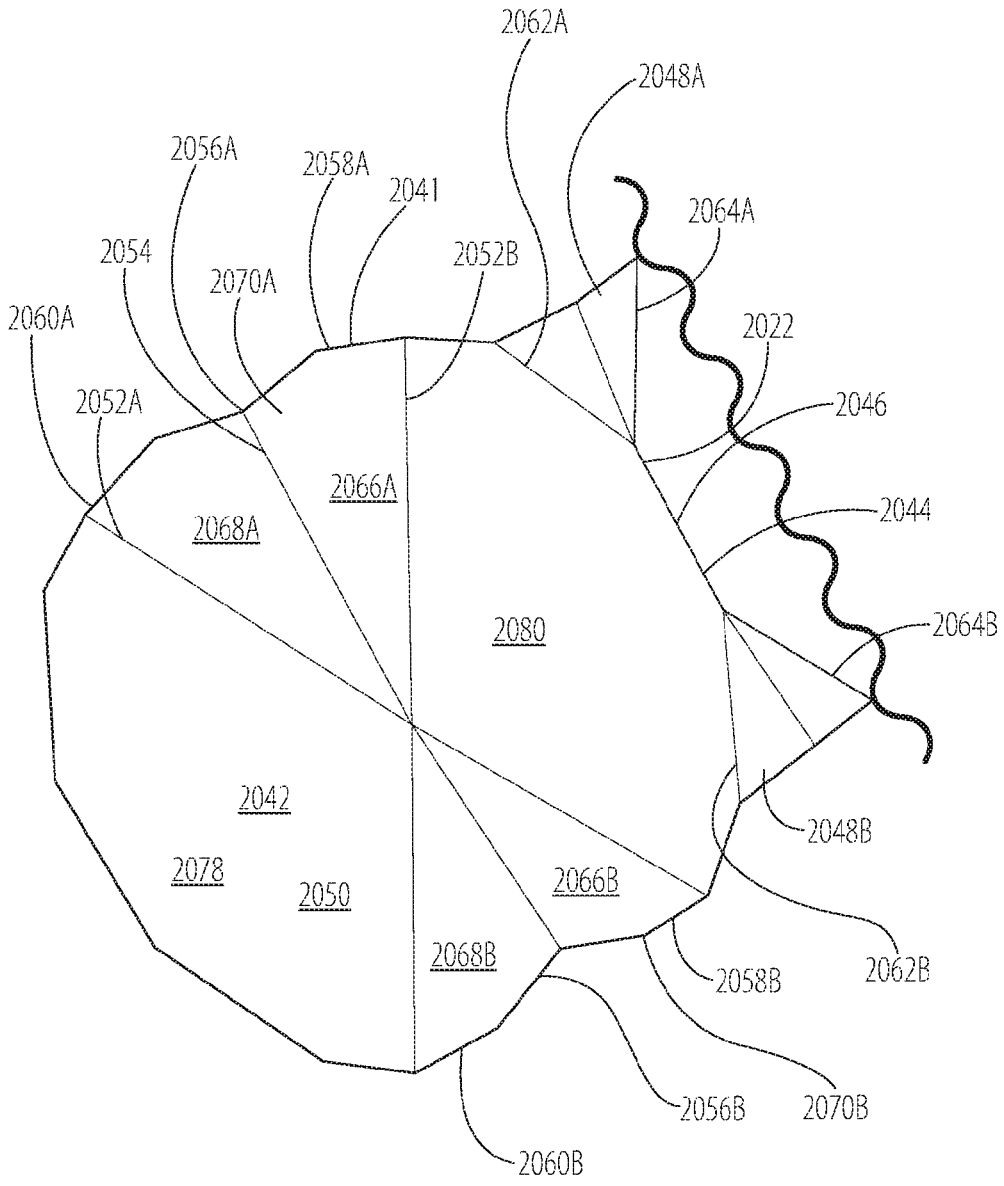
FIG. 27A is an enlarged detail of FIG. 27, showing just a first layer section.

Referring to FIGS. 25-27, the first layer sections 2041 and a second stage of expansion of the book 2010 will be described in detail. FIG. 27 shows each of the first layer sections 2041 in an expanded configuration. As shown, in this configuration, each first layer section 2041 extends radially outward from the center 2034 of its associated frame 2020 and includes a dodecagonal portion 2042, which may be sized and shaped the same as the folding book 2010 when in the folded configuration for example having a diameter of 8 inches, or either of the individual frames 2020 when in the unfolded configuration of FIG. 25. Each dodecagonal portion 2042 has an inner side 2044 joined with a side 2022 of the associated frame 2020. In particular, travelling around the perimeter of each frame 2020, every third side 2022 is an attachment side, having either the other frame 2020 affixed thereto about the connecting hinge 2030, or having a dodecagonal portion 2042 of one of the first layer sections 2041 affixed thereto about an attachment score 2046 formed between the frame 2020 and dodecagonal portion 2042 at the inner side 2044 thereof.

Each first layer section 2041 further includes first and second triangular shaped hinge portions 2048A, B, which extend between the dodecagonal portion 2042 and the first layer section 2041. The triangular hinge portions 2048A, B are shaped as isosceles triangles and the legs of each may be of lengths equal to the length of the sides 2014 of the book body 2014, for example, 2 inches.

Each first layer section 2041 moves from its folded configuration, shown in FIG. 25, to its unfolded configuration, shown in FIG. 27, to move the folding book 2010 to a second stage of expansion. Each first layer section 2041 has, in its unfolded configuration, an upper surface 2050 and a lower surface, and comprises a plurality of scores, each score being a linear crimp, fold line, or half cut, creating a predetermined fold pattern.

A transverse score 2054 bisects each dodecagonal portion 2042 in a direction perpendicular to the radial extension of the associated first layer section, 2041, extending between the two opposite sides of each dodecagonal portion 2042 that are parallel to the radial direction, referred to as radial sides 2056A, B. Attachment score 2046 continues through triangular hinge portions 2048A, B. Adjacent to each radial side 2056A, 2056B, is an inner adjacent side 2058A, B and an outer adjacent side 2060A, B. First and second diagonal scores 2052A, B extend between each inner adjacent side and the opposite outer adjacent side, dividing each dodecagonal portion into an inner third dodecagonal portion 2080, an outer third dodecagonal portion 2078, and first and second sixth dodecagonal portions 2070A, B, located on opposite sides of the dodecagonal portion 2042 between the inner third dodecagonal portion 2080 and outer third dodecagonal portion 2078. Each sixth dodecagonal portion 2070A, B is bisected into inner and outer portions 2066A, B, 2068A, B by transverse score 2054. An outer hinge portion score 2062A, B extends along the outer leg of each triangular hinge 2048, and an inner hinge portion score 2064A, B extends along the inner leg of each triangular hinge 2048A, B.

A valley is formed along the length of attachment score 2046 joining dodecagonal portion 2042 with book body 2012, and ridges are formed along the portions of attachment score 2046 extending into triangular hinge portions 2048. Valleys are formed along each of the inner hinge scores 2062A, B and outer hinge scores 2064A, B. A valley is further formed along the length of transverse score 2054 and ridges are formed along the length of diagonal scores 2052A, B.

Accordingly, when in the folded configuration of FIG. 25, the outer third dodecagonal portions 2078 overlap the body 2012, with a lower surface of each outer third dodecagonal portion 2078 facing the book body 2012 and the remaining portions of the first layer section folded and sandwiched in between. Specifically, inner third dodecagonal portion 2080, is folded inward about attachment score 2046, overlapping the book body 2012. Triangular hinge 2048 is folded outward about attachment score 2046, and housed between inner third dodecagonal portion 2080 and book body 2012. Inner portion 2066A of sixth dodecagonal portion 2070A is folded outward about diagonal score 2052B, overlapping inner third dodecagonal portion 2080. Outer portion 2068A of sixth dodecagonal portion 2070A is folded inward about transverse score 2054 and overlaps inner portion 2066. Outer third dodecagonal portion 2078 is folded outward about diagonal score 2052A and overlaps outer portion 2068A.

Similarly, on the opposite side of the first layer section 2041 inner third dodecagonal portion 2080, is folded inward about attachment score 2046, overlapping the book body 2012. Triangular hinge 2048B is folded outward about attachment score 2046, and housed between inner third dodecagonal portion 2080 and book body 2012. Inner portion 2066B of sixth dodecagonal portion 2070B is folded outward about diagonal score 2052B, overlapping inner third dodecagonal portion 2080. Outer portion 2068B of sixth dodecagonal portion 2070B is folded inward about transverse score 2054 and overlaps inner portion 2066B. Outer third dodecagonal portion 2078 is folded outward about diagonal score 2052B and overlaps outer portion 2068.

In order to move a first layer section 2042 from the folded configuration of FIG. 25, to the unfolded configuration of FIG. 27, and move the folding book 2012 into the third stage of expansion, outer third dodecagonal portion 2078 is griped and drawn radially outward, as shown in FIG. 26, away from the center 2034 of frame 2020, resulting in unhinging of the first layer section 2041 as described above and extension into the elongate shape of FIG. 27. Repeating this action for each of the first layer sections 2041 moves the first layer into the unfolded configuration and the folding book 2010 into the second stage of expansion, as shown in FIG. 27.

Figure 28:
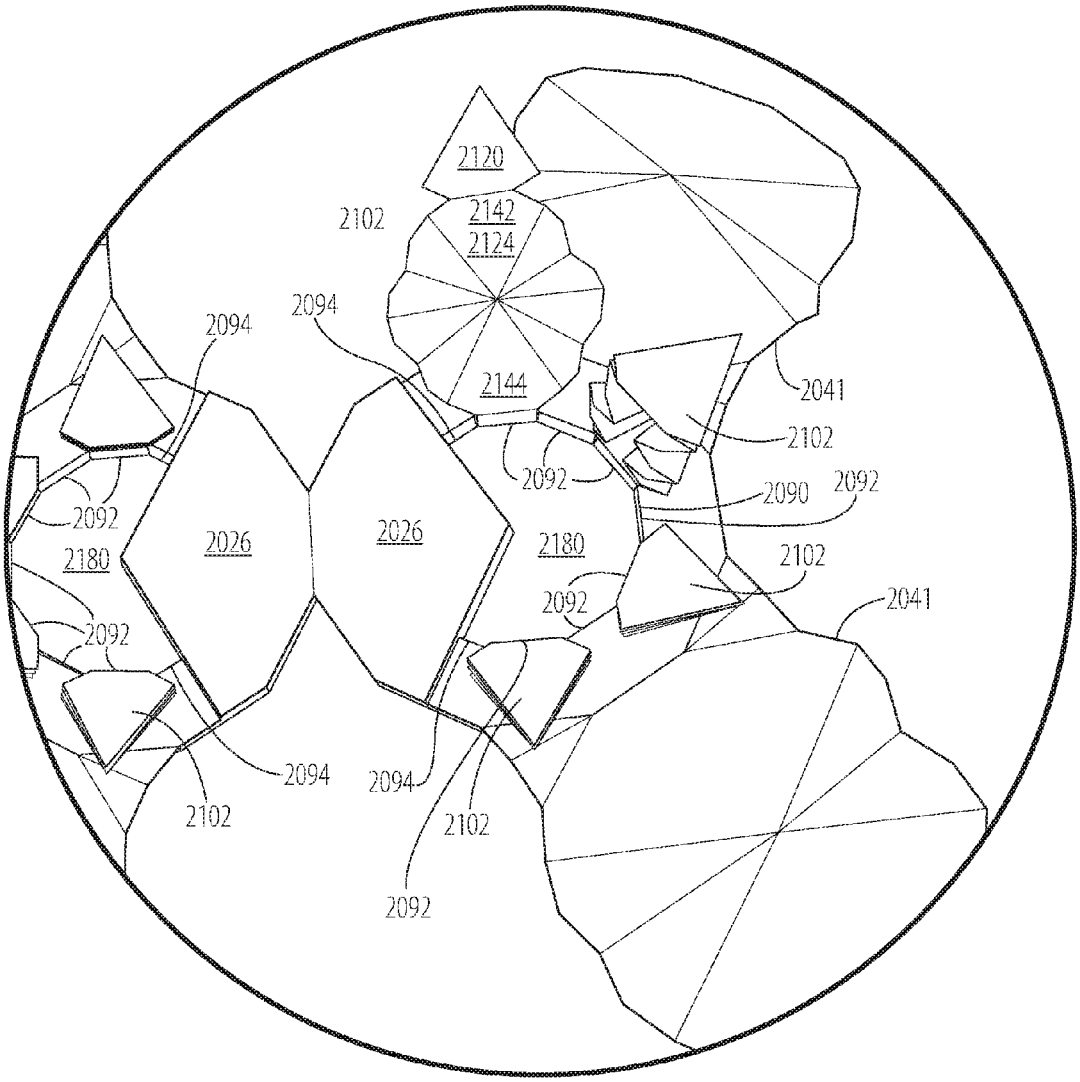
FIG. 28 is a detailed perspective view of the folding book of FIG. 23, showing the second layer in a partially unfolded configuration.
Figure 28A:
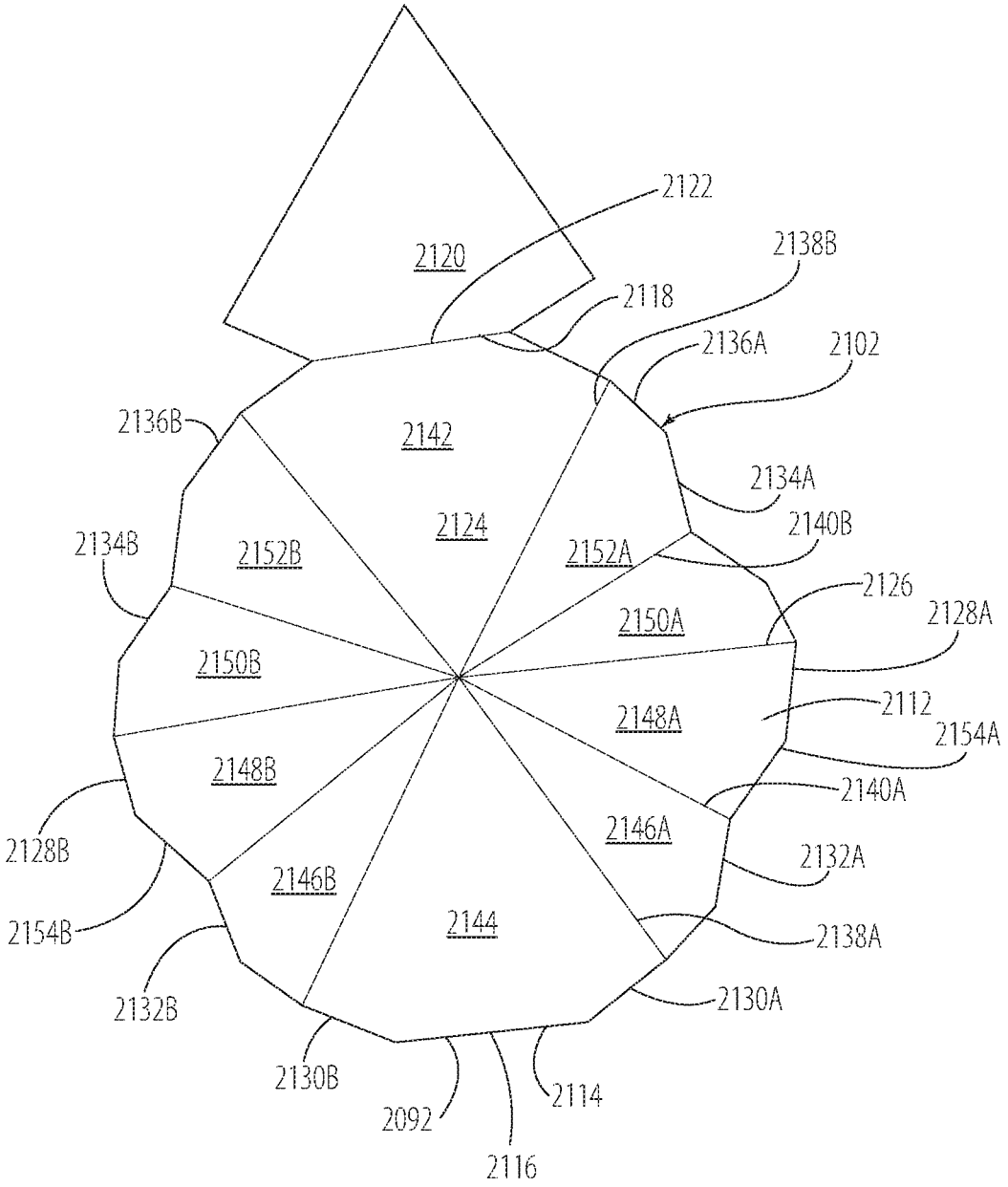
FIG. 28A is an enlarged detail of FIG. 28, showing just a second layer section.

Referring to FIGS. 27-29 the second layers 2100 and a third stage of expansion of the folding book 2010 is shown in detail. As shown in FIG. 27, each frame 2020 of the folding book body 2012 defines a cavity 2090 beneath the first layer 2040, which extends downward and terminates at the book base 2180. The cavity 2090 houses the second layer 2100 when in the folded condition, as shown in FIG. 27. The cavity 2090 is of a two thirds dodecagonal shape, formed by a dodecagon of which the remaining third is occupied by surface 2026. In one embodiment, the cavity has a diameter of 5 inches. The cavity 2090 has seven full dodecagonal sides 2092 and two half sides 2094, positioned in radial alignment with the six sides 2022 of the frame 2020. Eight vertices are formed between adjacent pairs of the sides 2092 or half sides 2094 and are positioned in radial alignment with vertices 2024 of the frame 2020.

Each second layer 2100 has a two thirds dodecagonal shape when in its folded configuration, which may be the same as the two thirds dodecagonal shape of the cavity 2090 in which the second layer 2100 is hosed when in the folded configuration. Each second layer 2100 includes four second layer sections 2102, each having a sixth dodecagonal shape. In particular, each second layer section is formed as if a dodecagon having sides dimensioned the same as those of the second layer 2100, were bisected by three evenly distributed bisecting lines, each bisecting a side of the dodecagon such that every other side is bisected. Each second layer section 2102, in its folded form has the shape of such a resulting sixth dodecagon, with opposite legs 2104 extending towards a vertex 2016 at the center of the second layer section 2100.

Each second layer section 2102 moves between the folded configuration of FIG. 27 and an unfolded configuration shown in FIG. 29. In the unfolded configuration each second layer section 2102 includes a dodecagonal portion 2112, which may have a diameter of 5 inches. Each dodecagonal portion 2112 includes an attachment side 2114 pivotally joined with a side 2092 of the cavity 2090 about an attachment score 2116. An outer side 2118 is located opposite attachment side 2118. Opposite radial sides 2128A, B extend perpendicularly to outer side 2118 and attachment side 2124. Inner diagonal sides 2130A, B extend from opposite edges of attachment side 2114, inner center diagonal sides 2132A, B extend between inner diagonal sides 2130 and radial sides 2128A, B, center outer diagonal sides 2134A, B extend outward from radial sides 2128A, B, and outer diagonal sides 2136A, B extend between center outer diagonal sides 2134A, B and outer side 2118. An extension 2120 having a sixth dodecagonal shape, which may have the same dimensions as the second layer section 2102 when in the folded configuration, is pivotally affixed to the outer side 2118 about an outer score 2122, and oriented with the vertex angle directed radially outward.

Each second layer section 2102, in the unfolded configuration, is formed as a strip extending radially away from the center 2034 of the frame 2020. Each second layer section 2102 moves from its folded configuration, shown in FIG. 27, to its unfolded configuration, shown in FIG. 29, to move the folding book 2010 to a third stage of expansion. Each second layer section 2102 has, in its unfolded configuration, an upper surface 2124 and a lower surface located opposite the upper surface, and comprises a plurality of scores, each score being a linear crimp, fold line, or half cut, creating a predetermined fold pattern.

A single transverse score 2126 is formed in each dodecagonal section 2112, extending between opposite radial sides 2128. First and second outer diagonal scores 2138A, B extend between opposing pairs of inner diagonal sides 2130A, B and outer diagonal sides 2136A, B, and first and second inner diagonal scores 2140A, B extend between opposing pairs of center outer diagonal sides 2134A, B and center inner diagonal sides 2132A, B.

The scores divide each dodecagonal portion 2112 into an outer sixth dodecagonal shaped portion 2142, and an inner sixth dodecagonal shaped portion 2144. Outer and inner sixth dodecagonal shaped portions 2142, 2144 meet at their respective vertices, and on each side of the dodecagon shaped portion 2112 are first twelfth dodecagonal portion 2146A, B, second twelfth dodecagonal portion 2148A, B, third twelfth dodecagonal portion 2150A, B and forth twelfth dodecagonal portion 2152A, B, which are arranged between the outer and inner sixth dodecagonal shaped portions 2142, 2144.

Valleys are formed along the length of outer score 2122, and inner diagonal scores 2140A, B. Ridges are formed along the length of attachment score 2116, transverse score 2126, and outer diagonal scores 2138A, B. The alternating valleys and ridges formed via scores result in a first triangular pleat 2154A extending along a first side of the dodecagonal portion 2112 and a second triangular pleat 2154B extending along a second side of the dodecagonal portion 2112.

Accordingly, when in the folded configuration of FIG. 27, extensions 2120 overlap the cavity 2090, with an upper surface of each extension folded downward and facing the book body 2012, and the folded dodecagonal portion 2112 sandwiched between the extension 2120 and the base 2180. Specifically, inner sixth dodecagonal portion 2144 is folded outward about attachment score 2116, overlapping the base 2180. First twelfth dodecagonal portion 2146A is folded outward about outer diagonal score 2138A, overlapping inner sixth dodecagonal portion 2144. Second twelfth dodecagonal portion 2148A is folded inward about inner diagonal score 2140A, overlapping first twelfth dodecagonal portion 2146A. Third twelfth dodecagonal portion 2150A is folded outward about transverse score 2126, overlapping second twelfth dodecagonal portion 2148A. Fourth twelfth dodecagonal portion 2152A is folded inward about inner diagonal score 2140B, overlapping third twelfth dodecagonal portion 2150A. Outer sixth dodecagonal portion 2142 is folded outward about outer diagonal score 2138B.

Similarly, on the opposite side of dodecagonal portion 2112, inner sixth dodecagonal portion 2144 is folded outward about attachment score 2116, overlapping the base 2180. First twelfth dodecagonal portion 2146B is folded outward about outer diagonal score 2138B, overlapping inner sixth dodecagonal portion 2144. Second twelfth dodecagonal portion 2148B is folded inward about inner diagonal score 2140B, overlapping first twelfth dodecagonal portion 2146B. Third twelfth dodecagonal portion 2150B is folded outward about transverse score 2126, overlapping second twelfth dodecagonal portion 2148. Fourth twelfth dodecagonal portion 2152 is folded inward about inner diagonal score 2140A, overlapping third twelfth dodecagonal portion 2150. Outer sixth dodecagonal portion 2142 is folded outward about outer diagonal score 2138A.

Extension is folded inward about outer score 2122 and overlaps both sides out outer sixth dodecagonal portion 2142.

In order to move a second layer section 2102 from the folded configuration of FIG. 27, to the unfolded configuration of FIG. 29, and move the folding book 2012 into the third stage of expansion and the fully expanded configuration, the vertex end of the extension 2120 is grasped and the extension 2120 is pivoted about outer score 2122 in an upward and radially outward direction of the frame 2020. The extension 2120 is then drawn radially outward, resulting in unhinging of the second layer section 2102, as shown in FIG. 28, about the triangular pleats 2154A, B, and extension into the elongate shape shown in FIG. 29. Repeating this action for each of the second layer sections 2102 moves the second layer 2100 into the unfolded configuration, and the folding book 2010 into the fully expanded configuration as shown in FIG. 29.

A fourth embodiment of a folding book 1010 is shown in FIGS. 30-42.

Figure 30:
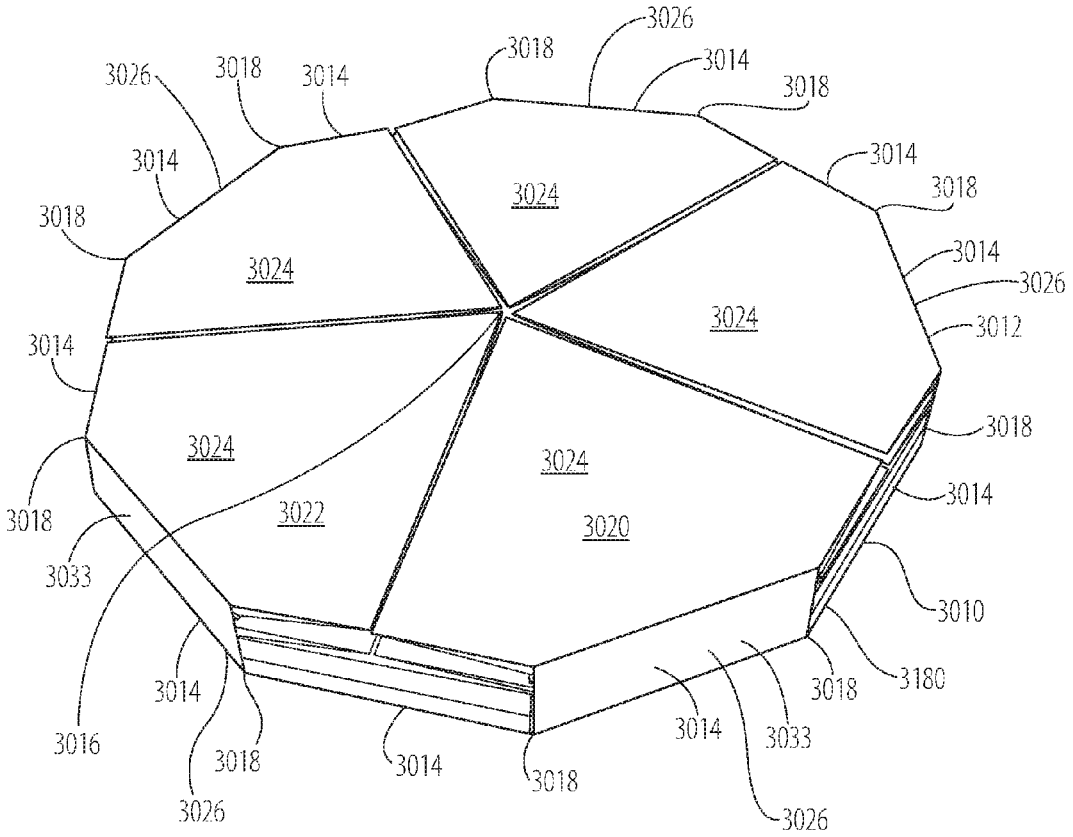
FIG. 30 is a perspective view of a fourth embodiment of a folding book, in a collapsed configuration.
Figure 42:
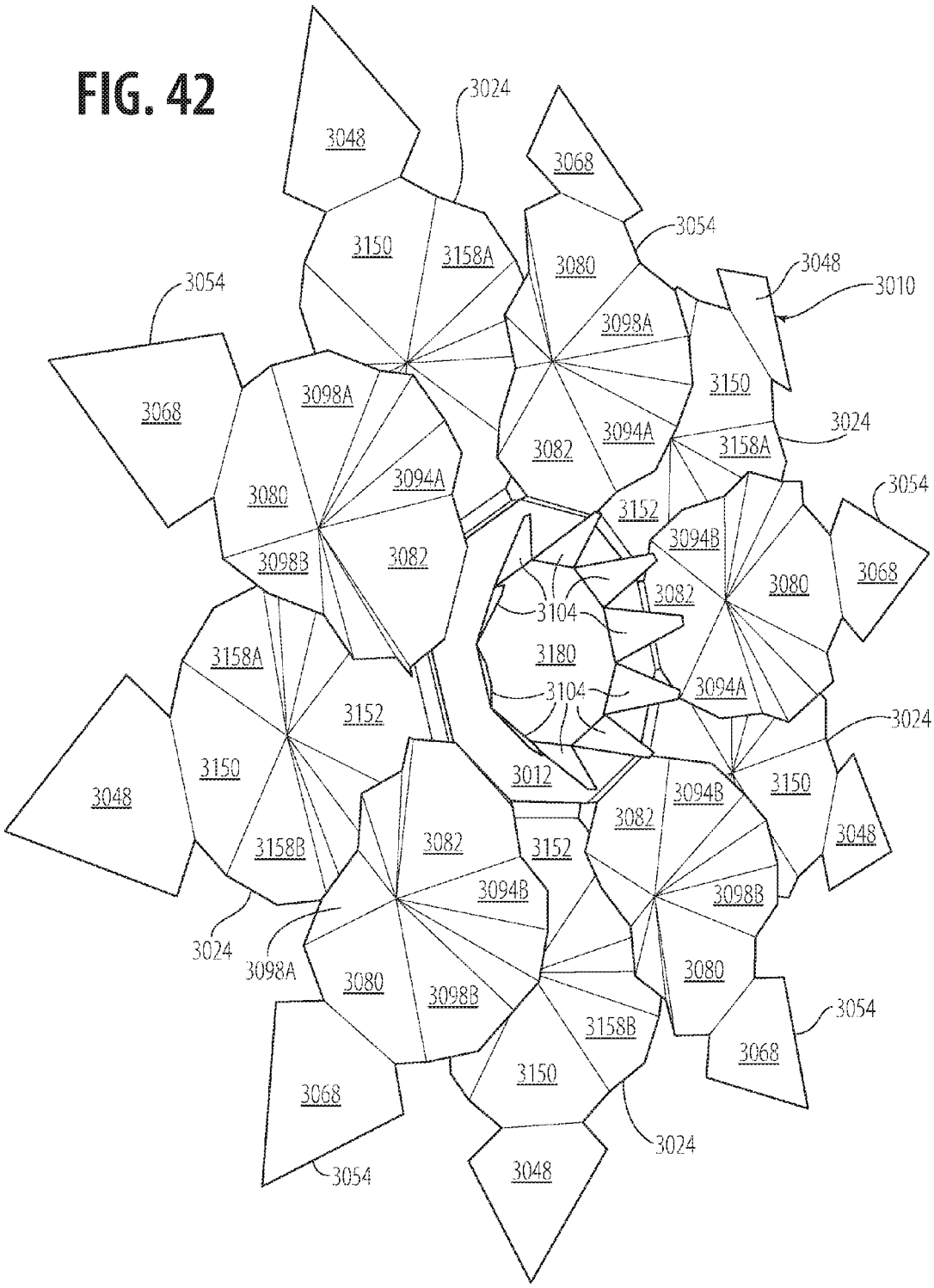
FIG. 42 is a perspective view of the folding book of FIG. 30, in a fully expanded configuration.

The folding book 3010 moves between a collapsed configuration, shown in FIG. 30, and an expanded configuration, shown in FIG. 42. As shown, the folding book 3010 comprises an decagonal body 3012 having a stacked three layer construction including a first or top layer 3020, a second layer 3050 located just beneath the first layer 3020, and a third layer 3100 located just beneath the second layer 3050. A book base 3180 is located beneath the third layer 3100.

Each layer moves between a folded and an unfolded configuration in a selected order, to move the folding book 3010 from the collapsed configuration to the expanded configuration, as described in detail below. Each layer includes a plurality of layer sections, and each of the layer sections individually moves between a folded configuration and an unfolded configuration, to move the layer between the folded configuration and the unfolded configuration, as described in further detail below.

As shown in FIG. 30, the decagonal body 3012 includes a center 3016 and ten sides 3014 extending between ten vertices 3018. In one embodiment, the decagonal body 3012 has a diameter of 8 inches, but the dimensions may vary depending on desired use and appearance of the folding book 3010.

Referring to FIGS. 30-36, the first layer 3020 and a first stage of expansion of the folding book 3010 is shown in detail. As shown, the first layer 3020, in the folded configuration of FIG. 30, has a decagonal shape and a top surface 3022 forming a top surface of the folding book 3010.

The first layer 3020 is formed of five identical first layer sections 3024. Each first layer section 3024 moves between a folded configuration, shown in FIG. 30, and an unfolded configuration, shown in FIG. 36. As shown, in the folded configuration, each first layer section 3024 is shaped as a fifth of a decagon. In particular, each first layer 3024 section is formed as if a decagon having sides dimensioned the same as those of the first layer 3020, were divided in five by five evenly radially distributed lines, each extending between the center 3016 and the midpoint of a side 3014.

When in the folded configuration, the first layer sections 3024 fit together to form a decagonal shape that may be similarly sized to the decagonal shape of the folding book body 3012, as shown in FIG. 30.

As shown, each first layer section 3024 is attached to the base 3018 by an attachment strip 3033. The attachment strip 3033 may extend between an outer edge of the base 3180 and the attachment side 3026 of each first layer section 3024, joining the first layer sections to the base 3180 such that in the folded configuration of FIG. 30, the attachment strips 3033 form side walls of the book body 3012, with each of the second 3050 and third 3110 layers in their folded configurations housed within.

Figure 31:
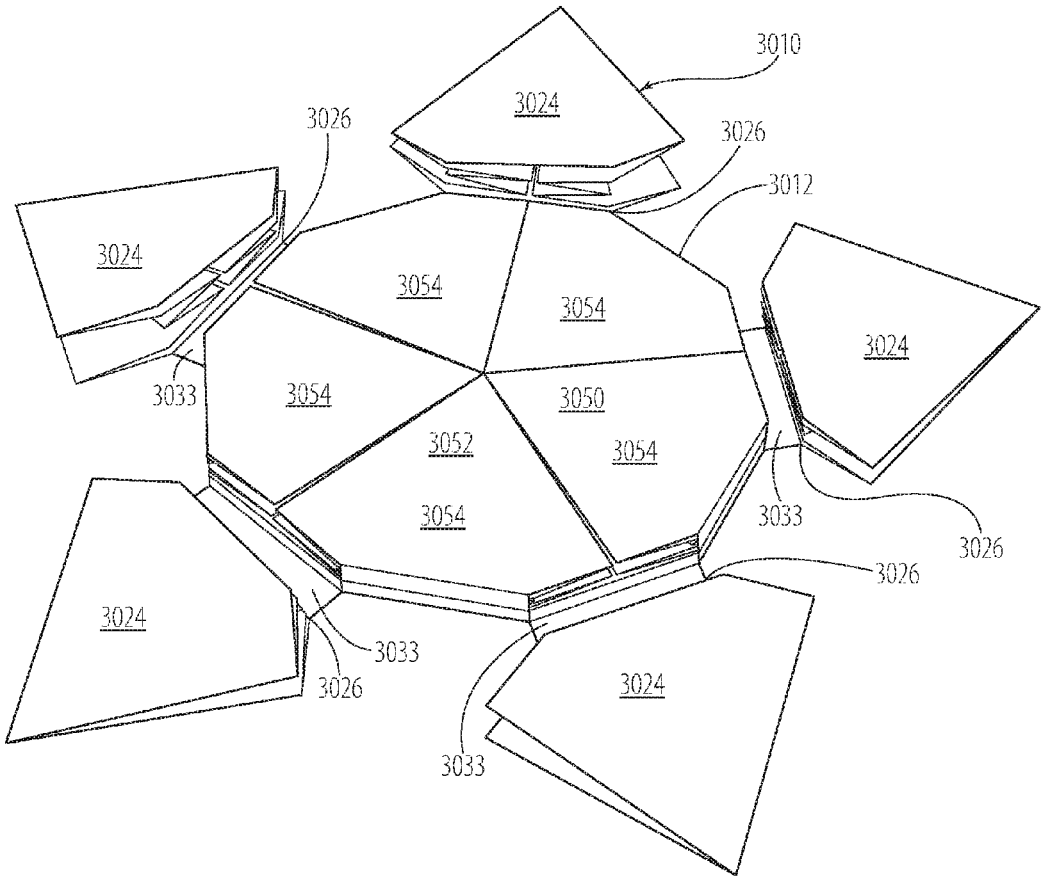
FIG. 31 is a perspective view of the folding book of FIG. 30, showing the first layer in a partially unfolded configuration.
Figure 32:
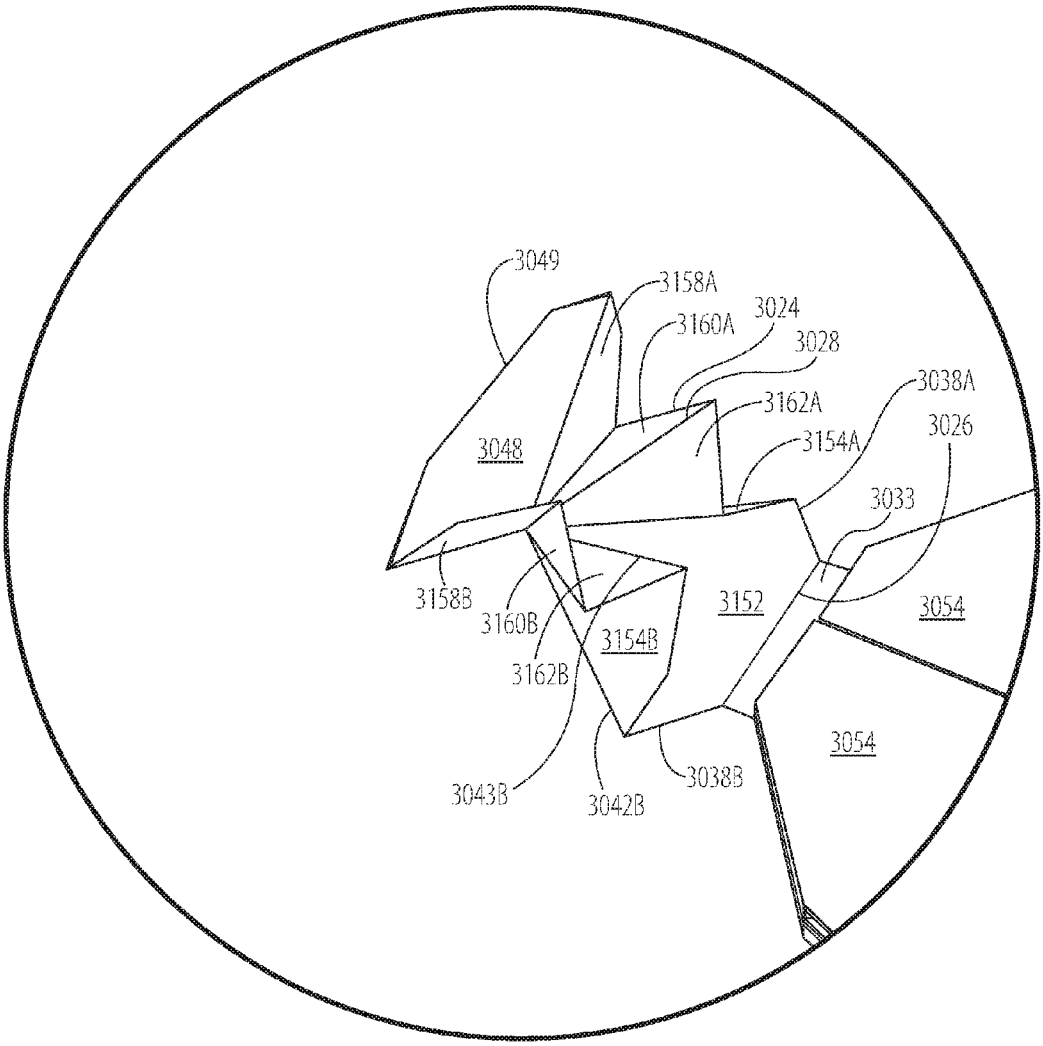
FIG. 32 is a detailed perspective view of the folding book of FIG. 30, showing a first layer section during unfolding.
Figure 33:
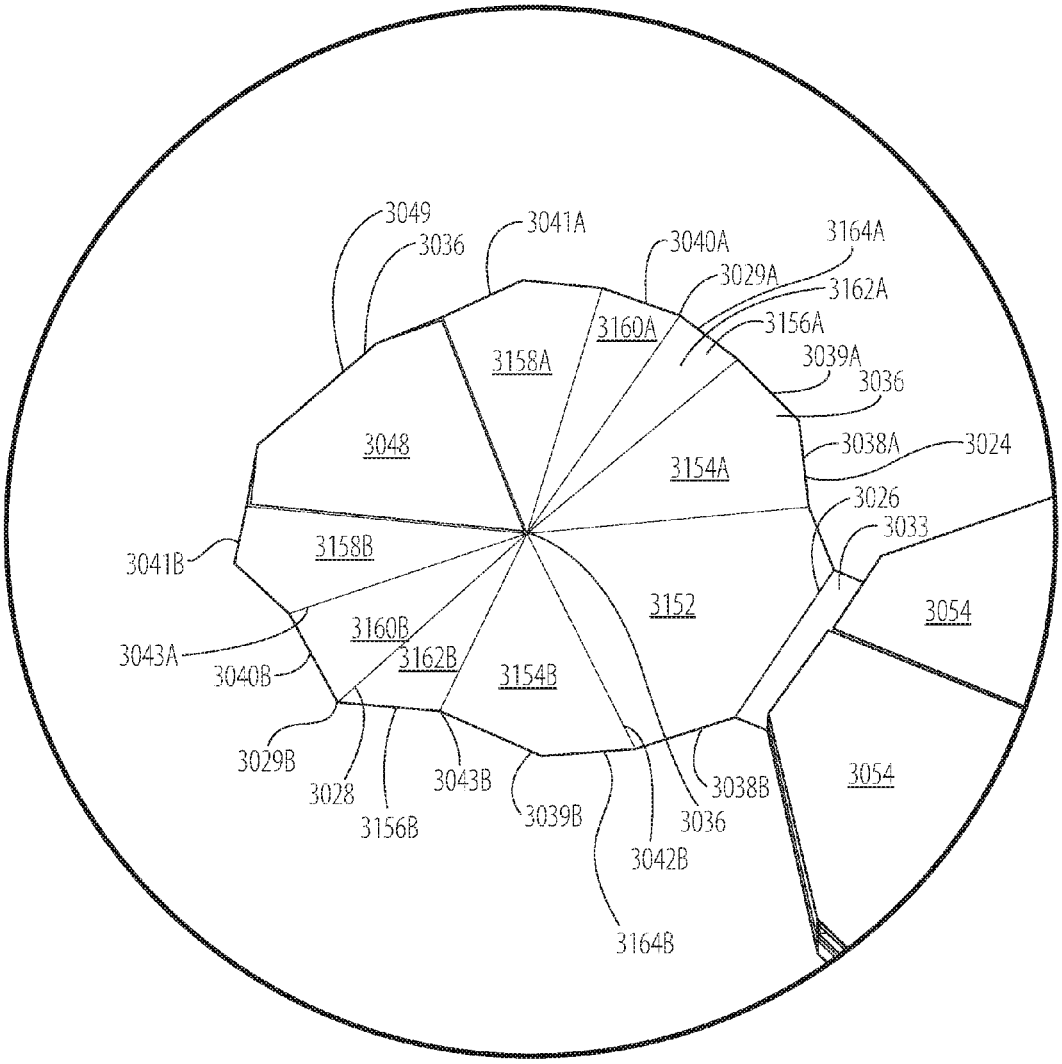
FIG. 33 is a detailed perspective view of the folding book of FIG. 30, showing a first layer section in a subsequent stage of unfolding to that shown in FIG. 32.

To begin moving the first layer 3024 from the folded configuration to the unfolded configuration, each section 3024 is first pivoted outward from the center 3016 of the book body 3012 about the attachment side 3026, as shown in FIG. 31. This is repeated for each first layer section 3024, until all have been pivoted to the positions shown in FIG. 31.

Figure 35:
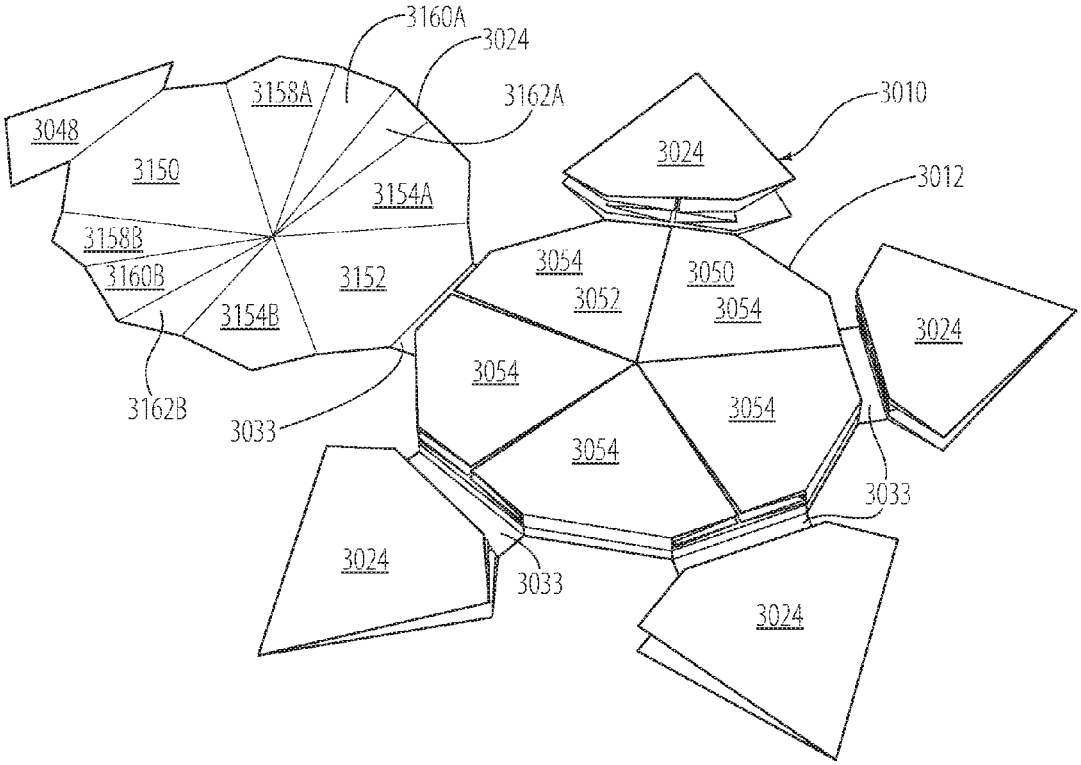
FIG. 35 is a perspective view of the folding book of FIG. 30, showing a first layer section in an unfolded configuration.
Figure 35A:
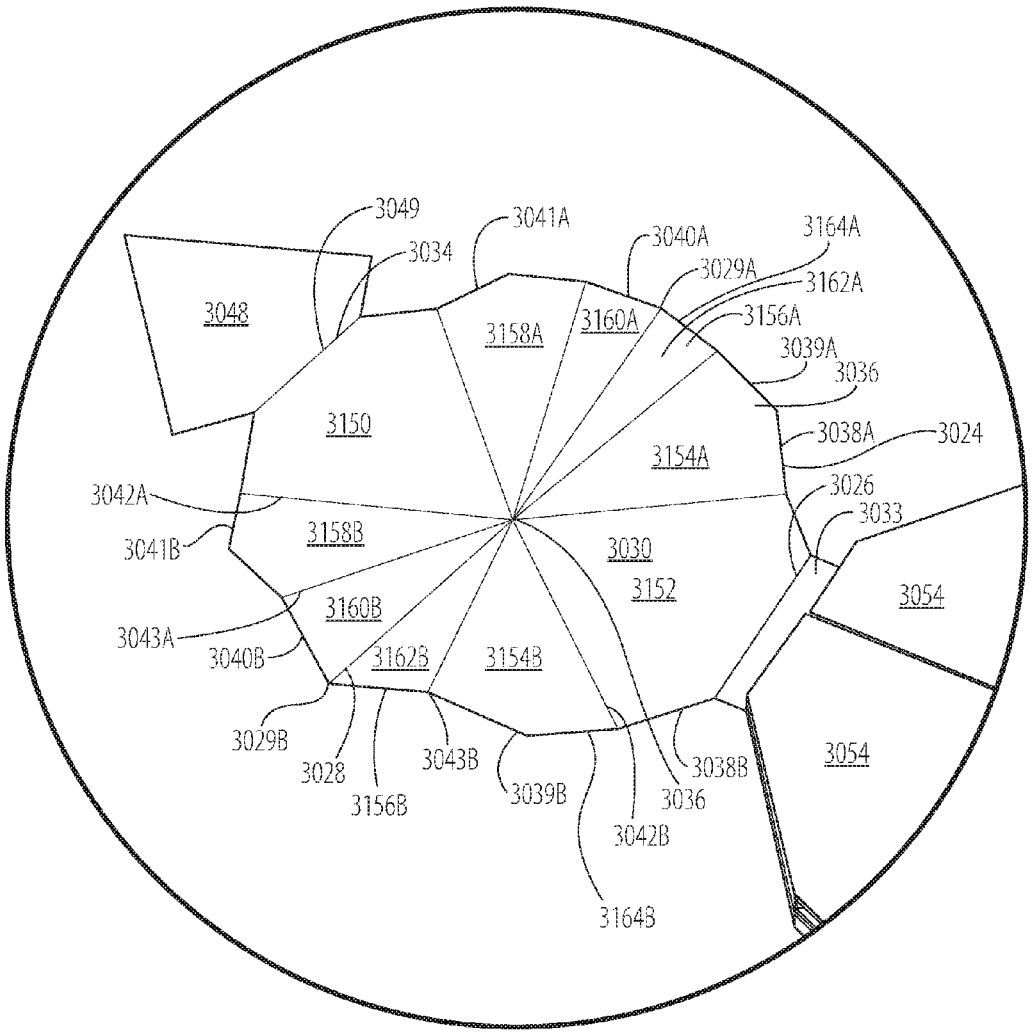
FIG. 35A is an enlarged detail of FIG. 35, showing just the unfolded first layer section.
Figure 36:
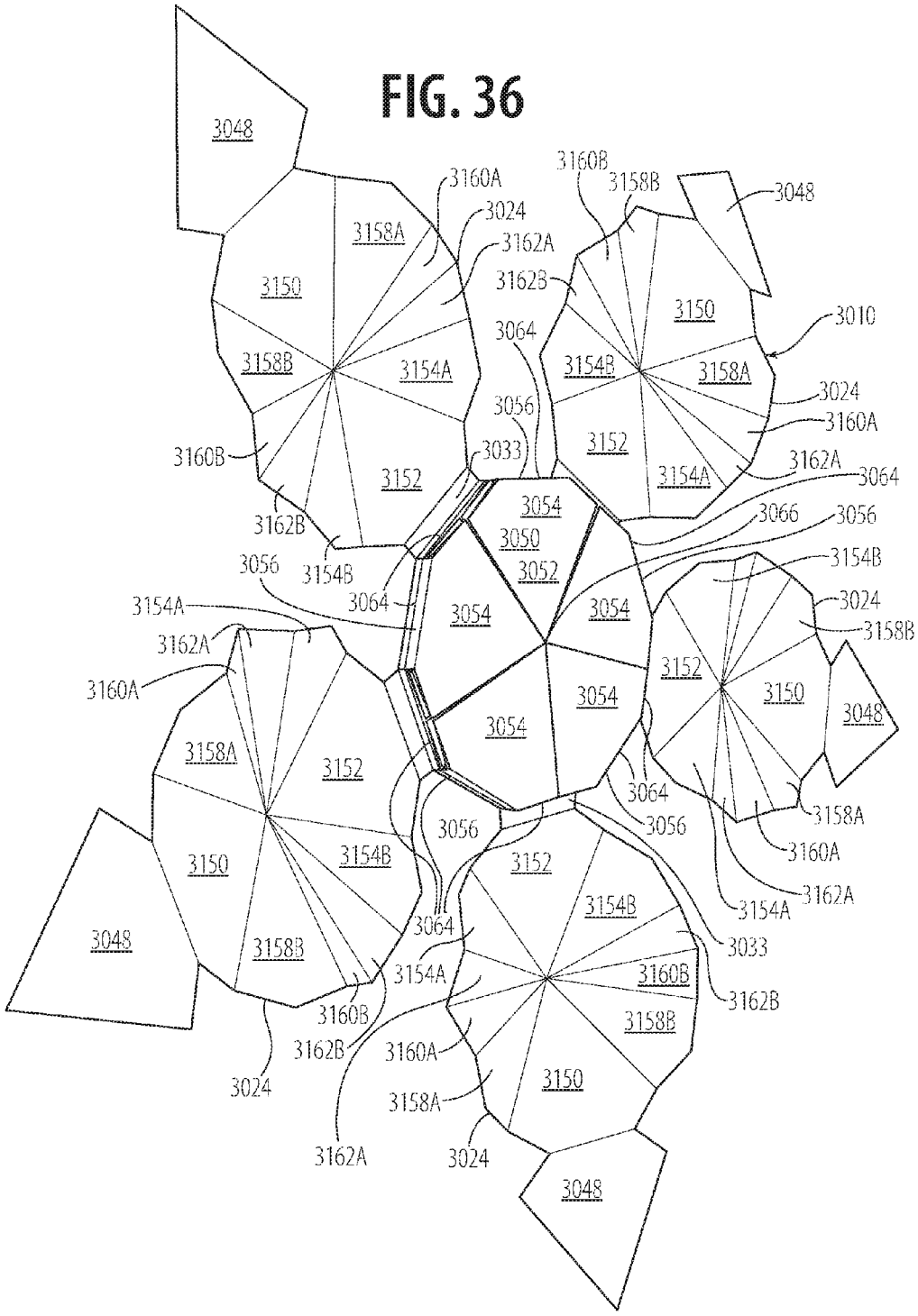
FIG. 36 is a perspective view of the folding book of FIG. 30, showing the first layer in an unfolded configuration.

In the unfolded configuration, as shown in FIGS. 35, 35A and 36, each first layer section 3024 includes an decagonal portion 3036, which may be dimensioned the same as the decagonal body 3012, for example having a diameter of 8 inches. Each decagonal portion has an attachment side 3026 attached to attachment strip 3033 and an outer side 3034 located opposite the attachment side 3026. First inner radial sides 3038A, B extend outward from attachment side 3026, second inner radial sides 3039A, B extend outward from each first inner radial side 3038A, B, first outer radial sides 3040A, B extend outward from each second inner radial side 3039A, B and second outer radial sides 3041A, B extend between each first outer radial side 3040A, B and outer side 3034.

Each first layer section 3024 further includes a fifth decagonal extension 3048 that extends radially outward from the outer side 3034. As shown in FIG. 35A, each extension 3048 may be shaped and dimensioned the same as an individual first layer section 3024 when in the folded configuration, and includes an inner radial side pivotally joined with outer side 3034 of decagonal portion 3036.

Each first layer section 3024 moves from its folded configuration, shown in FIG. 31, to its unfolded configuration, shown in FIGS. 35, 35A and 36, to fully move the first layer 3020 from the folded configuration to the unfolded configuration and move the folding book 3010 into a first stage of expansion. Each first layer section 3024 has, in its unfolded configuration, an upper surface 3030 and a lower surface opposite the upper surface, and comprises a plurality of scores, each score being a linear crimp, fold line, or half cut, creating a predetermined fold pattern and enabling the first layer section 3024 to be accurately folded, unfolded and refolded repeatedly along the same line.

As shown in FIG. 35A, an extension score 3049 is formed along the outer side 3034, between the extension 3048 and the adjacent decagonal portion 3036. Two outer diagonal scores 3042A, B are formed in each first layer section 3024, each extending between opposing first inner radial sides 3038A, B and second outer radial sides 3041A, B to bisect the decagonal shape of the decagonal portion 3036. Two inner diagonal scores 3043A, B are formed in each are formed in each first layer section 3024, each extending between opposing first outer radial sides 3040A, B and second inner radial sides 3039A, B to bisect the decagonal shape of the first decagonal portion 3036. A single transverse score 3028 extends across the width of the decagonal portion 3036, between opposite side vertices 3029A, B. The scores 3028, 3042A, B, 3043A, B intersect at the center 3046 of each decagonal portion 3036. The scores divide each decagonal portion 3036 into an outer fifth decagonal portion 3150, an inner fifth decagonal portion 3152, with first 3154A, B, second 3156A, B and third 3158A, B tenth decagonal portions arranged in between along each side of the decagonal portion 3036. Transverse score 3028 splits second tenth decagonal portions 3056A, B each into inner 3162A, B and outer 3160A, B halves.

A valley, or downwardly extending fold line, is formed along the length of transverse score 3028, extension score 3049 and each outer diagonal score 3042A, B. A ridge, or upwardly extending fold line is formed along the length of each inner diagonal score 3043A, 3043B. The alternating valleys and ridges formed via transverse score 3028, inner diagonal scores 3043A, B and outer diagonal scores 3042A, B result in a first radial pleat 3164A extending along a first side of each first layer section 3024 and a second radial pleat 3164B extending along a second side of each first layer section 3024.

When in the folded configuration of FIG. 30, the inner fifth decagonal portion 3152 forms an upper surface of the body 3012, with the remaining portions of each first layer section 3024, as well as second 3050 and third layers 3100 folded and sandwiched between the base 3180 and inner fifth decagonal portion 3152. Specifically, first tenth decagonal portion 3154A is folded inward about outer diagonal score 3042A, overlapping inner fifth decagonal portion 3152, inner half 3162A is folded outward about inner diagonal score 3043A, overlapping first tenth decagonal portion 3154A, outer half 3160A is folded inward about transverse score 3028, overlapping inner half 3162A, third tenth decagonal portion 3158A is folded outward about inner diagonal score 3043B, overlapping outer half 3160A, and outer fifth decagonal portion 3150 is folded inward about outer diagonal score 3042B, overlapping third tenth decagonal portion 3158A.

Similarly, on the opposite side of the first layer section 3024, first tenth decagonal portion 3154B is folded inward about outer diagonal score 3042B, overlapping inner fifth decagonal portion 3152, inner half 3162B is folded outward about inner diagonal score 3043B, overlapping first tenth decagonal portion 3154B, outer half 3160B is folded inward about transverse score 3028, overlapping inner half 3162B, third tenth decagonal portion 3158B is folded outward about inner diagonal score 3043A, overlapping outer half 3160B, and outer fifth decagonal portion 3150 is folded inward about outer diagonal score 3042A, overlapping third tenth decagonal portion 3158B.

Extension 3048 is folded inward about extension score 3048, and is housed between outer fifth decagonal portion 3150 and third tenth decagonal portions 3158A, B when the first layer section 3024 is in the folded configuration.

Figure 34:
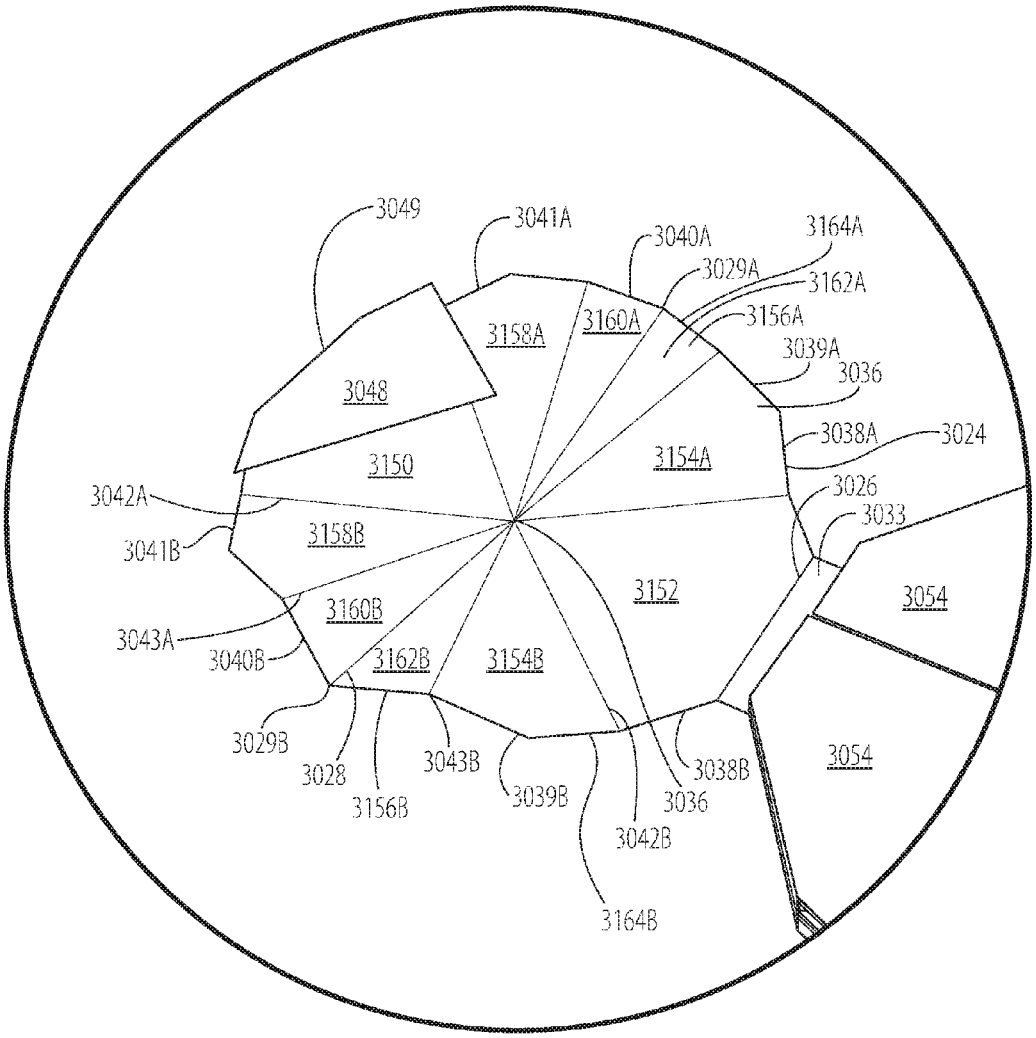
FIG. 34 is a detailed perspective view of the folding book of FIG. 30, showing a first layer section in a subsequent stage of unfolding to that shown in FIG. 33.

In order to move a first layer section 3024 from the folded configuration of FIG. 30, to the unfolded configuration, and move the folding book 3010 into a first stage of expansion, as shown in FIG. 36, outer fifth decagonal portion 3150 is gripped and pivoted outward away from the center 3016 of the folding book body 3012 and attachment side 3026. This action results in unfolding of radial pleats 164A, B, as shown in FIGS. 32-35 and expansion of the first layer section 3024 from the folded configuration of FIG. 30 to the configuration shown in FIG. 33. Extension 3048 is then pivoted outward about extension score 3049, as shown in FIG. 34, to move the first layer section 3024 to the configuration of FIGS. 35 and 35A. Repeating this action for each of the first layer sections 3024 moves the first layer 3020 into the unfolded configuration, and the folding book 3010 into the first stage of expansion, as shown in FIG. 36. As shown, each expanded first layer section 3024 is located adjacent to an associated side 3014 of the body 3012 and attached to the base 3018 by the attachment strip 3033.

Referring to FIGS. 36-40 the second layer 3050 and a second stage of expansion of the folding book 3010 is shown in detail. As shown, the second layer 3050 has a similar construction to the first layer 3020, with a decagonal shape and a top surface 3052, which forms a top surface of the book body 3012 following the first stage of expansion and before the second stage of expansion.

As shown in FIG. 36, in the folded configuration, each second layer section 3054 is shaped as a fifth of a decagon. In particular, each second layer section 3054 is formed as if a decagon having sides dimensioned the same as those of the second layer 3050, were divided in five by five evenly radially distributed lines, each extending between the center 3066 and the midpoint of a side 3064.

An attachment side 3056 of each second layer section 3054 lies on an outer edge and forms a portion of a side 3014 of the folding book body 3012 when the second layer 3050 is in the folded configuration. As shown, the attachment sides 3056 are adjacent to alternating sides 3014 of the book body 3014, and are misaligned with the first layer sections 3024, such that the second layer sections 3054 are positioned between adjacent first layer sections 3024 when in the expanded configuration of FIG. 40.

Figure 37:
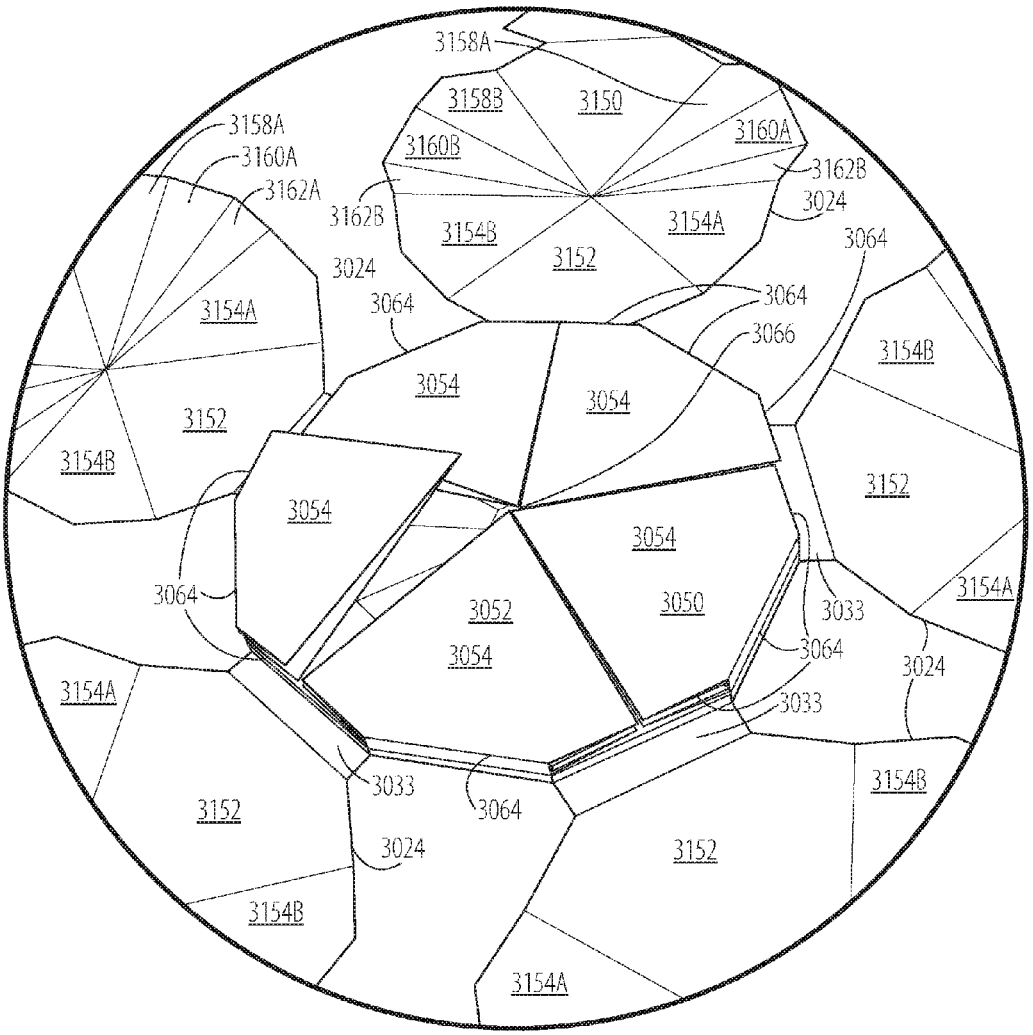
FIG. 37 is a detailed perspective view of the folding book of FIG. 30, showing the second layer during unfolding.
Figure 38:
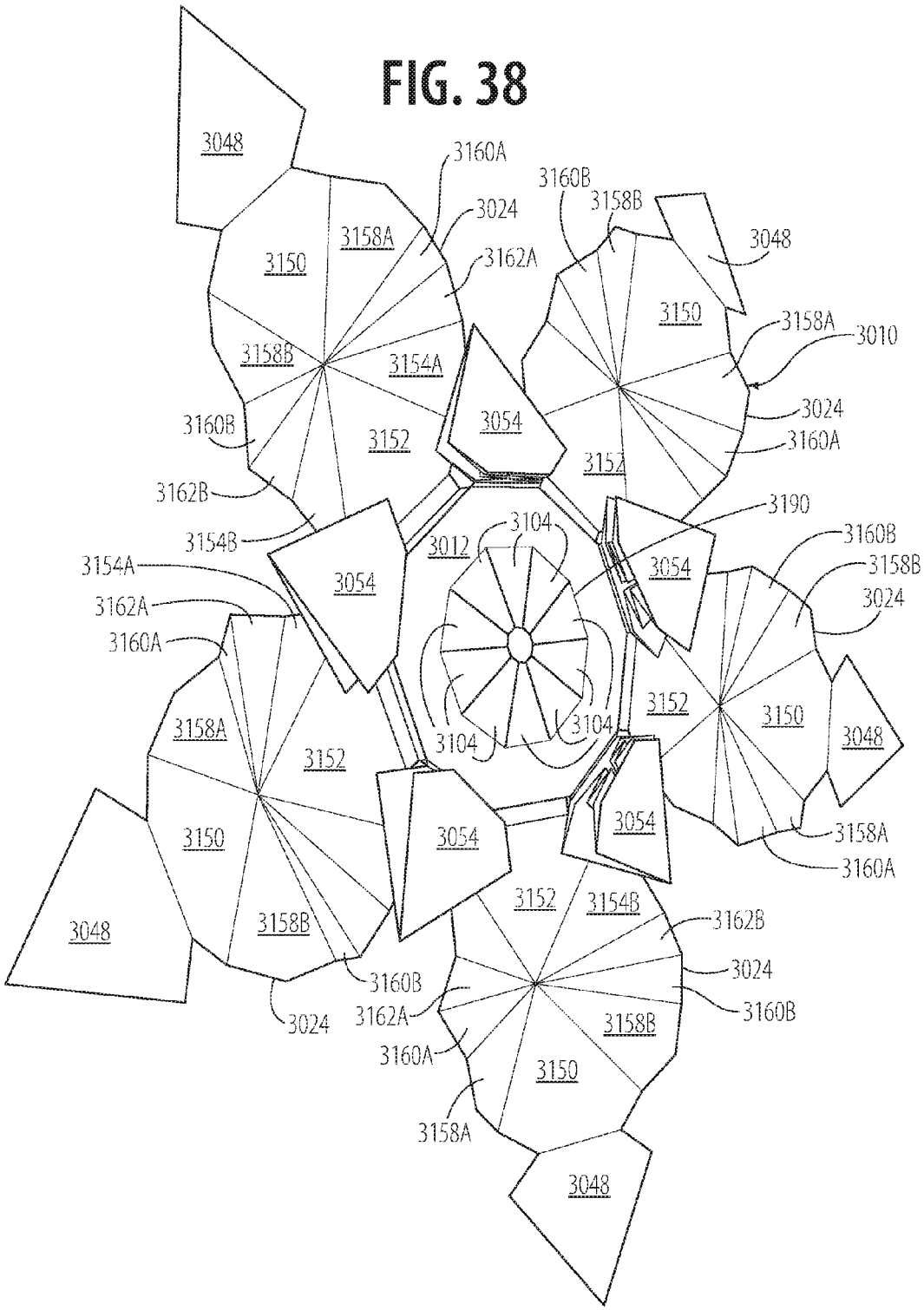
FIG. 38 is a perspective view of the folding book of FIG. 30, showing the second layer in a partially unfolded configuration.

To begin moving the second layer 3050 from the folded configuration to the unfolded configuration, each section 3054 is first pivoted outward from the center 3066 about the attachment side 3056, as shown in FIGS. 37 and 38. This is repeated for each second layer section 3054, until all have been pivoted to the positions shown in FIG. 38.

Figure 40:
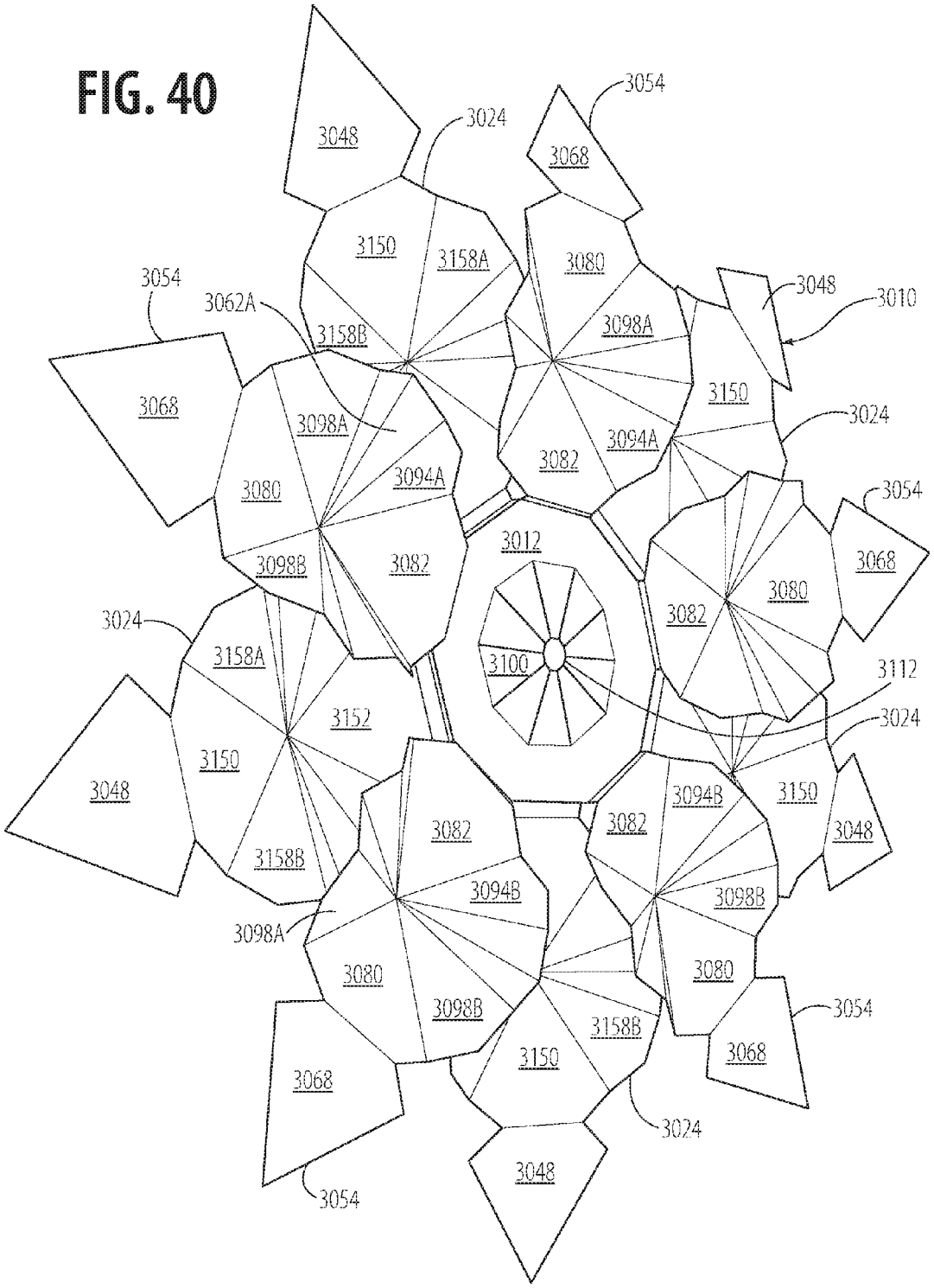
FIG. 40 is a perspective view of the folding book of FIG. 30, showing the second layer in an unfolded configuration.
Figure 40A:
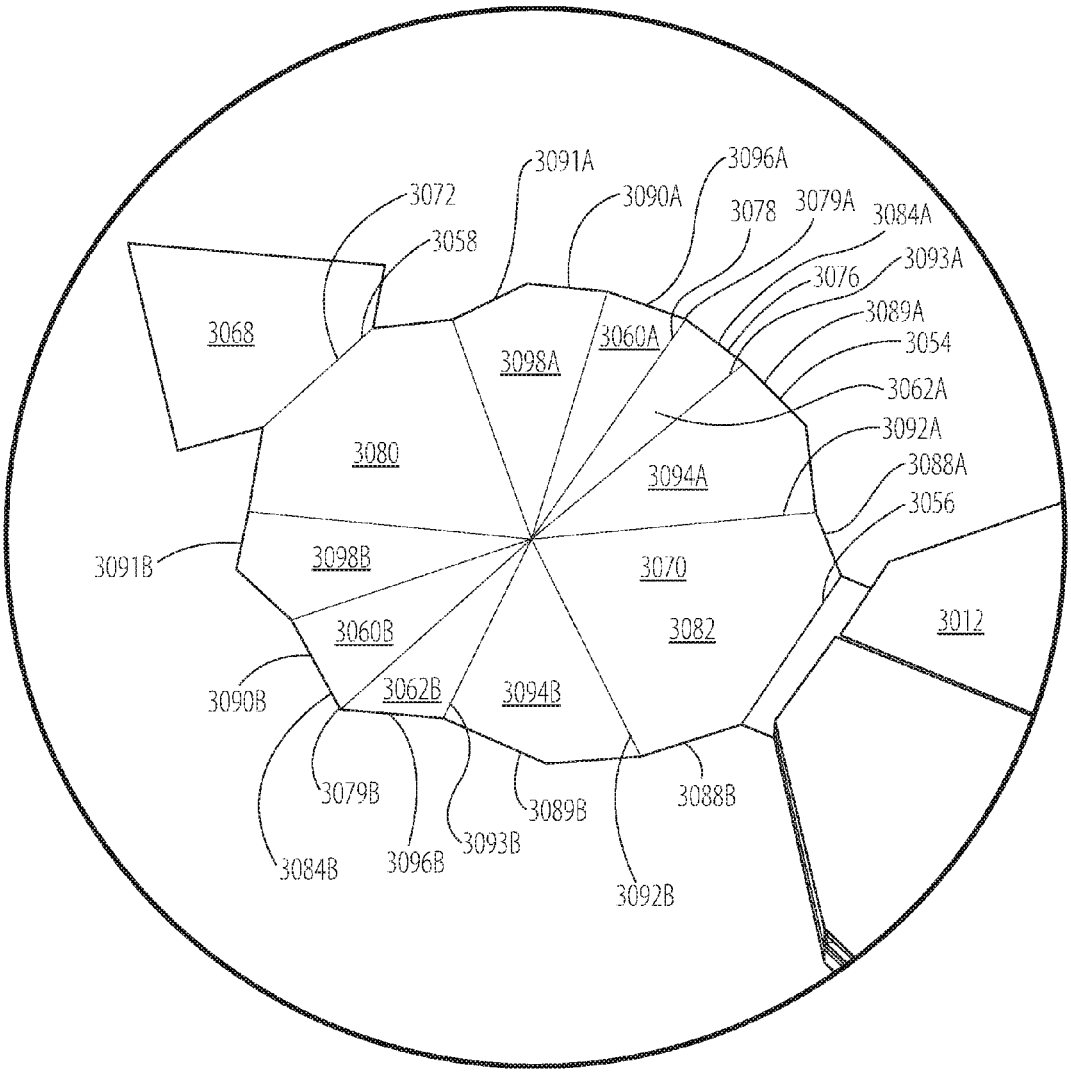
FIG. 40A is an enlarged detail of FIG. 40, showing just a second layer section.

In the unfolded configuration, as shown in FIGS. 40 and 40A, each second layer section 3054 includes an decagonal portion 3076, which may be dimensioned the same as the decagonal body 3012, for example having a diameter of 8 inches. Each decagonal portion 3076 has an attachment side 3056 and an outer side 3058 located opposite the attachment side 3056. First inner radial sides 3088A, B extend outward from attachment side 3056, second inner radial sides 3089A, B extend outward from each first inner radial side 3088A, B, first outer radial sides 3090A, B extend outward from each second inner radial side 3089A, B and second outer radial sides 3091A, B extend between each first outer radial side 3090A, B and outer side 3058.

Each second layer section 3054 further includes a fifth decagonal extension 3068 that extends radially outward from the outer side 3058. As shown in FIGS. 40 and 40A, each extension 3068 may be shaped and dimensioned the same as an individual second layer section 3054 when in the folded configuration, and includes an inner radial side pivotally joined with outer side 3058 of decagonal portion 3076.

Each second layer section 3054 moves from its folded configuration, shown in FIG. 36, to its unfolded configuration, shown in FIGS. 40 and 40A, to fully move the second layer 3050 from the folded configuration to the unfolded configuration and move the folding book 3010 into a second stage of expansion. Each second layer section 3054 has, in its unfolded configuration, an upper surface 3070 and a lower surface opposite the upper surface, and comprises a plurality of scores, each score being a linear crimp, fold line, or half cut, creating a predetermined fold pattern and enabling the second layer section 3054 to be accurately folded, unfolded and refolded repeatedly along the same line.

As shown in FIG. 40A, an extension score 3072 is formed along the outer side 3058, between the extension 3068 and the adjacent decagonal portion 3076. Two outer diagonal scores 3092A, B are formed in second first layer section 3054, each extending between opposing first inner radial sides 3088A, B and second outer radial sides 3091A, B to bisect the decagonal shape of the decagonal portion 3076. Two inner diagonal scores 3093A, B are formed in each are formed in each second layer section 3054, each extending between opposing first outer radial sides 3090A, B and second inner radial sides 3089A, B to bisect the decagonal shape of the first decagonal portion 3076. A single transverse score 3078 extends across the width of the decagonal portion 3076, between opposite side vertices 3079A, B. The scores 3078, 3092A, B, 3093A, B intersect at the center 3066 of each decagonal portion 3076. The scores divide each decagonal portion 3056 into an outer fifth decagonal portion 3080, an inner fifth decagonal portion 3182, with first 3094A, B, second 3096A, B and third 3098A, B tenth decagonal portions arranged in between along each side of the decagonal portion 3076. Transverse score 3078 splits second tenth decagonal portions 3096A, B each into inner 3062A, B, 3060A, B and outer halves.

A valley, or downwardly extending fold line, is formed along the length of transverse score 3078, extension score 3072 and each outer diagonal score 3092A, B. A ridge, or upwardly extending fold line is formed along the length of each inner diagonal score 3093A, B. The alternating valleys and ridges formed via transverse score 3078, inner diagonal scores 3093A, B and outer diagonal scores 3092A, B result in a first radial pleat 3084A extending along a first side of each second layer section 3054 and a second radial pleat 3084B extending along a second side of each second layer section 3054.

When in the folded configuration of FIG. 36, the inner fifth decagonal portion 3082 forms an upper surface of the body 3012, with the remaining portions of each first layer section 3054, as well as the third layer 3100, folded and sandwiched between the base 3180 and inner fifth decagonal portion 3082. Specifically, first tenth decagonal portion 3094A is folded inward about outer diagonal score 3092A, overlapping inner fifth decagonal portion 3082, inner half 3062A is folded outward about inner diagonal score 3093A, overlapping first tenth decagonal portion 3194A, outer half 3060A is folded inward about transverse score 3078, overlapping inner half 3062A, third tenth decagonal portion 3198A is folded outward about inner diagonal score 3093B, overlapping outer half 3060A, and outer fifth decagonal portion 3080 is folded inward about outer diagonal score 3092B, overlapping third tenth decagonal portion 3188A.

Similarly, on the opposite side of the first layer section 3054, first tenth decagonal portion 3094B is folded inward about outer diagonal score 3092B, overlapping inner fifth decagonal portion 3082, inner half 3062B is folded outward about inner diagonal score 3093B, overlapping first tenth decagonal portion 3194B, outer half 3060B is folded inward about transverse score 3078, overlapping inner half 3062B, third tenth decagonal portion 3098B is folded outward about inner diagonal score 3093A, overlapping outer half 3060B, and outer fifth decagonal portion 3180 is folded inward about outer diagonal score 3092A, overlapping third tenth decagonal portion 3188B.

Extension 3048 is folded inward about extension score 3049, and is housed between outer fifth decagonal portion 3080 and third tenth decagonal portions 3098A, B when the second layer section 3054 is in the folded configuration.

Figure 39:
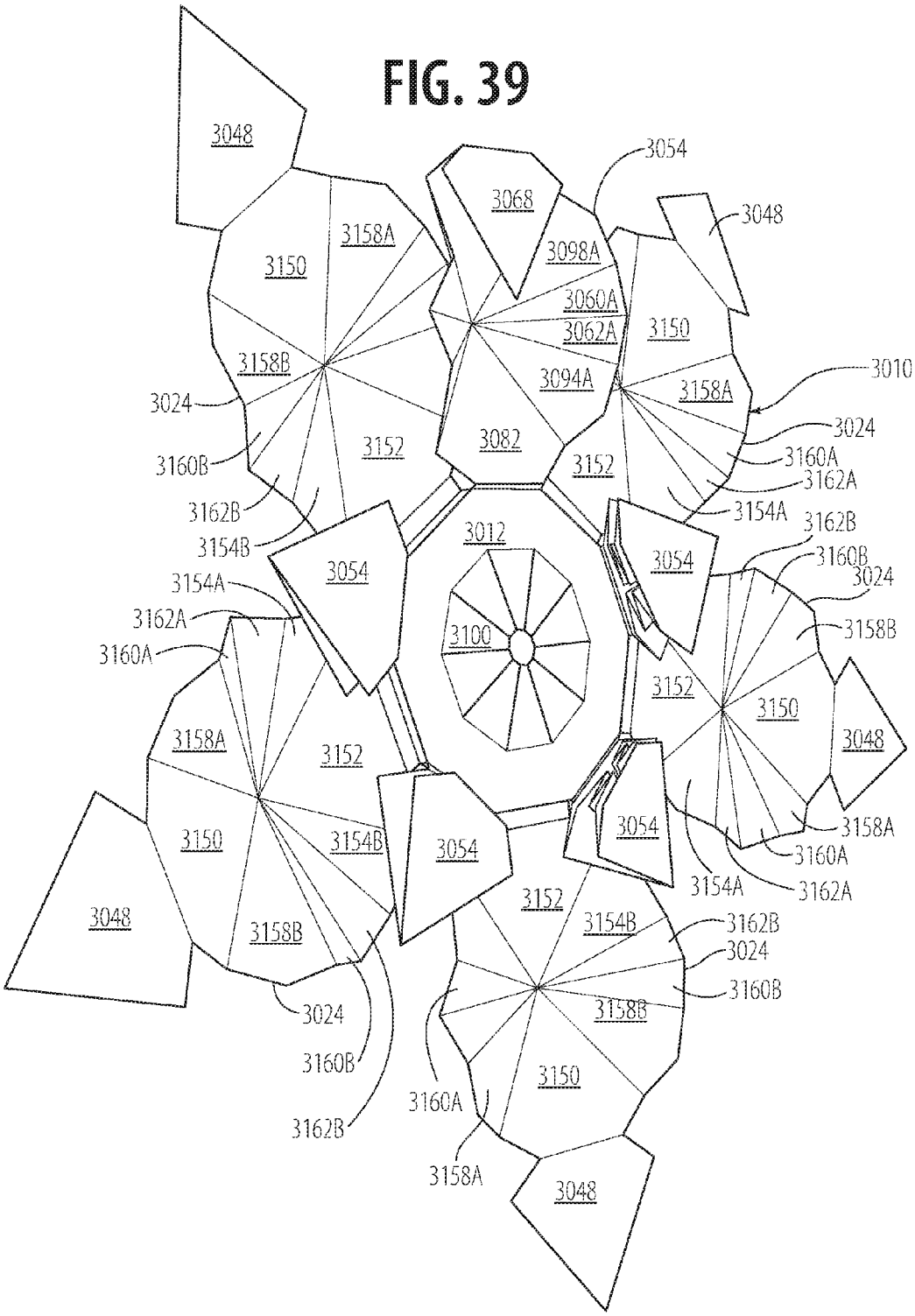
FIG. 39 is a perspective view of the folding book of FIG. 30, showing the second layer in a partially unfolded configuration, with one of the second layer sections shown during unfolding.

In order to move a second layer section 3054 from the folded configuration of FIG. 36, to the unfolded configuration, and move the folding book 3010 into a second stage of expansion, as shown in FIG. 40, outer fifth decagonal portion 3080 is gripped and pivoted outward away from the center 3016 of the folding book body 3012. This action results in unfolding of radial pleats 3084A, B, as shown in FIG. 39 and expansion of the second layer section 3054 into a partially unfolded configuration. Extension 3068 is then pivoted about extension score 3072 to move the second layer section 3054 to the unfolded configuration of FIG. 40A. Repeating this action for each of the second layer sections 3054 moves the second layer 3050 into the unfolded configuration, and the folding book 3010 into the second stage of expansion, as shown in FIG. 40. As shown, each expanded second layer section 3054 is located adjacent to an associated side 3014 of the body 3012 and attached to the base 3018.

Referring to FIGS. 38-42 the third layer 3100 and a third stage of expansion of the folding book 3010 is shown in detail. As shown, the folding book body 3012 defines a cavity 3190 beneath the second layer 3050, which extends downward and terminates at the book base 3180. The cavity 3190 houses the third layer 3100 when in the folded configuration. The cavity 3190 is of a decagonal shape, similar to and smaller than that of the folding book body 3012. In one embodiment, the cavity 90 has a diameter of 5½ inches. The cavity 3190 has ten sides 3192, positioned in radial alignment with the ten sides 3014 of the book body 3012, and ten vertices 3194, positioned in radial alignment with the ten vertices 3018 of the book body 3012.

The third layer 3100, in the folded configuration of FIG. 40, has a decagonal shape and a top surface 3102 forming a portion of the top surface of the folding book 3010 following the second stage of expansion and before the third stage of expansion. The third layer 3100 includes ten vertices 3106 located between each of ten sides 3108. Each of the ten sides 3108 is radially aligned with a first layer section 3024 or a second layer section 3054.

The third layer 3100 is formed of ten identical third layer sections 3104. Each third layer section 3104 moves between a folded configuration, shown in FIG. 40, and an unfolded configuration, shown in FIG. 42. As shown, each third layer section 3104 has an isosceles triangular shape, and in particular forms a tenth of the decagonal shape of the third layer 3100, which is divided in linear cuts extending between opposite vertices 3106. Each third layer section 3104 may have a length of one half the diameter of the cavity 3190. The third layer 3100 may be housed within the cavity 3190 when in the folded configuration, with the sides 3108 each pivotally affixed to the base 3180. An opening 3112 may be formed at the center of the third layer 3100, cutting into the vertex angle of each third layer section 3104. The opening 3112 may be formed by cutting the tip of each third layer section 3104.

Figure 41:
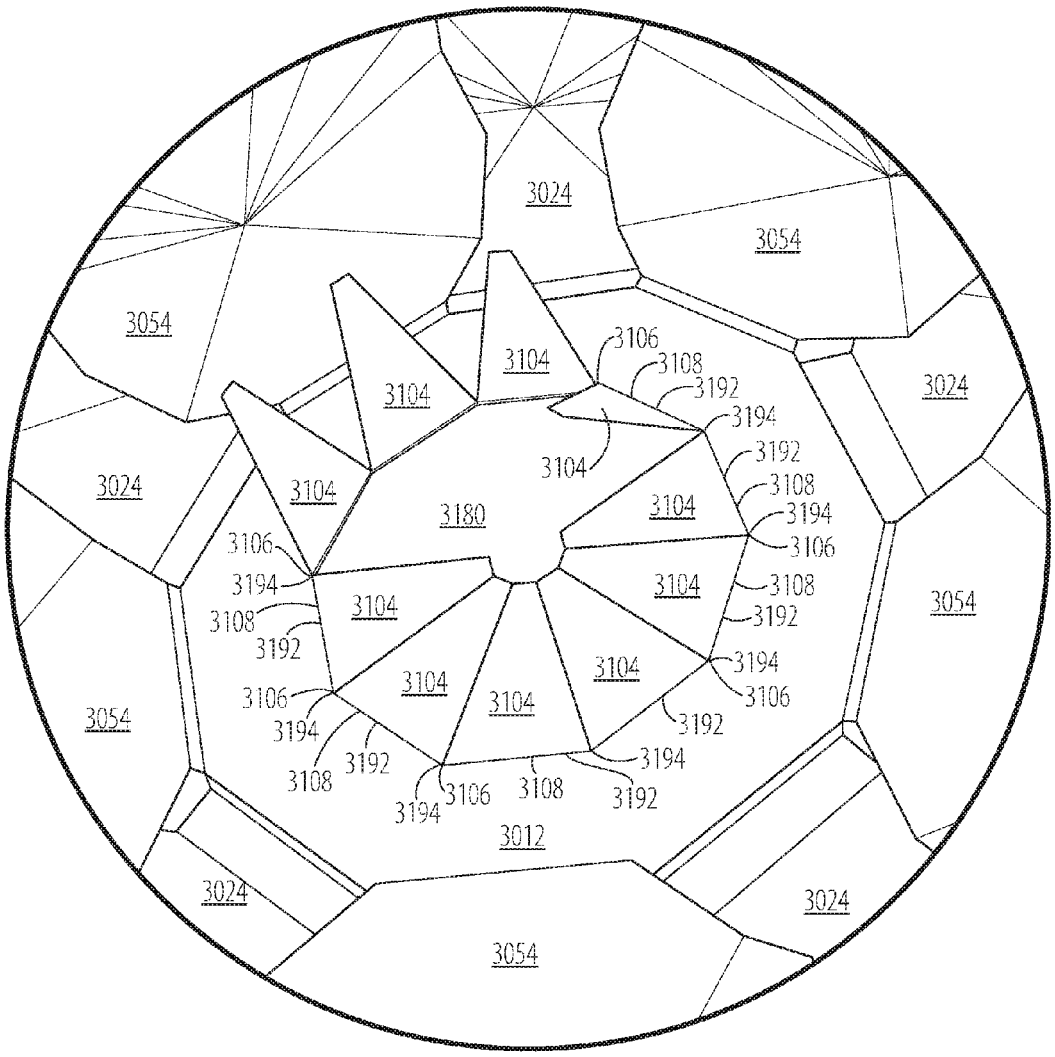
FIG. 41 is an enlarged perspective view of the folding book of FIG. 30, showing the third layer during unfolding.

To move the book third layer 3100 into the unfolded configuration, and in turn move the book 3010 to the fully expanded configuration, each third layer section 3104 is pivoted with respect to the base 3012, as shown in FIG. 41, until it reaches the position shown in FIG. 42. A user may insert a finger into the opening 3112 to facilitate gripping of a third layer section 3104 in order to initiate this pivoting action.

Any of the surfaces of the folding book may include images, such as illustrations, photographic images or text. For example, each surface may include a separate image. Surfaces that are adjacent in any of the stages of unfolding may include images or partial images which, when viewed together, form a single, unitary image. The top surface of the first layer may be configured as a book cover and include a cover image, text or title. The surfaces may include images or text configured to provide information or tell a story when viewed in the order of unfolding the layers described above.

While the invention has been described with reference to the embodiments above, a person of ordinary skill in the art would understand that various changes or modifications may be made thereto without departing from the scope of the claims.

The invention claimed is:

1. A folding book that moves between a collapsed configuration and an expanded configuration, comprising:

a book body having a shape; and a plurality of layers forming the book body, wherein each layer moves between a folded configuration and an unfolded configuration;

wherein the folding book moves from the collapsed configuration to the expanded configuration by moving each layer of the plurality of layers from the folded configuration to the unfolded configuration;

wherein each layer comprises a plurality of layer sections having a folded and unfolded configuration, wherein at least one layer section in the unfolded configuration creates a layer section shape similar to the shape of the book body, and another of the layer sections in the unfolded configuration creates another layer section shape similar to the shape of the book body, and wherein the at least one layer section and the another layer section shapes do not touch one another.

2. The folding book of claim 1, wherein each layer section moves from a folded configuration to an unfolded configuration to move the layer from the folded configuration to the unfolded configuration.

3. The folding book of claim 2, wherein each layer section comprises at least one score to facilitate moving between the folded configuration and unfolded configuration.

4. The folding book of claim 3, wherein the layer section in the unfolded configuration has a triangular shape.

5. The folding book of claim 1, wherein the layers are arranged in a stacked arrangement when the folding book is in the collapsed configuration.

6. The folding book of claim 1, wherein the body has a simple polygonal shape when in the folded configuration.

7. The folding book of claim 1, wherein the book body has a hexagonal shape when in the folded configuration.

8. The folding book of claim 1, wherein the body has an octagonal shape when in the folded configuration.

9. The folding book of claim 1, wherein the body has a dodecagonal shape when in the folded configuration.

10. The folding book of claim 1, wherein each of the layers expands in a radially outward direction to move the book from the collapsed configuration to the expanded configuration.

11. The folding book of claim 1, wherein the body has a decagonal shape when in the folded configuration.

12. A folding book that moves between a collapsed configuration and an expanded configuration, comprising:

a book body having a hexagonal shape; and a plurality of layers forming the book body, each layer comprising a plurality of identical layer sections, each layer section comprising a plurality of scores defining a predetermined fold pattern;

wherein each layer moves between a folded configuration and an unfolded configuration by folding each layer section about the scores; and the folding book moves from the collapsed configuration to the expanded configuration by moving each layer of the plurality of layers from the folded configuration to the unfolded configuration;

wherein at least one layer section in the unfolded configuration creates a hexagonal layer shape similar to the hexagonal shape of the book body, and another of the layer sections creates another layer section shape similar to the hexagonal shape of the book body, and wherein the at least one layer section and the another layer section shapes do not touch one another.

13. The folding book of claim 12, wherein the plurality of layer sections are distributed radially around the body in the unfolded configuration.

14. The folding book of claim 13, wherein each of the layer sections unfolds to expand radially away from a center of the body.

15. The folding book of claim 12, wherein at least one of the layer sections is a hexagonal layer section, having a shape similar to a hexagonal shape of the book body when in the unfolded configuration.

16. The folding book of claim 15, wherein the hexagonal layer section comprises multiple scores that bisect the hexagonal shape into a plurality of triangular shapes, such that the hexagonal layer section is of a triangular shape when in the folded configuration.

17. A method of moving a folded book from a collapsed configuration to an expanded configuration, comprising:

providing the book, the book comprising a book body with a shape and a plurality of layers that each move between a folded configuration and an unfolded configuration;

unfolding each layer in a predetermined order, to move each of the layers from the folded configuration to the unfolded configuration and move the book from the collapsed configuration to an expanded configuration;

wherein each layer comprises a plurality of layer sections, wherein at least one layer section in the unfolded configuration creates a hexagonal layer shape similar to the hexagonal shape of the book body, and another of the layer sections creates another layer section shape similar to the hexagonal shape of the book body, and wherein the at least one layer section and the another layer section shapes do not touch one another.

18. The method of claim 17, wherein the layers are stacked to form the book body, and the method comprises unfolding each layer in a top to bottom order to move the book from the collapsed configuration to the expanded configuration.

19. The method of claim 18, wherein each layer section comprises a plurality of scores defining a predetermined fold pattern, the method comprising unfolding each layer section about the scores.

20. The method of claim 19, wherein unfolding each layer section comprises expanding the layer section outward in a radial direction of the body.

* * * * *